United States Patent [19]

Ishikawa et al.

[11] Patent Number: 4,830,948

[45] Date of Patent: May 16, 1989

[54] METHOD OF FORMING COLOR IMAGES

[75] Inventors: Takatoshi Ishikawa; Genichi Furusawa; Takeshi Hirose, all of Kanagawa, Japan

[73] Assignee: Fuji Photo Film Co., Ltd., Kanagawa, Japan

[21] Appl. No.: 169,633

[22] Filed: Mar. 17, 1988

[30] Foreign Application Priority Data

Mar. 18, 1987 [JP] Japan ..... 62-63526
Mar. 18, 1987 [JP] Japan ..... 62-63527

[51] Int. Cl.[4] ..... G03C 5/24; G03C 5/38; G03C 7/32; G03C 7/40

[52] U.S. Cl. ..... 430/372; 430/393; 430/400; 430/428; 430/430; 430/434; 430/470; 430/472; 430/473; 430/474; 430/475; 430/476; 430/551; 430/642

[58] Field of Search ..... 430/392, 393, 400, 428, 430/430, 434, 470, 472, 473, 474, 475, 476, 551, 642

[56] References Cited

U.S. PATENT DOCUMENTS

| | | | |
|---|---|---|---|
| 3,369,896 | 2/1968 | Seemann et al. | 430/372 |
| 4,018,609 | 4/1977 | Lohmer et al. | 430/503 |
| 4,266,010 | 5/1981 | Nagatomo et al. | 430/642 |
| 4,601,975 | 7/1986 | Koboshi et al. | 430/400 |
| 4,605,611 | 8/1986 | Ohno et al. | 430/400 |
| 4,618,569 | 10/1986 | Kurematsu et al. | 430/399 |
| 4,623,613 | 11/1986 | Ishikawa et al. | 430/372 |
| 4,745,047 | 5/1988 | Asami et al. | 430/372 |
| 4,746,598 | 5/1988 | Kurematsu et al. | 430/372 |
| 4,756,918 | 7/1988 | Ueda et al. | 430/400 |

FOREIGN PATENT DOCUMENTS

| | | |
|---|---|---|
| 0071402 | 2/1983 | European Pat. Off. . |
| 0186158 | 7/1986 | European Pat. Off. . |
| 0204322 | 11/1983 | Fed. Rep. of Germany . |

*Primary Examiner*—Mukund J. Shah
*Attorney, Agent, or Firm*—Sughrue, Mion, Zinn, Macpeak, and Seas

[57] ABSTRACT

A method of forming color photographic images where a silver halide color photographic material containing a coupler which forms a dye by reaction with the oxidation product of an aromatic primary amine developing agent and containing an acid-processed gelatin in an amount of 25% by weight or more of the amount of the total gelatin coated is color developed, desilvered and then rinsed in water and/or stabilized. The total of the processing time of said desilvering, rinsing-in-water and stabilization steps is controlled to be 3 minutes or less, and/or the amount of replenisher added to the rinsing-in-water bath and stabilization bath is controlled to be from 0.5 to 50 times of the amount of the processing solution which is brought into the rinsing-in-water bath and stabilization bath from the desilvering bath together with the material which is being processed. By the method, staining of the processed photographic material in a rapid processing can noticeably be reduced and the amount of the final rinsing or stabilizing solution to be used can noticeably be economized without lowering the image storability of the processed material.

17 Claims, No Drawings

METHOD OF FORMING COLOR IMAGES

FIELD OF THE INVENTION

The present invention relates to a method of forming color images in a silver halide color photographic material and, more precisely, to an economical and practically advantageous method of forming color images where staining of the processed photographic material in rapid processing can be reduced to a large extent and the amount of the final rinsing solution or stabilization solution to be used can be reduced remarkably without lowering the image storability of the processed material.

BACKGROUND OF THE INVENTION

A color developer containing an aromatic primary amine color developing agent has been used in the past for formation of photographic color images, and at present, such a color developer plays a main role in the image formation method in color photography. However, such a color developer has a problem in that it is extremely easily oxidized with air or metals, and it is well known that the use of the oxidized developer for the formation of color images causes an increase in fog and an increase in the fluctuation of the sensitivity or gradation, with the result that the desired photographic characteristics cannot be obtained.

In particular, the fluctuation of photographic characteristics in continuous processing is apt to become large because of the shortened processing time that is being used in the recent photographic processing techniques. As the case may be, there is often a severe problem in that the processed photographic material becomes color-stained. In particular, when the desilvering step, rinsing-in-water step, etc., are shortened, such a problem is apt to occur frequently.

Various reasons, for example, as mentioned below, are considered to cause the color stain in the short time processing.

(A) The color developer deteriorates after being used or stored for a long period of time so that the photographic property thereof changes and the oxidation product of the developing agent in the developer adheres to the photographic material which is being processed, and as a result, the photographic material becomes color-stained because of an insufficient washing out of the adhered substance.

(B) The color developing agent is brought into the next bleaching bath or bleach-fixing bath, where the color developing agent is oxidized to cause the generation of fog or color stain.

(C) Substances which dissolve out from the photographic material which is being processed accumulate in the color developer so that the thus accumulated substances again adhere to the photographic material to cause color stain thereon.

(D) The dyes or sensitizing dyes contained in the photographic material cannot sufficiently be washed out so that the photographic material itself becomes colored.

(E) The bleach-fixing solution and the rinsing water or stabilization solution in the bath which follows the bleach-fixing solution deteriorate after being used or stored for a long period of time so that the photographic material which is being processed becomes color-stained.

In particular, in order to overcome the above-mentioned points (A) and (B), an improvement of the stability of the color developer to be used is an indispensable requirement, and various studies have heretofore been carried out up to the present.

For example, in order to improve the stability of a color developer, various kinds of preservatives and chelating agents have been investigated. For example, preservatives include the aromatic polyhydroxy compounds described in Japanese Patent Application (OPI) Nos. 49828/77, 160142/84 and 47038/81 (the term "OPI" as used herein refers to a "published unexamined Japanese Patent Application"), U.S. Pat. No. 3,746,544, etc.; the hydroxycarbonyl compounds described in U.S. Pat. No. 3,615,503, British Pat. No. 1,306,176, etc.; the α-aminocarbonyl compounds described in Japanese Patent Application (OPI) Nos. 143020/77 and 89425/78, etc.; the alkanolamines described in Japanese Patent Application (OPI) No. 3532/79, etc.; the metal salts described in Japanese Patent Application (OPI) Nos. 44148/82 and 53749/82, etc. Chelating agents include, for example, the aminopolycarboxylic acids described in Japanese Patent Publication Nos. 30496/73 and 30232/69, etc.; the organic phosphonic acids described in Japanese Patent Application (OPI) No. 97347/81, Japanese Patent Publication No. 39359/81, West German Patent No. 2,227,639, etc.; the phosphonocarboxylic acids described in Japanese Patent Application (OPI) Nos. 102726/77, 42730/78, 121127/79, 126241/80 and 65956/80, etc.; the compounds described in Japanese Patent Application (OPI) Nos. 195845/83 and 203440/83, Japanese Patent Publication No. 40900/78, etc.; the organic phosphonic acid series chelating agents described in *Research Disclosure,* Nos. 18837 and 17048, etc.

However, even by employing the above technique for improving preservability, it was still impossible to completely prevent the coloration and deterioration of the color developers. Regarding the sulfite ions which are known to be effective for preventing the coloration of developers, it is impossible to use a large amount of the sulfite ion when forming color images, contrary to the case of black-and-white developers, because the sulfite ion has a bad influence on the color forming property and has a solvent effect toward silver halides. In fact, recently the absence of the sulfite ion is rather considered favorable in view of the improvement of the color forming property. Accordingly, the coloration of color developers is becoming a more severer problem in this technical field.

If the time for the desilvering step, rinsing-in-water step, etc., which are carried out after the color development step is shortened under such a situation where the coloration and deterioration of the color developer to be used cannot completely be prevented, it is inevitable that the resulting stain of the photographic material in the color developer cannot sufficiently be washed out. Accordingly, the development of silver halide color photographic materials which are hardly stained has been strongly desired.

On the other hand, in the rinsing-in-water step, etc., in the processing procedure of silver halide photographic materials, it has recently become desirable to use less water for the purpose of preventing environmental pollution, economizing water resources and decreasing manufacturing cost. For example, S. R. Goldwasser, *Journal of the Society of Motion Picture and Television Engineers,* Vol. 64, pages 248–253 (May, 1955), "Water Flow Rates in Immersion Washing of Motion Picture Film" has proposed a method of reducing the amount of water to be used in the rinsing-in-water step where the water is run by a countercurrent flow system using plural stages of rinsing tanks. This method is utilized in various kinds of automatic developing machines as an effective means for water economization.

Apart from the above method, there is a different method where a stabilizer solution containing various kinds of chemicals is used in place of water in the rinsing step so as to reduce the amount of the processing solution to be used in the rinsing step (Japanese Patent Application (OPI) Nos. 8542/82, 14834/83, 132146/82, 18631/83 and 184345/84, etc.).

However, in any of the above methods, if the amount of the replenisher to be added to the final rinsing-in-water step or stabilization step is reduced, the removal of the iron complex existing in the bleaching solution or bleach-fixing solution and, in particular, the removal of the developing agent existing in the developer would be insufficient with the result that yellow, magenta and cyan stains which would be derived from the iron complex or developing agent would increase after storage. Anyway, all of the known methods have some defects.

In particular, in the case of reflective materials (for example, color papers), such stain would be amplified to several times because of optical reasons, as compared with light transmitting materials, and, therefore, even a slight stain would detract from the image quality. Accordingly, stain is an extremely important factor for evaluating photographic characteristics.

SUMMARY OF THE INVENTION

The object of the present invention is to provide a method of forming color images by rapid processing, in which the color stain in the processed color photographic material is extremely reduced, and the amount of the processing solution to be used in the final rinsing-in-water step and/or stabilization step can noticeably be reduced without deteriorating the image stability of the material processed.

The above and other objects which will be apparent from the description can be attained by a method of forming color images where a silver halide color photographic material containing a coupler which forms a dye by reaction with the oxidation product of an aromatic primary amine developing agent and containing an acid-processed gelatin in an amount of 25% by weight or more of the amount of the total gelatin coated is color-developed, desilvered and then rinsed in water and/or stabilized, comprising: controlling the total of the processing time of the desilvering, rinsing-in-water and stabilization steps to be 3 minutes or less, and/or controlling the amount of replenisher added to the rinsing-in-water bath and stabilization bath to be from 0.5 to 50 times of the amount of the processing solution which is brought into the rinsing-in-water bath and stabilization bath from the desilvering bath together with the material which is being processed.

DETAILED DESCRIPTION OF THE INVENTION

In the method of the present invention, "the amount of replenisher added to the rinsing-in-water bath and stabilization bath is from 0.5 to 50 times of the amount of the processing solution which is brought into the rinsing-in-water bath and stabilization bath from the desilvering bath together with the material which is being processed" means to define the amount of the replenisher which is used in the processing step between the desilvering step and the drying step. When the processing step between the desilvering step and the drying step comprises a rinsing-in-water step and a stabilization step, the amount of replenisher added means the total amount that is used in both the rinsing-in-water step and stabilization step. On the other hand, when the processing step between the desilvering step and the drying step comprises the rinsing-in-water step only, the amount of replenisher added means the total amount that is added to only the rinsing-in-water step.

Next, the present invention will be explained in detail hereinafter.

The acid-processed gelatin for use in the present invention is a gelatin which is obtained from collagen by treatment with hydrochloric acid or the like, and this is different from an alkali-processed gelatin obtained by treatment with lime or the like, which is generally utilized in a photographic industrial field. The details of the manufacture and properties of these gelatins are described in Arthur Veis, *The Macromolecular Chemistry of Gelatin* (by Academic Press, 1964), pages 187 to 217. The most important difference between the two is that the acid-processed gelatin has an isoelectric point (PI) of from 6.0 to 9.5, while the alkali-processed gelatin has a PI of from 4.5 to 5.3.

The use of an acid-processed gelatin in a color photographic material is described in Japanese Patent Publication No. 43777/76, Japanese Patent Application (OPI) Nos. 8938/76 and 5624/78, etc., which, however, relate to improvement of the reticulation of the film surface of the material. The fact that the stain of color photographic materials could noticeably be prevented by the use of an acid-processed gelatin was quite unexpected and surprising.

The effect of the acid-processed gelatin for preventing the stain of color photographic materials is presumed to be caused by the fact that the oxidation product of a color developing agent would hardly adhere to the acid-processed gelatin.

The amount of the acid-processed gelatin in the color photographic material for use in the present invention is 25% by weight or more, preferably 40% by weight or more, and more preferably 50% by weight or more, of the total amount of the gelatin coated on the photographic material. The upper limit of the amount of the acid-processed gelatin is 100% by weight.

The acid-processed gelatin for use in the present invention has an isoelectric point of from 6 to 9.5, preferably from 7 to 9.5, more preferably from 8 to 9.5.

The molecular weight of the acid-processed gelatin for use in the present invention is not specifically limitative but may be from 10,000 to 200,000.

As a gelatin which can be used together with the acid-processed gelatin in the method of the present invention, there may be mentioned a gelatin which is hereinafter referred to as the binder mentioned below.

The "total amount of the gelatin coated on the photographic material" means the total amount of the gelatin as coated on both surfaces of the support of the material, but preferably, this means the total amount of the gelatin which is coated on the side of the support having the silver halide emulsion layer.

The "total amount of the gelatin coated on the photographic material" is preferably from 1 to 30 g, more preferably from 2 to 20 g, per $m^2$ of the photographic material.

In the method of the present invention, the amount of the acid-processed gelatin in the photographic material is to be 25% by weight or more. If this amount is less than 25% by weight, it is difficult to sufficiently prevent stain in the material which is being processed.

The method of the present invention can be applied to any processing technique which uses a color developer. For example, it is suitable for photographic processing of color papers, color reversal papers, color direct positive photographic materials, color positive films, color negative films, color reversal films, etc., and in particular, it is preferably applied to photographic processing of color papers and color reversal papers.

The silver halide emulsion of the photographic material which is to be processed by the method of the present invention may have any halogen composition, for example, comprising silver iodobromide, silver bromide, silver chlorobromide, silver chloride, etc. For instance, when color papers are processed by a rapid processing procedure or by reduced and economized replenishment, the emulsion is preferably a silver chlorobromide emulsion containing 60 mol% or more silver chloride or a silver chloride emulsion, and more preferably the content of silver chloride in the emulsion is from 80 to 100 mol%. In case a high sensitivity is required and fog during manufacture, storage and/or processing is especially required to be lowered, a silver chlorobromide emulsion containing 50 mol% or more silver bromide or a silver bromide emulsion (which may contain 3 mol% or less silver iodide) is preferred, and more preferably the silver bromide content in the emulsion is 70 mol% or more. For color photographic materials for picture taking, a silver iodobromide emulsion or silver chloroiodobromide emulsion is preferred, where the silver iodide content is preferably from 3 to 15 mol%.

The silver halide grains for use in the present invention may have a different structure between the inside and the surface layer thereof, may have a structure having a junction structure, or may have a uniform phase or composition throughout the whole grain. Also, the silver halide grains may be composed of a mixture of these grains having different phase structures.

The mean grain size distribution of the silver halide grains for use in the present invention may be narrow or broad, but a so-called monodispersed silver halide emulsion wherein the value (fluctuation) obtained by dividing the standard deviation in the grain size distribution curve of the silver halide emulsion by the mean grain size is within about 20%, and preferably within 15%, is preferably used in the present invention. Also, for satisfying the gradation required for the color photographic material, two or more kinds of monodispersed silver halide emulsions (preferably having the above-mentioned fluctuation value as to monodispersibility) can exist in an emulsion layer having substantially the same color sensitivity as a mixture thereof or exist in two or more emulsion layers, respectively, each having substantially the same color sensitivity. Furthermore, two or more kinds of polydispersed silver halide emulsions or a combination of a monodispersed emulsion and a polydispersed emulsion can be used in one emulsion layer as a mixture thereof or in two or more layers, respectively.

The silver halide grains for use in the present invention may have a regular crystal form such as cubic, octahedral, rhombododecahedral or tetradecahedral or a combination thereof, or an irregular crystal form such as spherical, or further a composite form of these crystal forms. Also, a tabular grain silver halide emulsion can be used in the present invention. In particular, a tabular grain silver halide emulsion wherein tabular silver halide grains having an aspect ratio (length/thickness) of from 5 to 8 or more than 8 account for 50% or more of the total projected area of the silver halide grains may be used. The silver halide emulsion for use in the present invention may be a mixture of these emulsions containing silver halide grains each having different crystal forms.

Also, the silver halide grains may be of a surface latent image type capable of forming latent images mainly on the surface thereof or of an internal latent image type capable of forming latent images mainly in the inside thereof.

The photographic emulsions for use in the present invention can be prepared by the method described in *Research Disclosure,* Vol. 170, Item No. 17643, I, II, III (December, 1978).

The photographic emulsions are generally subjected to physical ripening, chemical ripening and spectral sensitization, for use in the present invention. The additives to be used in the said steps of ripening and sensitization are described in *Research Disclosure* (RD), Vol. 176, No. 17643 (December, 1978) and ibid., Vol. 187, No. 18716 (November, 1979), and the relevant parts are summarized in the following Table.

Known photographic additives which can be used in the present invention are also described in the above two *Research Disclosure's,* and the relevant parts are also mentioned in the following Table.

| Additives | RD 17643 | RD-18716 |
|---|---|---|
| 1. Chemical Sensitizer | p. 23 | p. 648, right column |
| 2. Sensitivity Enhancer | | p. 648, right column |
| 3. Spectral Sensitizer | pp. 23–24 | from p. 648, right column to p. 649, right column |
| 4. Super Color Sensitizer | | |
| 5. Brightening Agent | p. 24 | |
| 6. Antifoggant, Stabilizer | pp. 24–25 | p. 649, right column |
| 7. Coupler | p. 25 | |
| 8. Organic Solvent | p. 25 | |
| 9. Light Absorber, Filter Dye | pp. 25–26 | from p. 649, right column to p. 650, left column |
| 10. UV Absorber | | |
| 11. Stain Inhibitor | p. 25, right column | p. 650, from left to right column |
| 12. Color Image Stabilizer | p. 25 | |
| 13. Hardener | p. 26 | p. 651, left column |
| 14. Binder | p. 26 | p. 651, left column |
| 15. Plasticizer, Lubricant | p. 27 | p. 650, right column |
| 16. Coating Assistant, Surfactant | pp. 26–27 | p. 650, right column |
| 17. Antistatic Agent Lubricant | p. 27 | p. 650, right column |

Various kinds of color couplers can be used in the present invention. The color coupler herein referred to means a compound capable of forming a dye by a coupling reaction with the oxidation product of an aromatic primary amine developing agent. Specific examples of usable color couplers include naphthol or phenol series compounds, pyrazolone or pyrazoloazole series compounds and open chain or heterocyclic ketomethylene compounds. Examples of the cyan, magenta and yellow couplers which can be used in the present invention are described in the patents as referred to in *Research Disclosure,* (RD) No. 17643 (December, 1978), VII-D and ibid., No. 18717 (November, 1979).

It is preferred that the couplers to be incorporated into the color photographic materials which are processed by the process of the present invention are non-diffusible as the result of having a ballast group or being polymerized. Also, the use of 2-equivalent color couplers substituted by a releasable group can reduce the amount of silver for the color photographic materials as compared to 4-equivalent color couplers having a hydrogen atom at the coupling active group. Couplers giving colored dyes having a proper diffusibility, non-color-forming couplers, DIR couplers releasing a development inhibitor with coupling reaction, or DAR couplers releasing a development accelerator with coupling reaction can also be used in the present invention.

As the yellow couplers for use in the present invention, there are oil protect type acylacetamido series couplers as the typical examples. Specific examples of these couplers are described in U.S. Pat. Nos. 2,407,210, 2,875,057, 3,265,506, etc. In the present invention, 2-equivalent yellow couplers are preferably used and specific examples of these yellow couplers are the oxygen atom-releasing type yellow couplers described in U.S. Pat. Nos. 3,408,194, 3,447,928, 3,933,501, 4,022,620, etc., and the nitrogen atom-releasing type yellow couplers described in Japanese Patent Publication No. 10739/80, U.S. Pat. Nos. 4,401,752, 4,326,024, *Research Disclosure,* No. 18053 (April, 1979), British Pat. No. 1,424,020, West German Patent Application (OLS) Nos. 2,219,917, 2,261,361, 2,329,587, 2,433,812, etc. In these yellow couplers, α-pivaloylacetanilide couplers are excellent in fastness, in particular light fastness of colored dyes formed, while α-benzoylacetanilide couplers are excellent in coloring density.

As the magenta couplers for use in the present invention, there are oil protect type indazolone series or cyanoacetyl series couplers, and preferably 5-pyrazolone series magenta couplers and other pyrazoloazole series couplers such as pyrazoloazoles, etc. As the 5-pyrazolone series couplers, those substituted by an arylamino group or an acylamino group at the 3-position thereof are preferred from the viewpoint of the hue and coloring density of the colored dyes formed. Specific examples of these couplers are described in U.S. Pat. Nos. 2,311,082, 2,343,703, 2,600,788, 2,908,573, 3,062,653, 3,152,896 and 3,936,015, etc. Also, as the releasable groups for the 2-equivalent 5-pyrazolone series couplers, the nitrogen atom-releasing groups described in U.S. Pat. No. 4,310,619 and the arylthio groups described in U.S. Pat. No. 4,351,897 are preferred. Furthermore, the 5-pyrazolone series magenta couplers having a ballast group described in European Pat. No. 73,636 give high coloring density.

As the pyrazoloazole series couplers, there may be mentioned the pyrazolobenzimidazoles described in U.S. Pat. No. 3,369,879, preferably the pyrazolo[5,1-c][1,2,4]triazoles described in U.S. Pat. No. 3,725,067, the pyrazolotetrazoles described in *Research Disclosure,* No. 24220 (June, 1984), and the pyrazolopyrazoles described in *Research Disclosure,* No. 24230 (June, 1984). The imidazo[1,2-b]pyrazoles described in European Pat. No. 119,741 are preferred because of the small yellow side absorption of the colored dye and of the sufficient light fastness thereof, and in particular, the pyrazolo[1,5-b][1,2,4]triazoles described in European Pat. No. 119,860 are especially preferred.

As the cyan couplers for use in the present invention, there are oil protect type naphthol series or phenol series couplers. Specific examples of the naphthol series couplers include the cyan couplers described in U.S. Pat. No. 2,474,293 and preferably the oxygen atom-releasing type 2-equivalent naphthol series couplers described in U.S. Pat. Nos. 4,052,212, 4,146,396, 4,228,233 and 4,296,200. Also, specific examples of the phenol series cyan couplers are described in U.S. Pat. Nos. 2,369,929, 2,801,171, 2,772,162, 2,895,826, etc. Cyan couplers having high fastness to humidity and temperature are preferably used in the present invention and specific examples of these cyan couplers include the phenol series cyan couplers having an alkyl group of 2 or more carbon atoms at the meta-position of the phenol nucleus described in U.S. Pat. No. 3,772,002; the 2,5-diacylamino-substituted phenol series cyan couplers described in U.S. Pat. Nos. 2,772,162, 3,758,308, 4,126,396, 4,334,011, 4,327,173, West German Patent Application (OLS) No. 3,329,729, Japanese Patent Application (OPI) No. 166956/84, etc.; and the phenol series couplers having a phenylureido group at the 2-position thereof and an acyamino group at the 5-position thereof described in U.S. Pat. Nos. 3,446,622, 4,333,999, 4,451,559 and 4,427,767.

In the present invention by using couplers giving colored dyes having a proper diffusibility together with the aforesaid color couplers, the graininess of color images formed can be improved. Specific examples of magenta couplers giving such diffusible dyes are described in U.S. Pat. No. 4,366,237 and British Pat. No. 2,125,570 and specific examples of yellow, magenta and cyan couplers of this type are described in European Pat. No. 96,570 and West German Patent Application (OLS) No. 3,234,533.

The dye-forming couplers and the above-described specific couplers for use in the present invention may form dimers or higher polymers. Typical examples of the polymerized dye-forming couplers are described in U.S. Pat. Nos. 3,451,820 and 4,080,211. Also, specific examples of the polymerized magenta couplers are described in British Pat. No. 2,102,173 and U.S. Pat. No. 4,367,282.

The various kinds of couplers for use in the present invention may be used in the same photographic layer of a color photographic material as a combination of two or more kinds thereof for meeting particular characteristics desired for a color photographic material, or the same kind of coupler may be used in two or more photographic layers for meeting desired characteristics.

In the practice of the present invention, especially preferred couplers are yellow couplers represented by the general formula (I) mentioned below, magenta couplers represented by the general formulae (II) or (III) mentioned below and cyan couplers represented by the general formulae (IV) or (V) mentioned below.

All of these couplers are preferably used since the color reproducibility is excellent, the amount of silver to be used may be small and the manufacturing cost is low. However, when the amount of the replenisher to be used in the rinsing step is lowered, the photographic material which is being processed is often stained, because the developing agent remains in the processed material. Accordingly, the use of the above couplers is defective with respect to this point. The problem can effectively be overcome by the use of the acid-processed gelatin in the preparation of the color photographic material in accordance with the present invention, which is to be especially mentioned.

It is noted that the use of yellow, magenta and cyan couplers in the same photographic material is more preferred in the practice of the present invention.

Yellow Coupler:

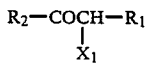

(I)

Magenta Coupler:

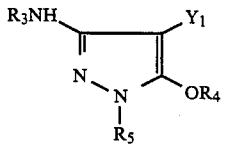

(II)

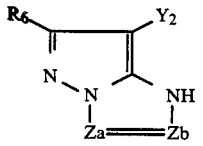

(III)

Cyan Coupler:

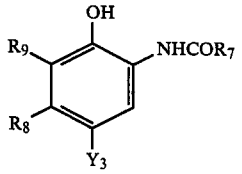

(IV)

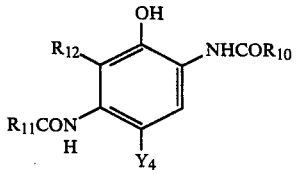

(V)

The term "aliphatic group" as used herein represents straight chain, branched chain or cyclic aliphatic hydrocarbon groups and includes saturated or unsaturated aliphatic groups such as alkyl, alkenyl and alkynyl groups; typical examples include a methyl group, an ethyl group, a butyl group, a dodecyl group, an octadecyl group, an eicosenyl group, an isopropyl group, a tert-butyl group, a tert-octyl group, a tert-dodecyl group, a cyclohexyl group, a cyclopentyl group, an alkyl group, a vinyl group, a 2-hexadecenyl group and a propargyl group.

In these formulae, $R_1$ represents a substituted or unsubstituted N-phenylcarbamoyl group, wherein the substituents are those well known in yellow couplers and include an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, a carboxyl group, a sulfo group, a nitro group, a cyano group, and a thiocyano group; $R_1$ may have at least two substituents which may be the same or different;

$R_2$ represents a tertiary alkyl group having from 4 to 20 carbon atoms or a substituted or unsubstituted phenyl group, typical substituents being a t-butyl group, a t-amyl group, a t-octyl group, a 1,1-diethylpropyl group, a 1,1-dimethylhexyl group and a 1,1,5,5-tetramethylhexyl group, with the substituents represented by $R_1$ being typical ones in the substituted phenyl group;

$R_3$ and $R_5$ each represents a substituted or unsubstituted phenyl group, wherein the phenyl group may have a substituent selected from the group consisting of an alkyl group, an aryl group, a heterocyclic group, an alkoxy group, an aryloxy group, an alkenyloxy group, an acyl group, an ester group, an amido group, a carbamoyl group, a sulfamoyl group, an imido group, a ureido group, an aliphatic or aromatic sulfonyl group, an aliphatic or aromatic thio group, a hydroxyl group, a cyano group, a carboxyl group, a nitro group, a sulfo group, and a halogen atom;

$R_4$ represents a hydrogen atom, an aliphatic or aromatic acyl group or an aliphatic or aromatic sulfonyl group, with a hydrogen atom being preferred;

$R_6$ represents a hydrogen atom or a substituent;

$R_7$, $R_{10}$ and $R_{11}$ each represents an aliphatic group, an aromatic group, a heterocyclic group, an aromatic amino group or a heterocyclic amino group;

$R_8$ represents an aliphatic group having preferably from 1 to 20 carbon atoms;

$R_9$ and $R_{12}$ each represents a hydrogen atom, a halogen atom, an aliphatic group having preferably from 1 to 20 carbon atoms, an aliphatic oxy group having preferably from 1 to 20 carbon atoms or an acylamino group having preferably from 1 to 20 carbon atoms;

Za and Zb each represents a methine group, a substituted methine group or =N—;

$X_1$, $Y_1$, $Y_2$, $Y_3$ and $Y_4$ each represents a group capable of being released by a coupling reaction with the oxidation product of a developing agent (hereinafter referred to as a releasable group); and $R_1$, $R_2$ or $X_1$; $R_3$, $R_4$, $R_5$ or $Y_1$; $R_6$, Za, Zb or $Y_2$; $R_7$, $R_8$, $R_9$ or $Y_3$; $R_{10}$, $R_{11}$, $R_{12}$ or $Y_4$ may form a dimer or a higher polymer.

In general formulae (IV) and (V), respective releasable groups $Y_3$ and $Y_4$ each includes, for example, a halogen atom, a sulfo group, an alkoxy group, an acyloxy group, an aryloxy group, a heterocyclic oxy group, an alkylthio group, an arylthio group and a heterocyclic thio group; $R_7$, $R_{10}$ and $R_{11}$ each represents an aliphatic group having preferably from 1 to 36 carbon atoms, an aromatic group having preferably from 6 to 36 carbon atoms, a heterocyclic group, and an aromatic or heterocyclic amino group, wherein these groups may be substituted with an alkyl group, an aryl group, a heterocyclic group, an alkoxy group, an aryloxy group, an alkenyloxy group, an acyl group an ester group, an amido group, a sulfonamido group, an imido group, a ureido group, an aliphatic or aromatic sulfonyl group, an aliphatic or aromatic thio group, a hydroxyl group, a cyano group, a carboxyl group, a nitro group, a sulfo group or a halogen atom;

$R_8$ and $R_9$ together, and $R_{11}$ and $R_{12}$ together may form a 5-, 6- or 7-membered ring.

In the formula (I), $X_1$ preferably represents the following group (VI), (VII) or (VIII).

(VI)

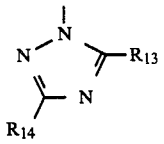

(VII)

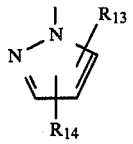

in which $R_{13}$ and $R_{14}$ each represents a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, an unsubstituted or substituted phenyl group or a heterocyclic group, and these substituents $R_{13}$ and $R_{14}$ may be the same or different.

(VIII)

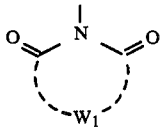

in which $W_1$ represents a nonmetallic atom group necessary for forming a 4-membered, 5-membered or 6-membered ring together with the moiety

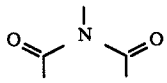

in the formula.

Specific examples of the groups represented by formula (VIII) are represented by the following formulae (IX), (X) and (XI).

(IX)

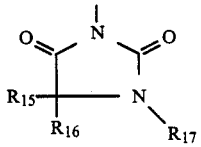

(X)

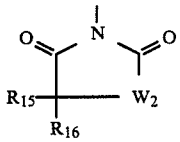

(XI)

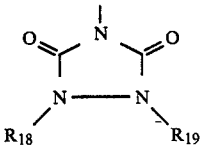

in which $R_{15}$ and $R_{16}$ each represents a hydrogen atom, an alkyl group, an aryl group, an alkoxy group, an aryloxy group or a hydroxyl group; $R_{17}$, $R_{18}$ and $R_{19}$ each represents a hydrogen atom, an alkyl group, an aryl group, an aralkyl group or an acyl group; and $W_2$ represents an oxygen atom or a sulfur atom.

The compounds represented by general formula (III) are 5-membered-5-membered condensed nitrogen heterocyclic type couplers, have chromophores with an aromaticity isoelectric to naphthalene, and have chemical structures generally called azapentalene. Among the couplers represented by general formula (III), preferred compounds are 1H-imidazo[1,2-b]pyrazoles, 1H-pyrazolo[5,1-c][1,2,4]triazoles, 1H-pyrazolo[1,5-b][1,2,4]triazoles and 1H-pyrazolo[1,5-d]tetrazoles.

Preferred examples of the couplers of the formula (I) include the following compounds.

(A-1)

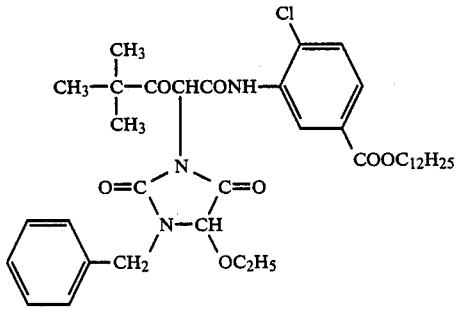

-continued
(A-2)
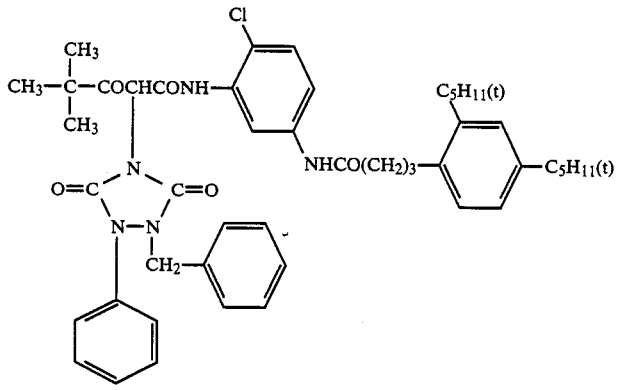
(A-3)
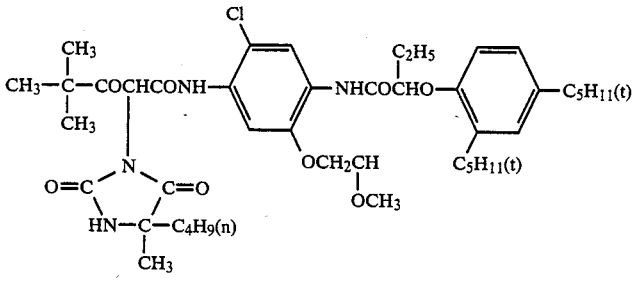
(A-4)
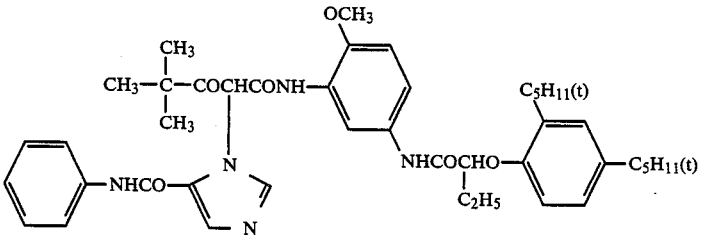
(A-5)
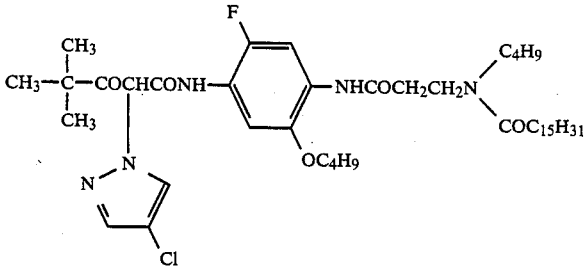
(A-6)
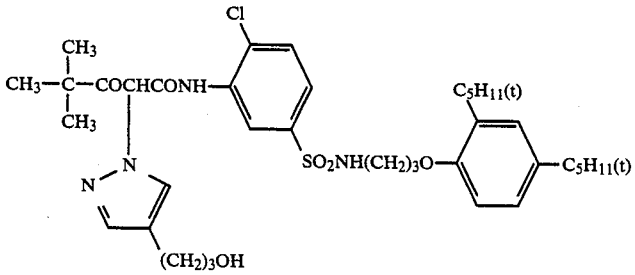

-continued
(A-7)
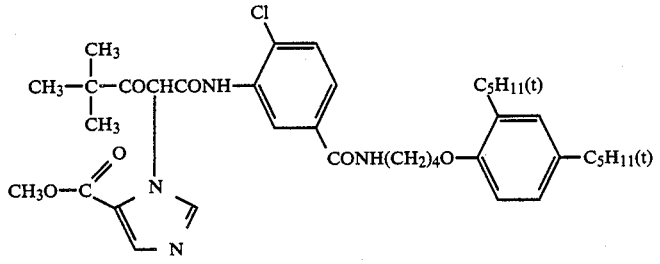
(A-8)
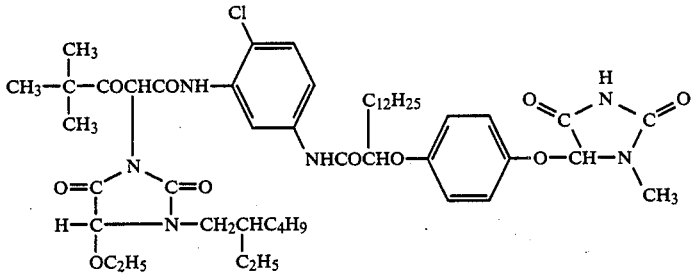
(A-9)
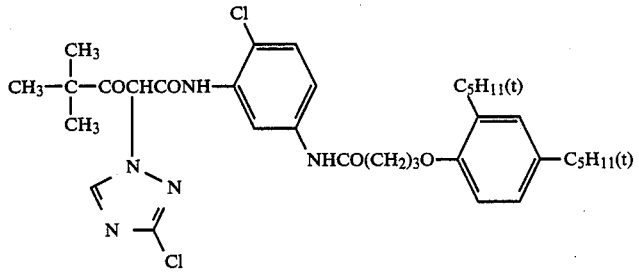
(A-10)
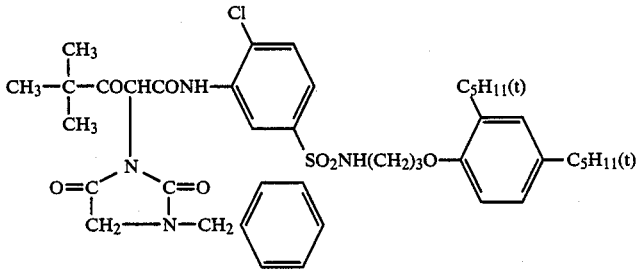
(A-11)
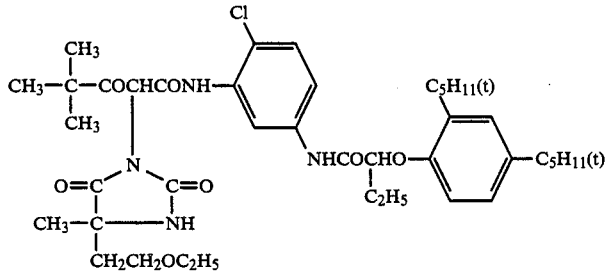
(A-12)
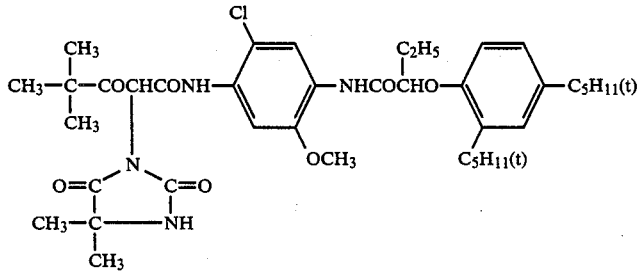

-continued
(A-13)
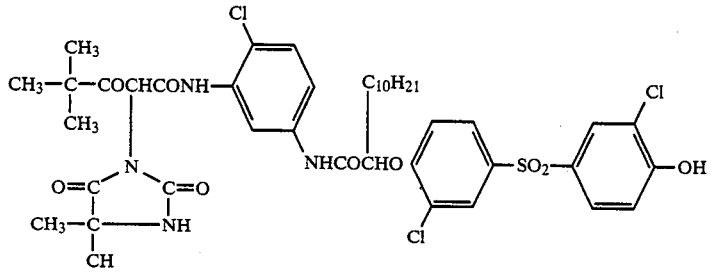
(A-14)
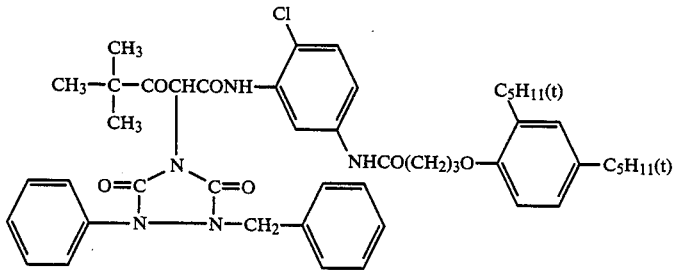
(A-15)
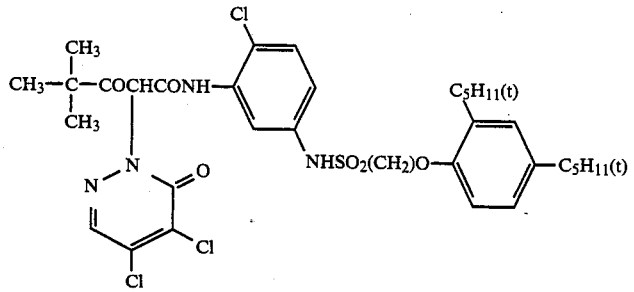
(A-16)
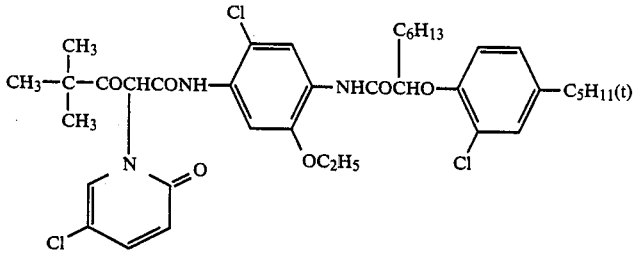
(A-17)
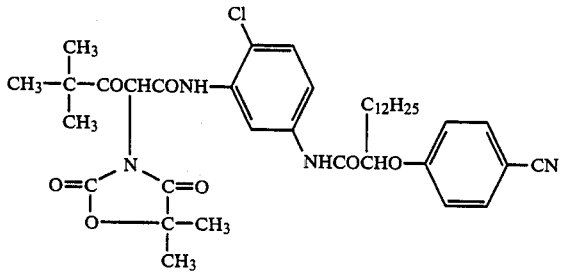

-continued
(A-18)
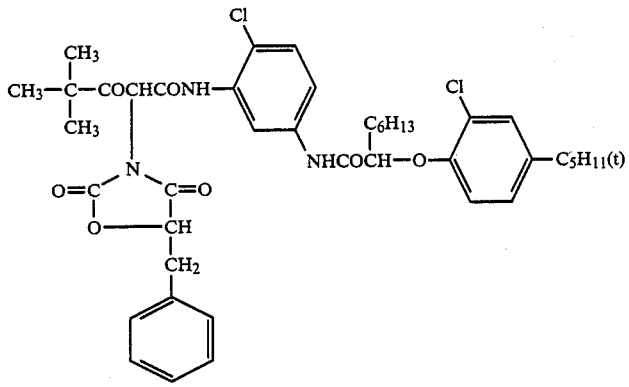
(A-19)
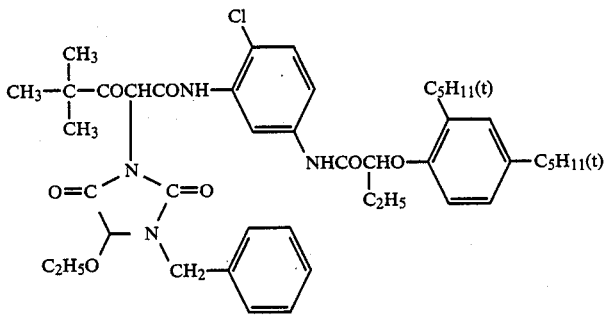
(A-20)
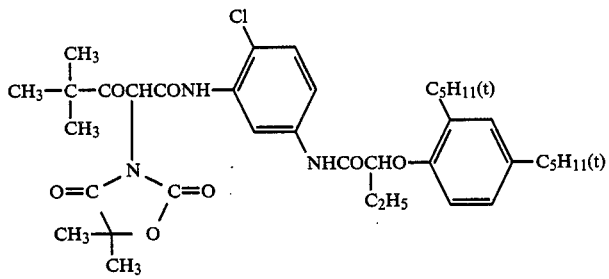
(A-21)
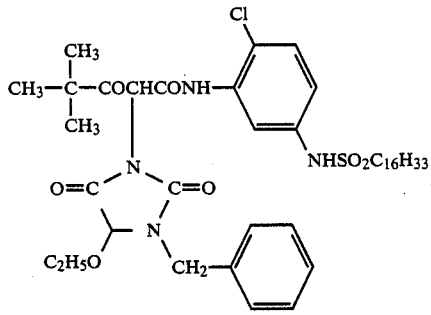
(A-22)
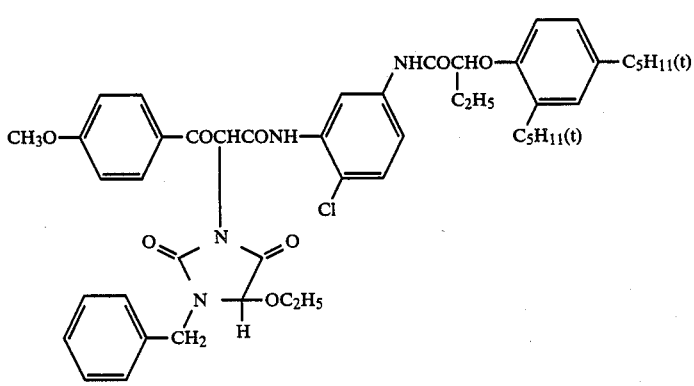

-continued
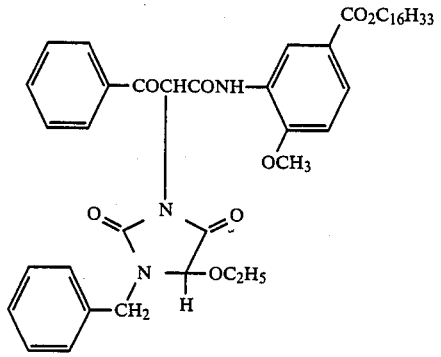
(A-23)
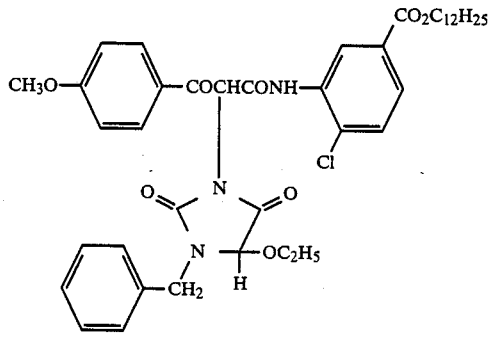
(A-24)
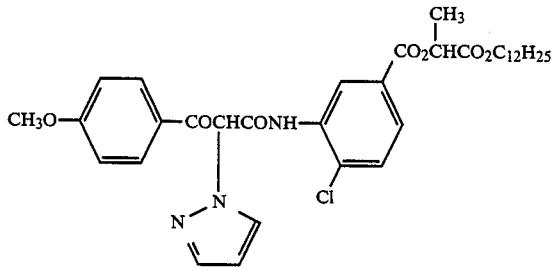
(A-25)
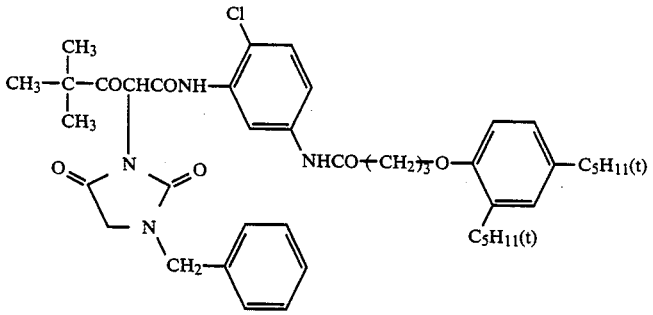
(A-26)
Preferred examples of the couplers of the formulae (II) and (III) are mentioned below.

(A-27)
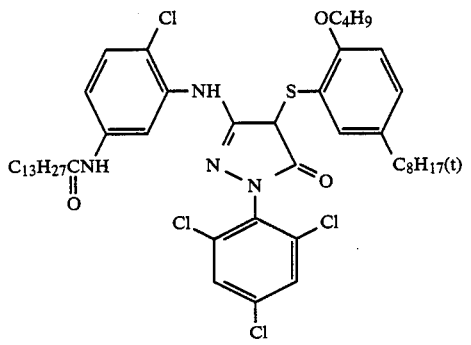
(A-28)
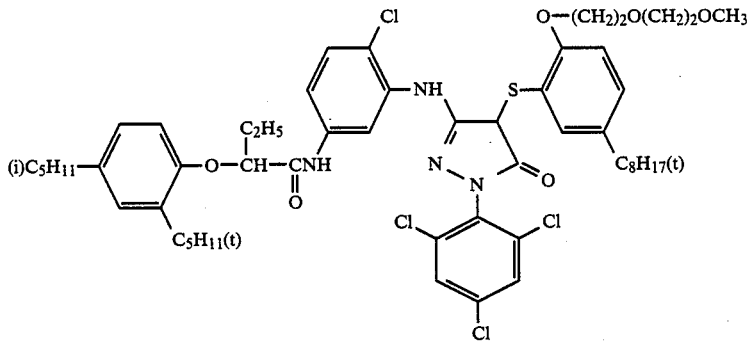
(A-29)
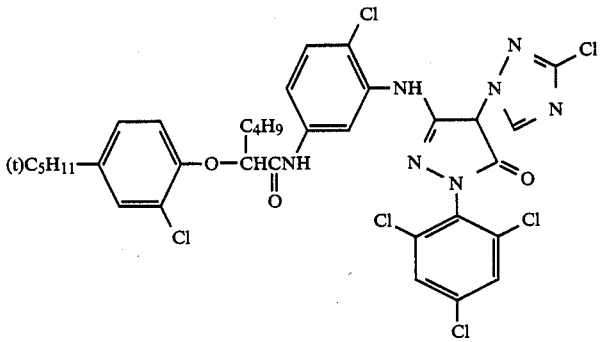
(A-30)
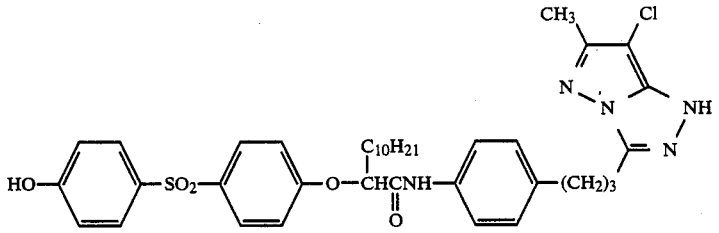
(A-31)
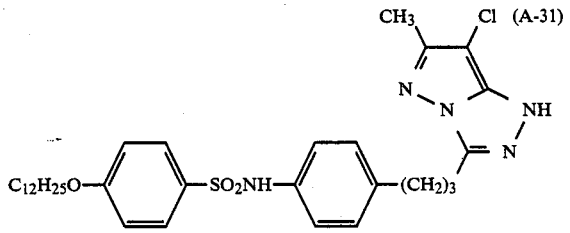
(A-32)
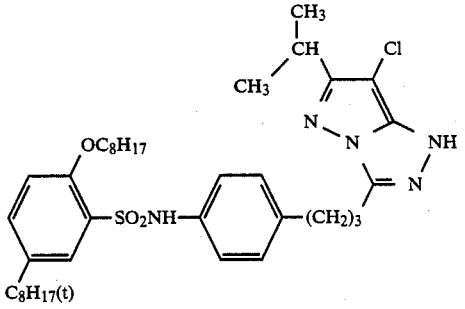

-continued
(A-33)
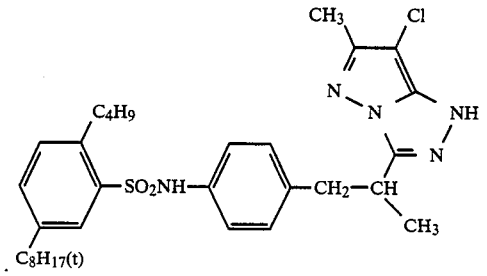
(A-34)
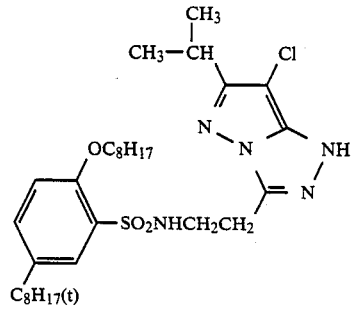
(A-35)
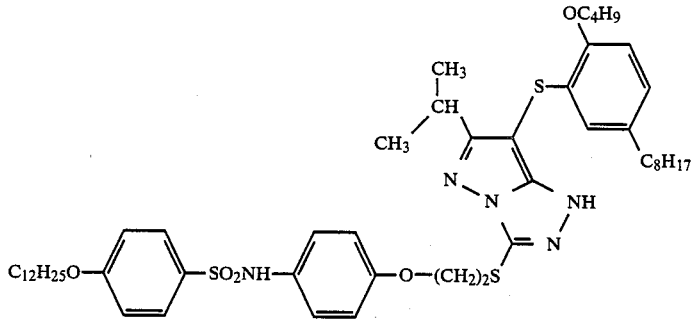
(A-36)
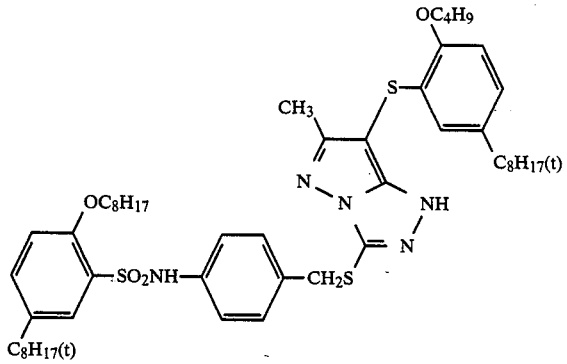
(A-37)
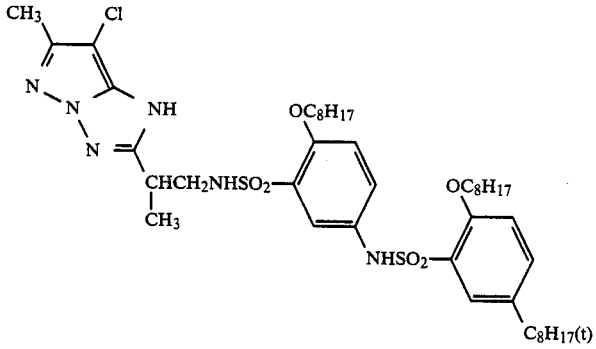
(A-38)
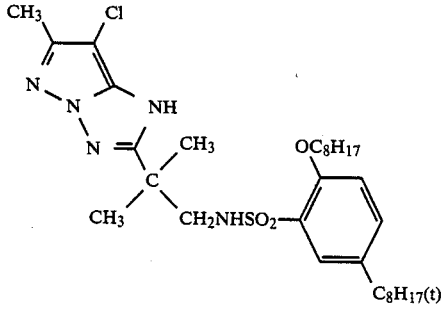

-continued
(A-39)
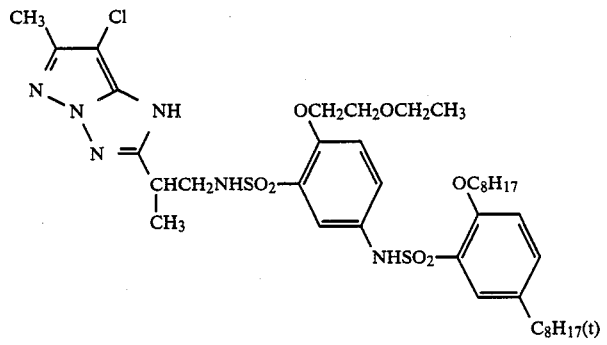
(A-40)
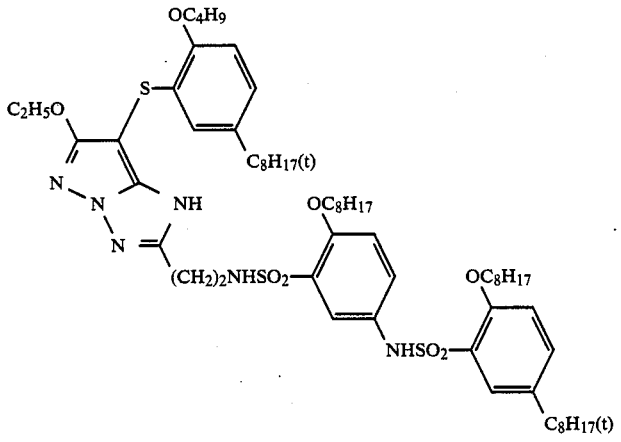
(A-41)
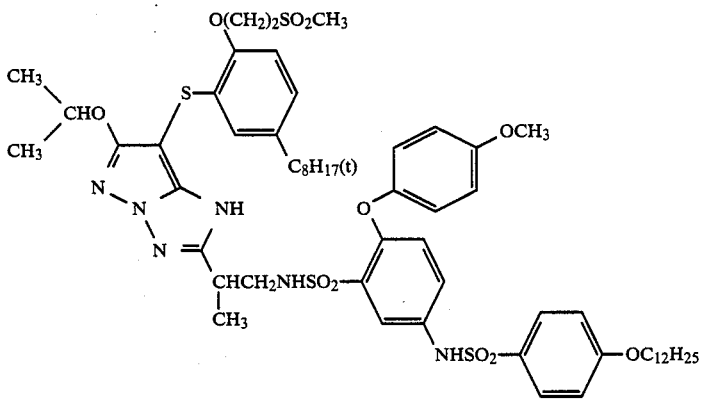
(A-42)
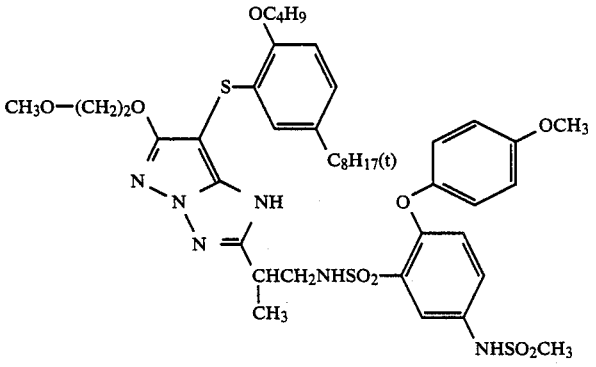

-continued
(A-43)
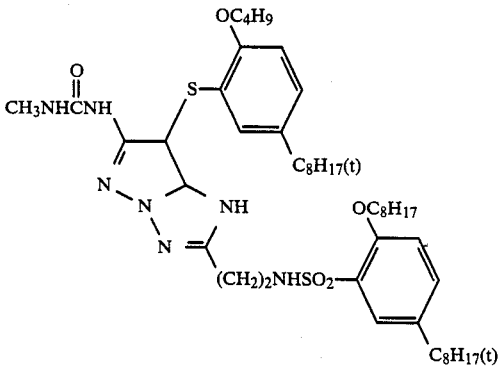
(A-44)
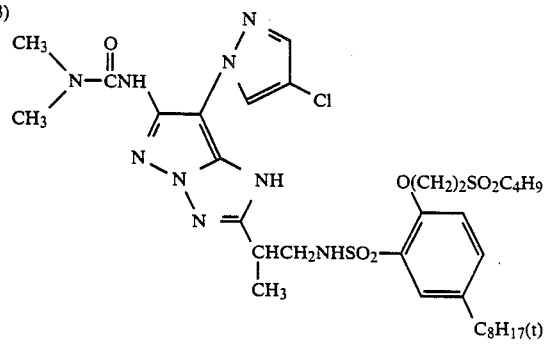
(A-45)
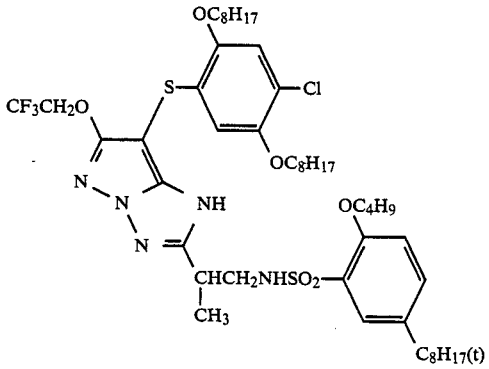
(A-46)
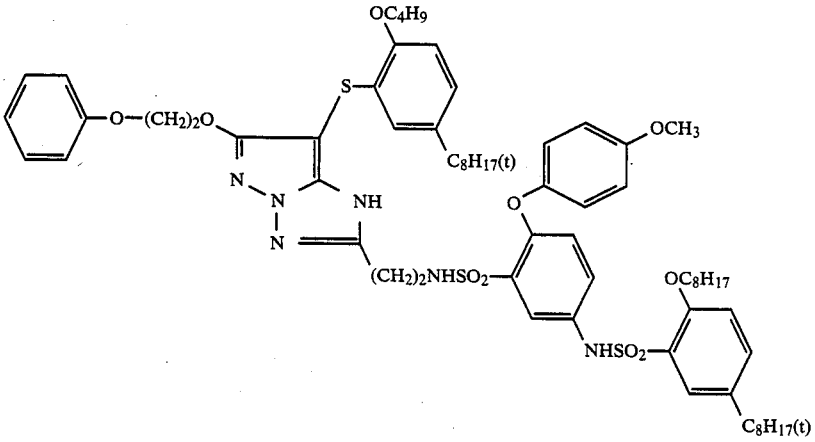
(A-47)
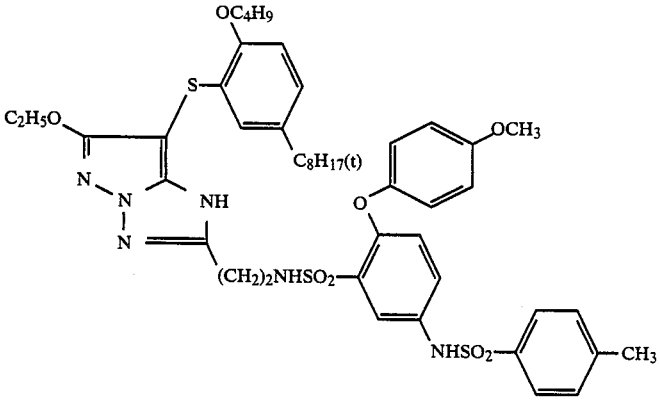

-continued
(A-48)
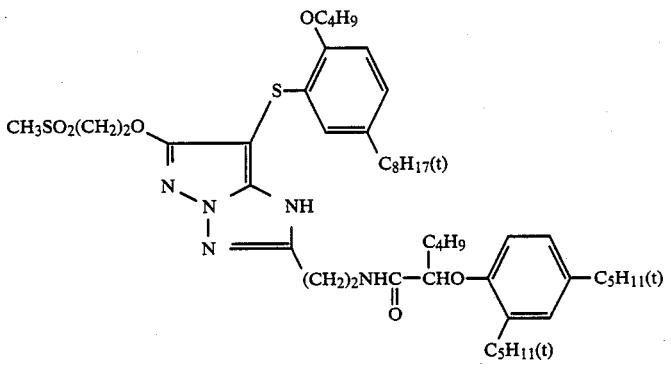
(A-49)
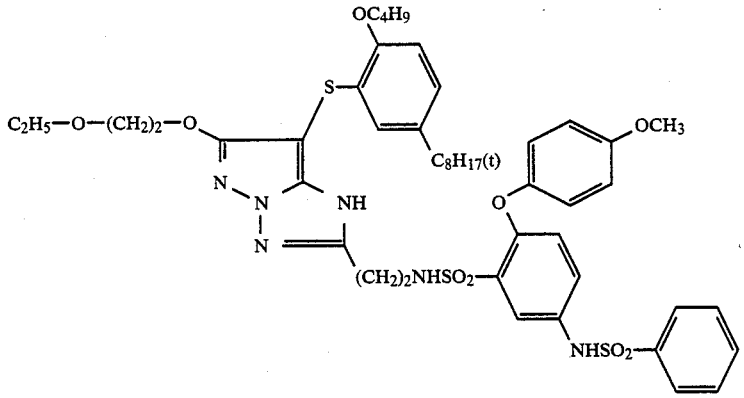
(A-50)
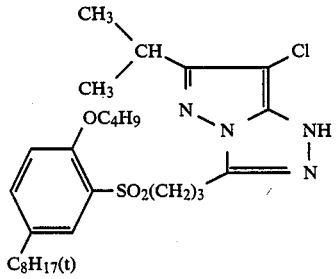
(A-51)
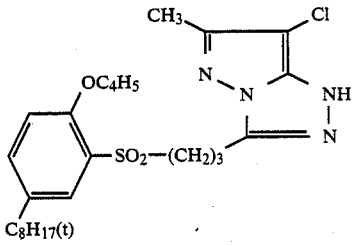
(A-52)
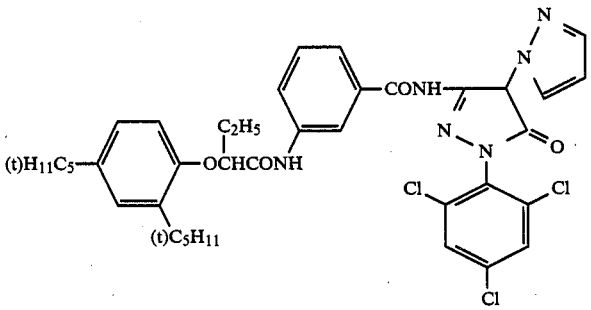

-continued
(A-53)
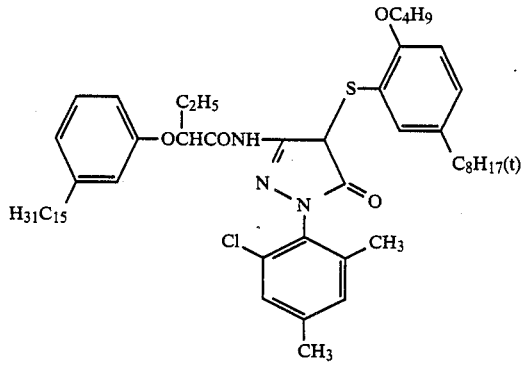
(A-54)
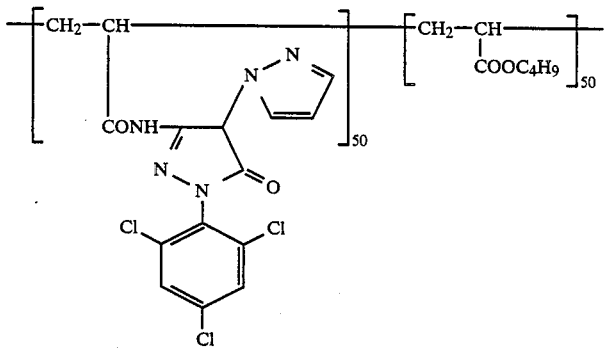
(A-55)
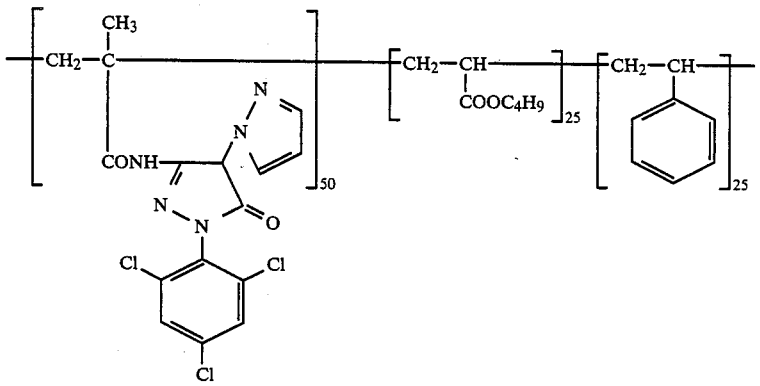
(A-56)
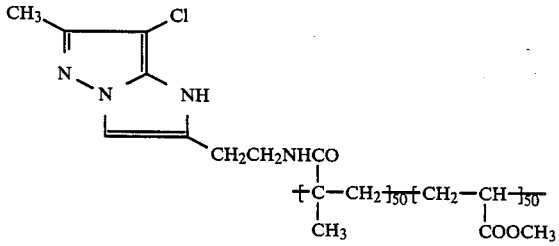
(A-57)
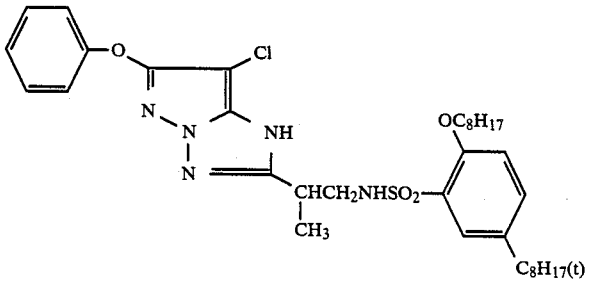

-continued
(A-58)
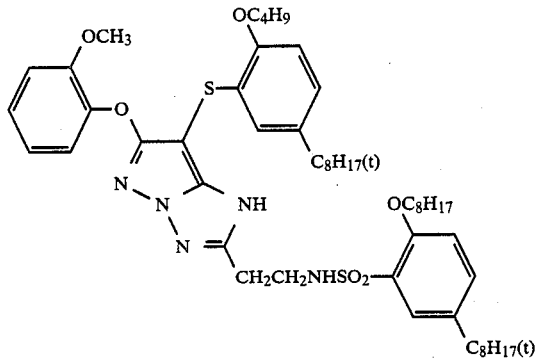
Preferred examples of the couplers of the formulae (IV) and (V) are mentioned below.
(A-59)
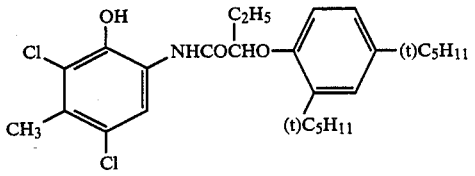
(A-60)
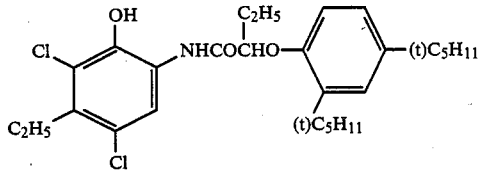
(A-61)
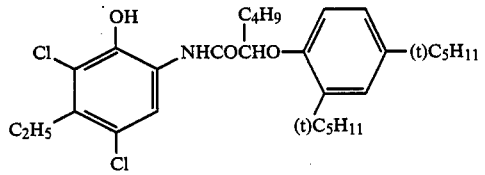
(A-62)
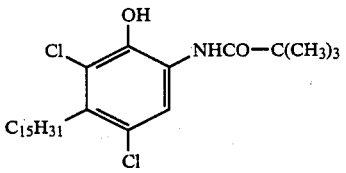
(A-63)
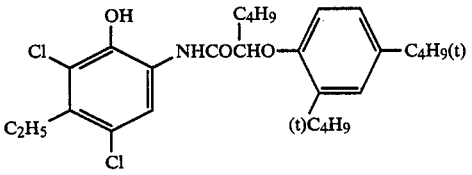
(A-64)
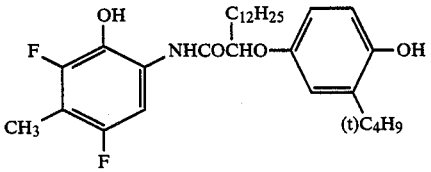

-continued
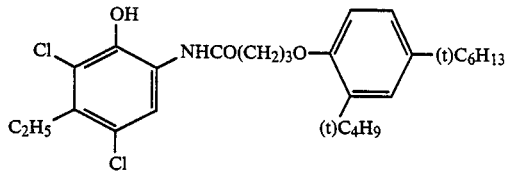
(A-65)
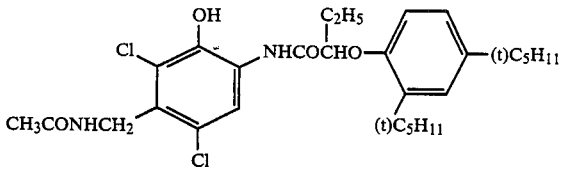
(A-66)
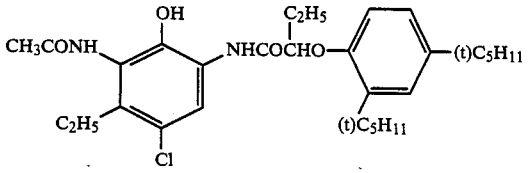
(A-67)
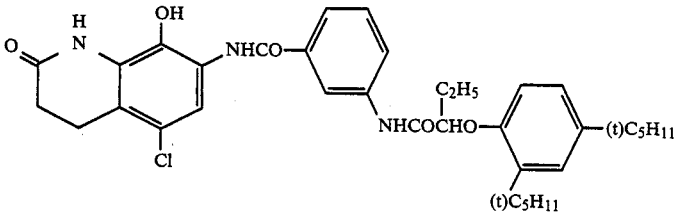
(A-68)
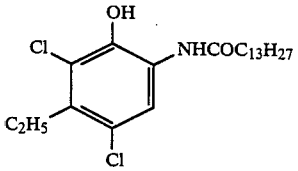
(A-69)
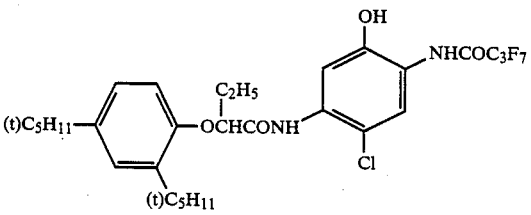
(A-70)
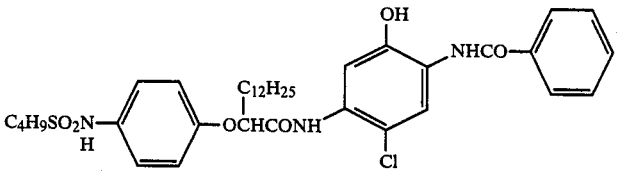
(A-71)
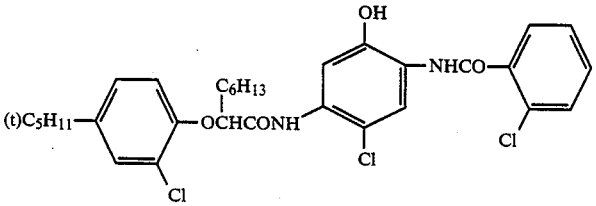
(A-72)

-continued
(A-73)
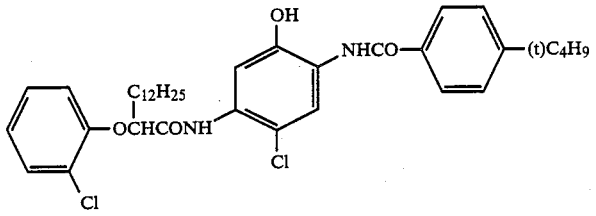
(A-74)
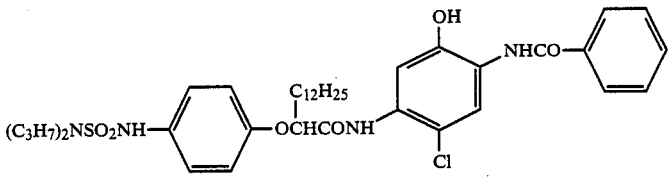
(A-75)
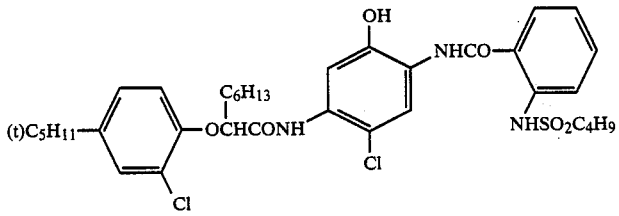
(A-76)
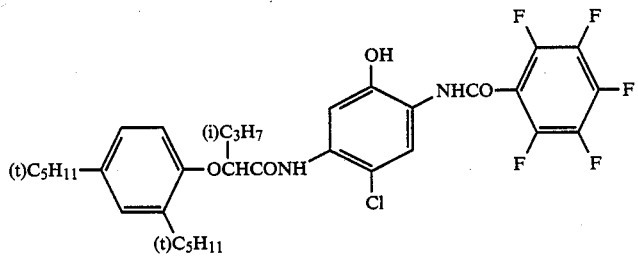
(A-77)
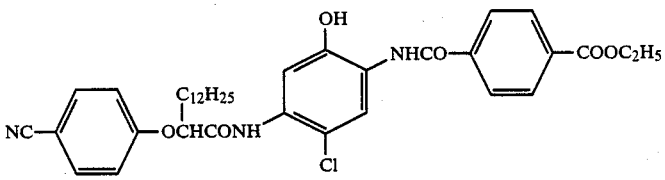
(A-78)
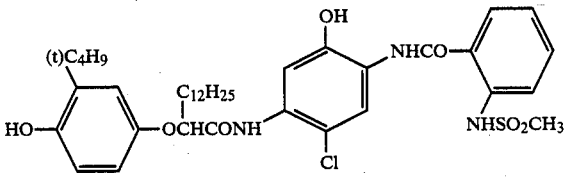
(A-79)
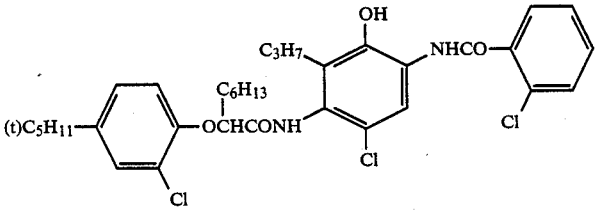

-continued
(A-80)
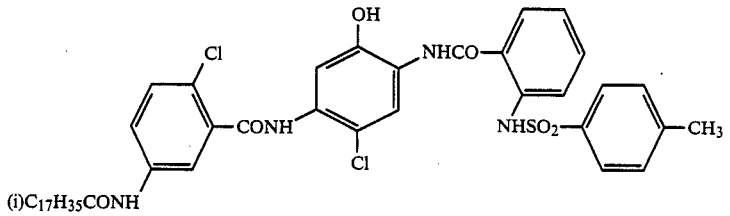
(A-81)
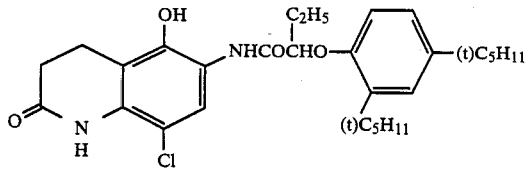
(A-82)
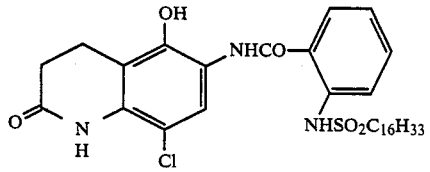
(A-83)
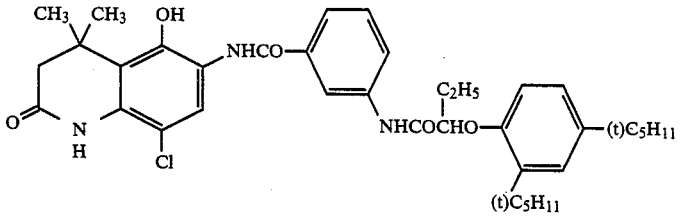
(A-84)
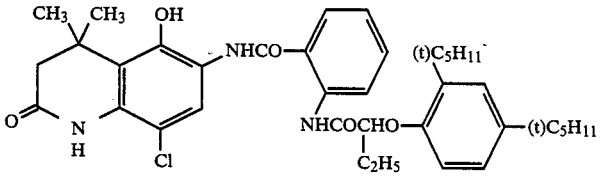
(A-85)
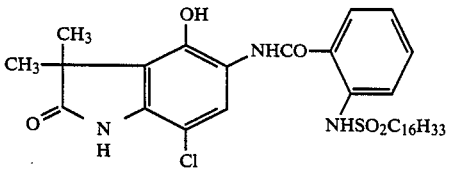
(A-86)
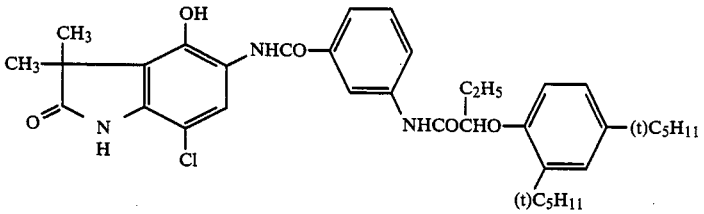
(A-87)
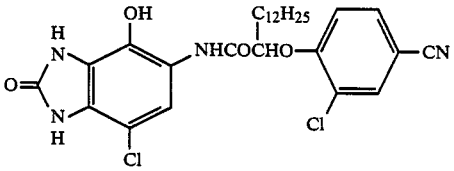

-continued
(A-88)
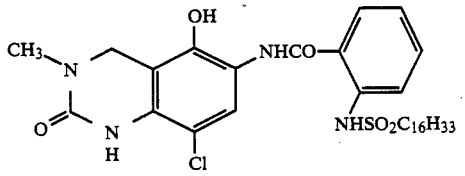
(A-89)
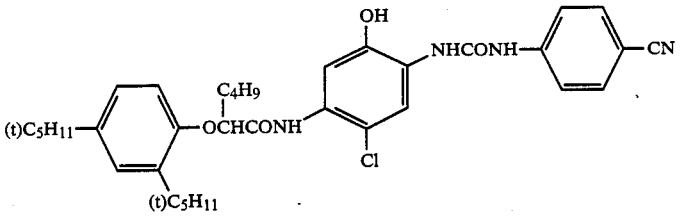
(A-90)
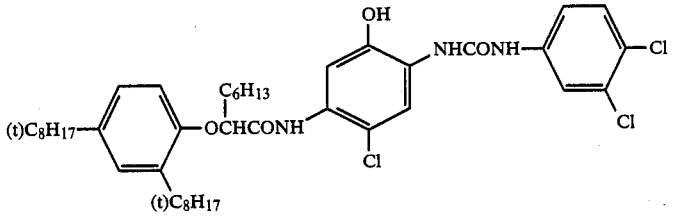
(A-91)
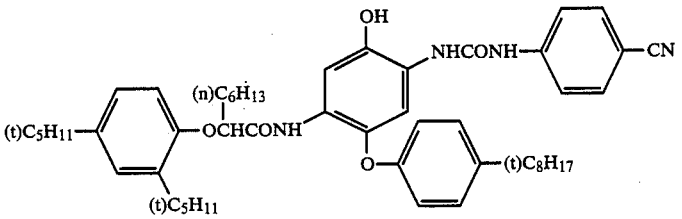
(A-92)
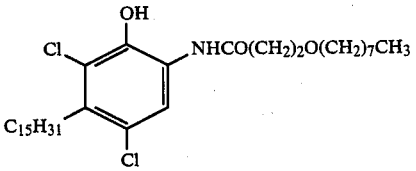
(A-93)
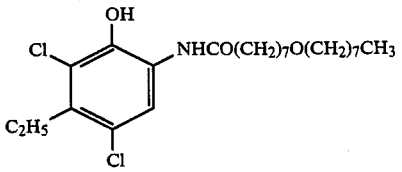
(A-94)
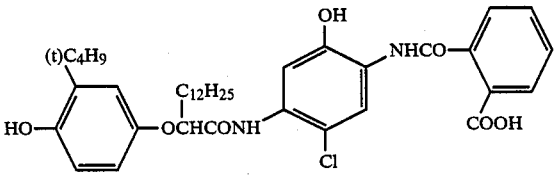

-continued

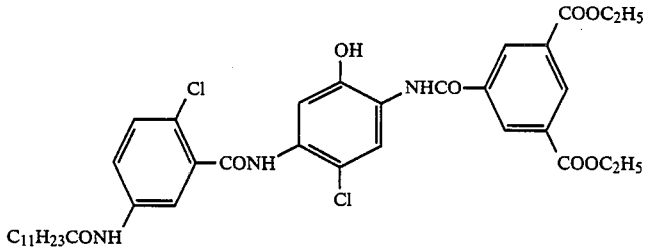

(A-95)

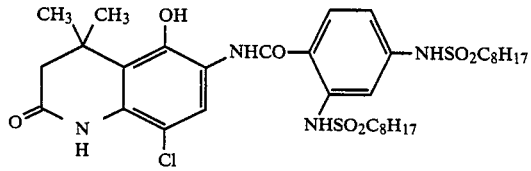

(A-96)

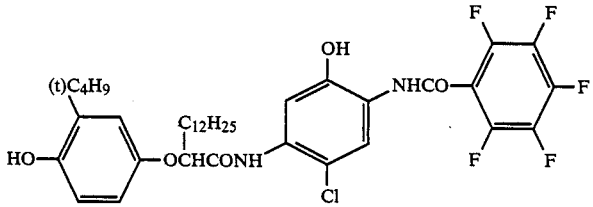

(A-97)

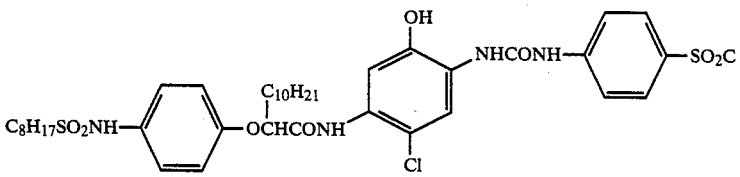

(A-98)

The standard amount of the color coupler to be incorporated is in the range of from 0.001 to 1 mol per mol of the light-sensitive silver halide in the silver halide emulsion and the preferred amount is from 0.01 to 0.5 mol for yellow coupler, from 0.003 to 0.3 mol for magenta coupler and from 0.002 to 0.3 mol for cyan coupler.

The couplers for use in the present invention can be incorporated into the photographic light-sensitive materials by means of various known dispersion methods. For instance, an oil-in-water dispersion method can be mentioned as one example, and examples of high boiling point organic solvents which can be used in the oil-in-water dispersion method are described in U.S. Pat. No. 2,332,027, etc. Another example is a latex dispersion method, and the procedure, effect and examples of latexes to be used for impregnation are described in U.S. Pat. No. 4,199,363, West German Patent Application (OLS) Nos. 2,541,274 and 2,541,230, etc.

The photographic light-sensitive material for use in the present invention is coated on a conventional flexible support such as a plastic film (e.g., cellulose nitrate, cellulose acetate, polyethylene terephthalate, etc.) or paper or a conventional rigid support such as glass, etc. The details of the supports and the coating means are described in *Research Disclosure,* Vol. 176, Item No. 17643, XV (page 27) and XVII (page 28) (December, 1978).

In the present invention, a reflective support is especially preferably used. The "reflective support" has a high reflectivity for clearly viewing the dye images formed in silver halide emulsion layers of the color photographic material, and this includes a support coated with a hydrophobic resin having dispersed therein a light reflective material such as titanium oxide, zinc oxide, calcium carbonate, calcium sulfate, etc., and a support composed of a hydrophobic resin having dispersed therein a light reflective material as mentioned above.

The color developer for use in the method of the present invention will be explained below.

The color developer for use in the method of the present invention contains a known aromatic primary amine color developing agent. Preferred examples are p-phenylenediamine derivatives, and specific examples are mentioned below, which, however, are not limitative.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-Ethyl-N-(β-hydroxyethyl)amino]aniline
D-5: 2-Methyl-4-[N-ethyl-N-(β-hydroxyethyl-)amino]aniline
D-6: 4-Amino-3-methyl-N-ethyl-N-[β-(methanesulfonamido)ethyl]aniline
D-7: N-(2-Amino-5-diethylaminophenylethyl)methanesulfonamide
D-8: N,N-Diethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Among the above-mentioned phenylenediamine derivatives, 4-amino-3-methyl-N-ethyl-N-[β-(methanesulfonamido)ethyl]aniline (D-6) is most preferred.

These p-phenylenediamine derivatives may also be in the form of salts such as sulfates, hydrochlorides, sulfites, p-toluenesulfonates, etc. The amount of the aromatic primary amine developing agent to be used is preferably from about 0.1 g to about 20 g, more preferably from about 0.5 g to about 10 g, per liter of the developer.

The color developer may contain, as a preservative, a sulfite such as sodium sulfite, potassium sulfite, sodium bisulfite, potassium bisulfite, sodium metasulfite, potassium metasulfite, etc., or a carbonyl-sulfite adduct, if desired.

It is preferred to add, as a compound for directly preserving the above-mentioned color developing agent, various kinds of hydroxylamines, the hydroxamic acids described in Japanese Patent Application (OPI) No. 43138/88, the hydrazines or hydrazides described in U.S. Ser. No. 76,505, the phenol described in Japanese Patent Application (OPI) No. 44657/88 and Japanese Patent Application No. 203253/86, the α-hydroxyketones or α-aminoketones described in Japanese Patent Application (OPI) No. 44656/88 and/or the various kinds of saccharides described in Japanese Patent Application (OPI) No. 36244/88, to the color developer. In addition, it is also preferred to use, together with the above preserving compounds, the monoamines described in Japanese Patent Application (OPI) Nos. 4235/88, 24254/88, 21647/88, 27841/88 and 25654/88 (U.S. Ser. No. 74,983) and Japanese Patent Application No. 164515/86, the diamines described in Japanese Patent Application (OPI) Nos. 30845/88 and 43139/88 (U.S. Ser. No. 84,941) and U.S. Ser. No. 72,479, the polyamines described in Japanese Patent Application (OPI) Nos. 21647/88 and 26655/88 (U.S. Ser. No. 76,430), etc., the polyamines described in Japanese Patent Application (OPI) No. 44655/88, the nitroxy radicals described in Japanese Patent Application No. 197760/86, the alcohols described in Japanese Patent Application (OPI) No. 43140/88 and Japanese Patent Application No. 197419/86, the oximes described in Japanese Patent Application No. 198987/86, and the tertiary amines described in U.S. Ser. No. 117,727, etc.

As other preservatives, the color developer may further contain the various kinds of metals described in Japanese Patent Application (OPI) Nos. 44148/82 and 53749/82, the salicylic acids described in Japanese Patent Application (OPI) No. 180588/84, the alkanolamines described in Japanese Patent Application (OPI) No. 3532/79, the polyethyleneimines described in Japanese Patent Application (OPI) No. 94349/81, the aromatic polyhydroxy compounds described in U.S. Pat. No. 3,746,544, etc., if desired. In particular, it is preferred to add aromatic polyhydroxy compounds, alkanolamines and the compounds described in Japanese Patent Application No. 264159/86, etc., to the color developer.

The color developer for use in the present invention preferably has a pH value of from 9 to 12, more preferably from 9 to 11.0, and the color developer can contain any other compounds which are known to be used as color developer components, in addition to the above-mentioned compounds.

In order to maintain the above pH value, the color developer preferably contains various kinds of buffers. The buffers which are usable include, for example, carbonic acid salts, phosphoric acid salts, boric acid salts, tetraboric acid salts, hydroxybenzoic acid salts, glycine salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, trishydroxyaminomethane salts, lysine salts, etc. In particular, carbonic acid salts, phosphoric acid salts, tetraboric acid salts and hydroxybenzoic acid salts are advantageous in that they have excellent solubility and have an excellent buffering capacity in a high pH range of pH 9.0 or more, and therefore even when they are added to the color developer, they have no bad influence on the photographic property (for example, fog, etc.). In addition, they are inexpensive. Accordingly, the use of these buffers is especially preferred.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, these compounds are not intended to restrict the scope of the present invention.

The amount of the buffer to be added to the color developer is preferably 0.1 mol/liter or more, and is especially preferably from 0.1 mol/liter to 0.4 mol/liter.

In addition, the color developer can further contain various kinds of chelating agents as a flocculation-preventing agent with respect to calcium or magnesium or for the purpose of improving the stability of the color developer.

As a preferred chelating agent mention is made of organic acid compounds, and, for example, there may be mentioned the aminopolycarboxylic acids described in Japanese Patent Publication Nos. 30496/73 and 30232/69, etc.; the organic phosphonic acids described in Japanese Patent Application (OPI) No. 97347/81, Japanese Patent Publication No. 39359/81, West German Pat. No. 2,227,639, etc.; the phosphonocarboxylic acids described in Japanese Patent Application (OPI) Nos. 102726/77, 42730/78, 121127/79, 126241/80 and 659506/80, etc.; and the compounds described in Japanese Patent Application (OPI) Nos. 195845/83 and 203440/83, Japanese Patent Publication No. 40900/78, etc. Specific examples of the compounds are mentioned below, which, however, are not limitative.

Nitrilotriacetic acid; diethylenetriaminepentaacetic acid; ethylenediaminetetraacetic acid; N,N,N-trimethylenephosphonic acid; ethylenediamine-N,N,N',N'-tetramethylenephosphonic acid; transcyclohexanediaminetetraacetic acid; 1,2-diaminopropanetetraacetic acid; glycoletherdiaminetetraacetic acid; ethylenediamineorthohydroxyphenylacetic acid; 2-phosphonobutane-1,2,4-tricarboxylic acid; 1-hydroxyethylidene-1,1-diphosphonic acid; N,N'-bis(2-hydroxybenzyl)ethylenediamine-N,N'-diacetic acid.

These chelating agents can be used in the form of a mixture of two or more kinds of them if desired.

The amount of the chelating agent to be added to the color developer preferably is a sufficient amount for blocking the metal ions in the developer. For example, the amount may be from 0.1 g to 10 g or so, per liter of the developer.

The color developer optionally may contain any known development accelerator, if desired. However, it is preferred that the color developer of the present invention does not substantially contain benzyl alcohol, in order to prevent environmental pollution, to prevent fog, and to enable an easy preparation of the developer solution. The working "does not substantially contain benzyl alcohol" means that the content of the benzyl alcohol in the developer is 2 ml/liter or less, and preferably this is achieved by providing a developer which contains no benzyl alcohol.

The above-mentioned technique of the present invention is noticeably effective when the color developer to be used in the method of the present invention does not substantially contain benzyl alcohol.

As other development accelerators which can be added to the color developer for use in the present invention, there may be mentioned, for example, the thioether series compounds described in Japanese Patent Publication Nos. 16088/62, 5987/62, 7826/63, 12380/79 and 9019/70, U.S. Pat. No. 3,813,247, etc.; the p-phenylenediamine series compounds described in Japanese Patent Application (OPI) Nos. 49829/77 and 15554/75, etc.; the quaternary ammonium salts described in Japanese Patent Application (OPI) No. 137726/75, Japanese Patent Publication No. 30074/69, Japanese Patent Application (OPI) Nos. 156826/81 and 43429/77, etc.; the amine series compounds described in U.S. Pat. Nos. 2,494,903, 3,128,182, 4,230,796 and 3,253,919, Japanese Patent Publication No. 11431/66, U.S. Pat. Nos. 2,482,546, 2,596,926 and 3,582,346, etc.; the polyalkylene oxides described in Japanese Patent Publication Nos. 16088/62 and 25201/67, U.S. Pat. No. 3,128,183, Japanese Patent Publication Nos. 11431/66 and 23883/67, U.S. Pat. No. 3,532,501, etc.; as well as 1-phenyl-3-pyrazolidones, imidazoles, etc. These can be added to the developer, if desired.

In the practice of the present invention, any antifoggant optionally can be added to the color developer, if desired. As the antifoggant there can be used alkali metal halides such as sodium chloride, potassium bromide or potassium iodide as well as organic antifoggants. Specific examples of the organic antifoggants are nitrogen-containing heterocyclic compounds, including, for example, benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolymethylbenzimidazole, indazole, hydroxyazaindolizine, adenine, etc.

The color developer for use in the present invention preferably contains a brightening agent. As the brightening agent 4,4'-diamino-2,2'-disulfostilbene series compounds are preferred. The amount of the brightening agent to be added to the color developer is up to 5 g/liter, preferably from 0.1 to 4 g/liter.

In addition, various kinds of surfactants can be added to the color developer, if desired, including alkylsulfonic acids, arylsulfonic acids, aliphatic carboxylic acids, aromatic carboxylic acids, etc.

The processing temperature of the color developer of the present invention is from 20° to 50° C., preferably from 30° to 40° C. The color developer processing time is from 20 seconds to 5 minutes, preferably from 30 seconds to 2 minutes. The amount of the color developer replenisher is preferably small and is, for example, from 20 to 600 ml, preferably from 50 to 300 ml, more preferably from 100 to 200 ml, per $m^2$ of the photographic light-sensitive material as which is being processed.

Next, the desilvering step in the method of the present invention will be explained hereunder. The desilvering step generally comprises a bleaching step and a fixation step; a fixation step and a bleach-fixation step; a bleaching step and a bleach-fixation step; or a bleach-fixation step, and any of them can be employed in the method of the present invention. In the practice of the present invention, the processing time for the desilvering step is preferred to be as small as possible, in order to obtain a more favorable effect. Specifically, the desilvering time is preferably 2 minutes or less, more preferably from 15 seconds to 60 seconds.

Next, the bleaching solution, bleach-fixing solution and fixing solution for use in the present invention will be mentioned hereunder.

Any and every bleaching agent can be used in the bleaching solution or bleach-fixing solution for use in the present invention. Organic complex salts of iron(III) (for example, complex salts with aminopolycarboxylic acids such as ethylenediaminetetraacetic acid, diethylenetriaminepentaacetic acid, etc., or with aminopolyphosphonic acids, phosphonocarboxylic acids or carboxylic acids or organic phosphonic acids) or organic acids such as citric acid, tartaric acid, malic acid, etc.; persulfates; hydrogen peroxide, etc., are preferred as the bleaching agent.

Among them, the organic complex salts of iron(III) are especially preferred in view of the rapid processability thereof and in view of the preventing environmental pollution. Examples of the aminopolycarboxylic acids, aminopolyphosphonic acids or organic phosphonic acids or their salts which are useful for formation of organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, glycoletherdiaminetetraacetic acid, etc. These compounds may be in the form of their sodium, potassium, lithium or ammonium salts.

Among the above compounds, iron(III) complex diaminetetraacetic acid, diethylenetriaminepentaacetic acid, cyclohexanediaminetetraacetic acid, 1,3-diaminopropanetetraacetic acid or methyliminodiacetic acid are especially preferred, as these have a high bleaching capacity.

These ferric complex salts can be used in the form of the complex salts themselves, or alternatively, a ferric salt, such as ferric sulfate, ferric chloride, ferric nitrate, ferric ammonium sulfate, ferric phosphate, etc., and a chelating agent, such as aminopolycarboxylic acids, aminopolyphosphonic acids, phosphonocarboxylic acids, etc., can be added to the developer solution so that the intended ferric complex salt can be formed in the solution. The chelating agent can be used in an excess amount exceeding the necessary amount for the formation of the ferric complex salt. Among the iron complexes, the aminopolycarboxylic acid/iron complexes are perferred, and the amount of the iron complex to be added to the developer is from 0.01 to 1.0 mol/liter, preferably from 0.05 to 0.50 mol/liter.

In the bleaching or bleach-fixing solution and/or the desilvering bath preceding bleaching or bleach-fixation, various kinds of compounds can be used as a bleaching accelerating agent. For example, the mercapto group- or disulfido group-containing compounds described in U.S. Pat. No. 3,893,858, West German Pat. No. 1,290,812, Japanese Patent Application (OPI) No. 95630/78, *Research Disclosure,* No. 17129 (July, 1978), etc., the thiourea series compounds described in Japanese Patent Publication No. 8506/70, Japanese Patent Application (OPI) Nos. 20832/77 and 32735/78, U.S. Pat. No. 3,706,561, etc.; as well as halides such as iodides, bromides, etc., are preferred for the above purpose, as having excellent bleaching capacity.

In addition, the bleaching or bleach-fixing solution for use in the present invention can further contain a rehalogenating agent such as bromides (e.g., potassium bromide, sodium bromide, ammonium bromide, etc.), chlorides (e.g., potassium chloride, sodium chloride, ammonium chloride, etc.), iodides (e.g., ammonium iodide, etc.), etc. Also, the bleaching or bleach-fixing solution can additionally contain one or more inorganic acids, organic acids or alkali metal or ammonium salts thereof having a pH buffering capacity, such as boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc., as well as an anti-corrosive agent such as ammonium nitrate, guanidine, etc., if desired.

The fixing agent to be used in the bleach-fixing solution or fixing solution for use in the present invention may be a known fixing agent which is a water-soluble silver halide-dissolving agent, such as thiosulfates (e.g., sodium thiosulfate, ammonium thiosulfate, etc.); thiocyanates (e.g., sodium thiocyanate, ammonium thiocyanate, etc.); thioether compounds and thiourea compounds (e.g., ethylenebisthioglycolic acid, 3,6-dithio-1,8-octanediol, etc.), etc. These can be used singly or in the form of a mixture of two or more of them. In addition, a special bleach-fixing solution comprising the combination of a fixing agent and a large amount of a halide such as potassium iodide, as described in Japanese Patent Application (OPI) No. 155354/80, can also be used in the present invention. In the practice of the present invention, the use of thiosulfates, especially ammonium thiosulfate, is preferred. The amount of the fixing agent in the bleach-fixing or fixing solution is preferably from 0.3 to 2 mols, more preferably from 0.5 to 1.0 mol, per liter of the solution. The pH range of the bleach-fixing solution or fixing solution is preferably from 3 to 10, more preferably from 5 to 9. If the pH of the bleach-fixing solution or fixing solution is too low, the color density of the color images formed would become lower with the formation of leuco dyes from cyan dyes, but if the ph thereof is too high, the desilvering would be insufficient.

The bleach-fixing solution or fixing solution can further contain other various kinds of agents such as brightening agents, defoaming agents and surfactants buffers, chelating agents and fungicides, as well as organic solvents such as polyvinyl pyrrolidone, methanol, etc.

The bleach-fixing solution or fixing solution for use in the present invention contains, as a preservative, a sulfite ion-releasing compound, such as sulfites (e.g., sodium sulfite, potassium sulfite, ammonium sulfite, etc.), bisulfites (e.g., ammonium bisulfite, sodium bisulfite, potassium bisulfite, etc.), metabisulfites (e.g., potassium metabisulfite, sodium metabisulfite, ammonium metabisulfite, etc.), etc. The compound can be incorporated into the bleach-fixing solution or fixing solution in an amount of from about 0.02 to about 0.50 mol/liter, more preferably from 0.04 to 0.40 mol/liter, as the sulfite ion.

As the preservative, the addition of the sulfites is generally employed, but other preservatives such as ascorbic acids, carbonyl-bisulfite adducts or carbonyl compounds can also be added.

In addition, a buffer, a chelating agent, a fungicide, etc., can also be added to the bleach-fixing solution or fixing solution, if desired.

The silver halide color photographic material which is processed by the method of the present invention is generally rinsed in water and/or stabilized, after the desilvering process such as fixation or bleach-fixation.

The final rinsing-in-water step or stabilization step in the method of the present invention is to be carried out after the above-mentioned desilvering step and before the subsequent drying step. For example, the step may be a rinsing step to be carried out in a short period of time for the purpose of recovery of silver after the desilvering step may be a stabilization step to be carried out immediately before the drying step. Some embodiments of the final rinsing-in-water step are illustrated below by techniques (a) to (g), which, however, are not limitative. The "(rinsing-in-water)" steps which are shown below in parentheses in techniques (a) to (g) below may be replaced by a "stabilization" step.

(a) Color Development→Bleach-Fixation→(Rinsing-in-Water)→Drying
(b) Color Development→Bleaching→Fixation→Rinsing-in-Water)→Drying
(c) Color Development→Bleaching→Fixation→(Rinsing-in-Water)→Stabilization→Drying
(d) Color Development→Bleaching→Bleach-Fixation→(Rinsing-in-Water)→Stabilization→Drying
(e) Color Development→Fixation→Bleach-Fixation→(Rinsing-in-Water)→Drying
(f) Black-and-White Development→Rinsing-in-Water→Reversal→Color Development→Acceleration→Bleaching→Fixation→(Rinsing-in-Water)→Stabilization→Drying
(g) Black-and-White Development→Rinsing-in-Water→Color Development→Rinsing-in-Water→Bleach-Fixation→(Rinsing-in-Water)→Drying The amount of water to be used in the rinsing step can be set in a broad range, in accordance with the characteristic of the photographic light-sensitive material which is being processed (for example, depending upon the raw material components, such as coupler, etc.) or the use of the material, as well as the temperature of the rinsing water, the number of the rinsing tanks (the number of the rinsing stages), the replenishment system (cocurrent or countercurrent) and other various kinds of conditions. Among the above conditions, the relation between the number of the rinsing tanks and the amount of the rinsing water in a multistage countercurrent rinsing system can be obtained by the method described in *Journal of the Society of Motion Picture and Television Engineers,* Vol. 64, pages 248 to 253 (May, 1955). In general, the number of the stages in the multistage countercurrent rinsing system is preferably from 2 to 6, especially from 2 to 4.

As the solution for the rinsing-in-water or stabilization step to follow the desilvering step in the method of the present invention, a so-called rinsing solution can also be used in the same manner.

The pH value in the rinsing-in-water step or stabilization step in the method of the present invention is from 4 to 10, preferably from 5 to 8. The temperature can be set variously in accordance with the characteristic of the photographic material which is being processed, the use thereof, etc., and, in general, it is from 15° to 45° C., and preferably from 20° to 40° C. The time can also be set variously, but it is desired to be short to more effectively attain the effect of the present invention. Preferably, it is from 30 seconds to 2 minutes, more preferably from 15 seconds to 1 minute and 30 seconds. The amount of the replenisher is also desired to be small from the viewpoint that the running cost is low, the drainage is reduced, the operation is easy and the effect of the present invention can be attained more efficiently.

The total of the time of the desilvering step, rinsing-in-water step and stabilization step in the method of the present invention is 3 minutes or less, and preferably from 30 seconds to 2 minutes and 30 seconds. The "total of the time" means the time from the introduction of the silver halide color photographic material which is being processed into the first desilvering bath to the taking out of the photographic material from the last rinsing-in-water or stabilization bath, and this includes the time for the transference of the material during the procedure.

If the total time for desilvering, rinsing-in-water and stabilization exceeds 3 minutes, the effect of the present invention cannot be attained noticeably.

In the present invention, "the total of the time of the desilvering step, rinsing-in-water step and stabilization step is 3 minutes or less" means that the total of the time for the procedure from the desilvering step up to the drying step (the drying step being exclusive), more concretely, from the desilvering step to the rinsing-in-water and/or stabilization step(s) (the both being inclusive) is to be 3 minutes or less.

For example, the above total time means that the following procedure is to be finished in 3 minutes or less.

(1) Desilvering and Rinsing-in-Water
(2) Desilvering and Stabilization
(3) Desilvering, Rinsing-in-Water and Stabilization The amount of the replenisher for the rinsing water or stabilization solution is desired to be as small as possible for the purpose of economizing the amount of water which is to be used. In the method of the present invention, the amount of the replenisher is from 0.5 to 50 times, preferably from 3 to 40 times, of the amount of the processing solution which is brought into the rinsing-in-water bath and stabilization bath from the previous desilvering bath together with the photographic material which is being processed. The amount of the processing solution which is brought into the rinsing-in-water bath and stabilization bath from the previous desilvering bath together with the photographic material which is being processed variously differs, depending upon the kind of the material and the strength of the squeegee used, but it is generally from 10 ml/m$^2$ to 100 ml/m$^2$ or so of the photographic material which is being processed. The amount of the processing solution which is brought into the rinsing-in-water bath and stabilization bath from the previous desilvering bath together with the photographic material which is being processed is preferred to be as small as possible, because the amount of the replenisher then can be reduced. The replenishment can be carried out either continuously or intermittently.

The amount of the replenishment for the rinsing water or stabilization solution is preferably 1 liter or less, more preferably from 50 ml to 1,000 ml, per m$^2$ of the photographic material which is being processed.

In the past, when a noticeably reduced amount of water has been used to effect an economized rinsing on stabilization step, bacteria would propagate in the tank because of the need to prolong the residue time of the rinsing or stabilization solution in the tank so that some floating substances formed would adhere to the photographic material which is being processed. This is a troublesome problem. In accordance with the present invention where the aforesaid acid-processed gelatin is used in the photographic material, the adhesion of such substances is small, and the present invention is advantageous with respect to this point. In addition, as the means for preventing the propagation of bacteria, the method described in Japanese Patent Application (OPI) No. 288838/87 (U.S. Ser. No. 57,254), where calcium and magnesium in water are reduced, can extremely effectively be utilized in the practice of the present invention. Also, the isothiazolone compounds and the thiabendazoles described in Japanese Patent Application (OPI) No. 8542/82; the chlorine series bactericides such as the chlorinated sodium isocyanurates described in Japanese Patent Application (OPI) No. 120145/86; the benzotriazoles described in Japanese Patent Application (OPI) No. 267761/86 (USSN 863,907); copper ions and other various bactericides or fungicides described in H. Horiguchi, *Chemistry of Bactericides and Fungicides*, as well as in *Bactericidal and Fungicidal Technique to Microorganisms*, by Sanitary Technical Association (Japan) and *Encyclopedia of Bactericides and Fungicides*, by Japan Bactericidal and Fungicidal Association can also be used.

Further, the rinsing water may contain a surfactant as a water-cutting agent as well as a chelating agent such as EDTA as a water softener.

Following the above-mentioned rinsing-in-water step, the material can be processed with a stabilizer solution, or alternatively, the material can directly be processed with a stabilizer solution without taking the rinsing-in-water step. To the stabilizer solution can be added a compound having an image stabilizing function. For example, aldehyde compounds such as formalin, buffers for adjusting the film pH value to one suitable for image stabilization as well as ammonium compounds can be added to the stabilizer solution. In addition, the above-mentioned various kinds of bactericides and fungicides can also be added to the stabilizer solution so as to prevent the propagation of bacteria in the solution or to impart a fungicidal capacity to the photographic material which is being processed.

Further, a surfactant, a brightening agent and a hardener can also be added to the stabilizer solution. In the practice of the present invention, when the stabilization step is directly carried out without the rinsing-in-water step, any and every known method, for example, the methods described in Japanese Patent Application (OPI) Nos. 8543/82, 14834/83, 184343/84, 220345/85, 238832/85, 239784/85, 239749/85, 4054/86 and 118749/86, etc., can be utilized.

In addition, a chelating agent such as 1-hydroxyethylidene-1,1-diphosphonic acid, ethylenediaminetetramethylenephosphonic acid, etc., as well as a magnesium or bismuth compound can also be used as a preferred embodiment.

The solution which is used in the rinsing-in-water and/or stabilization step(s) can be used again in a preceding step of the process. As an example, there may be mentioned a process in which the overflow of the rinsing water, the amount of the rinsing water having been reduced in the multistage countercurrent system is returned backward to the previous bleach-fixing bath and a fresh concentrated solution is replenished into the bleach-fixing bath so as to decrease the amount of the resulting waste drainage.

In the practice of the present invention, the effect of the present invention can be attained most noticeably when all the procedure of the desilvering step and rinsing-in-water (or stabilization) step, following the development step, is carried out under the condition of a pH of from 5 to 8. Specifically, when the method of the present invention is carried out under the above condition, the white background part of the photographic material which is being processed is not color-stained so that the image formed can have a high image density and an excellent color image fastness.

The following examples are intended to illustrate the present invention but not to limit it in any way.

The compounds which are used in the examples are selected depending on the cases, from the aforementioned Compounds (A-1) to (A-98) and the following Solv-1 to Solv-7 and Compounds (A-99) to (A-168).

Solv-1: Dibutyl phthalate

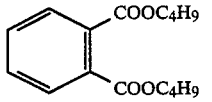

-continued

Solv-2: Tricresyl phosphate

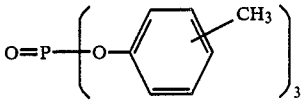

Solv-3: Trioctyl phosphate $((n)C_8H_{17}O)_3P{=}O$

Solv-4: Trinonyl phosphate $O{=}P(O{-}C_9H_{19}(iso))_3$

Solv-5: N—Di-n-butyl-2-n-butoxy-5-tert-octylaniline

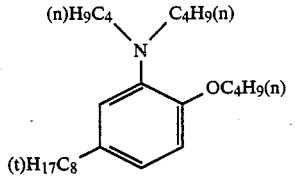

Solv-6: Tri(2-ethylhexyl) phosphate $O{=}P(OCH_2CH(C_2H_5)C_4H_9)_3$

Solv-7: Bis(2-ethylhexyl) phthalate

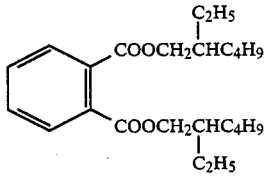

(A-99)

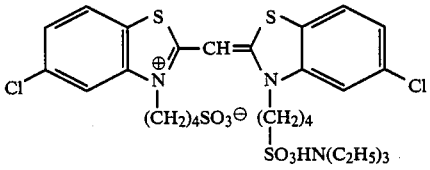

(A-100)

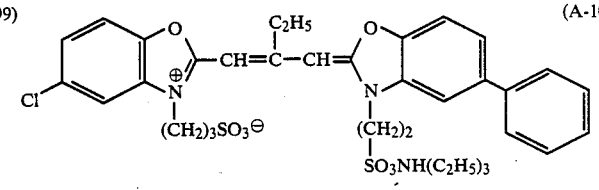

(A-101)

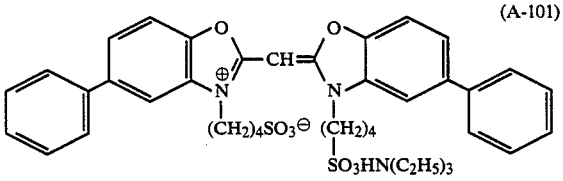

(A-102)

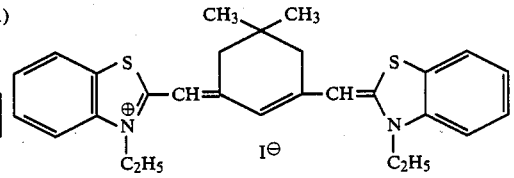

(A-103)

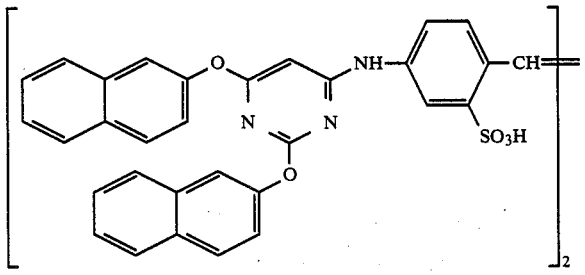

-continued
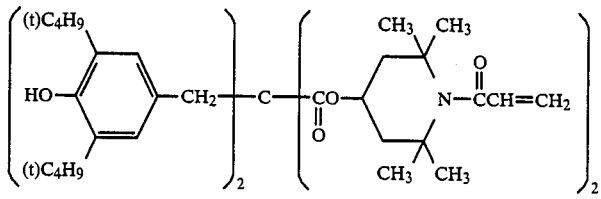
(A-104)
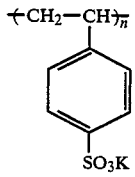
(A-105)
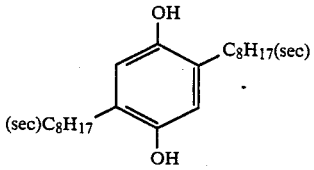
(A-106)
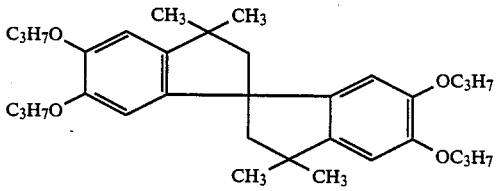
(A-107)
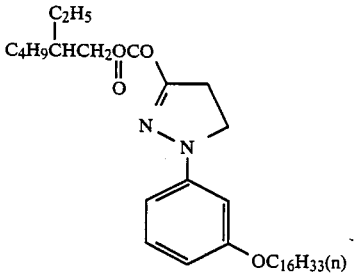
(A-108)
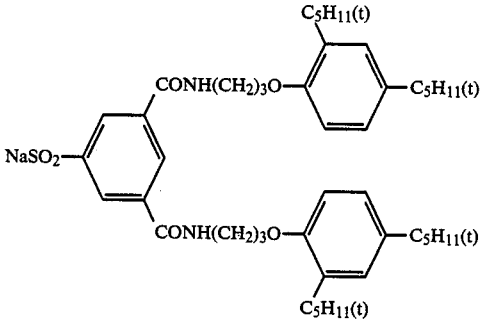
(A-109)
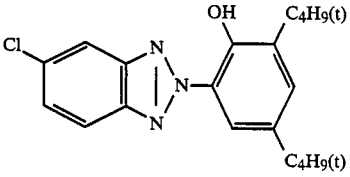
(A-110)
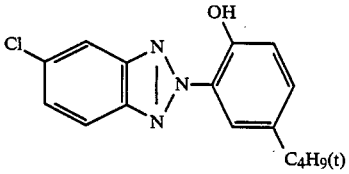
(A-111)
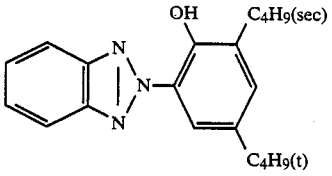
(A-112)
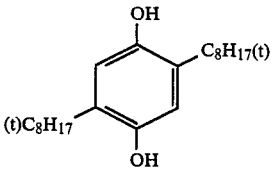
(A-113)
(mean molecular weight 80,000)
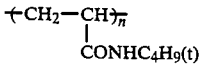
(A-114)
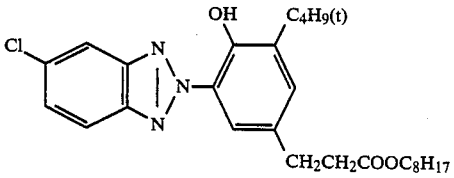
(A-115)

-continued
(A-116)
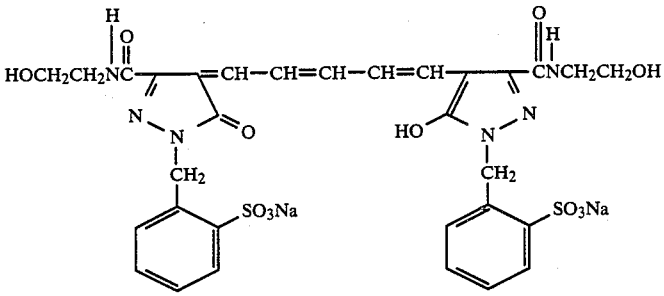
(A-117)
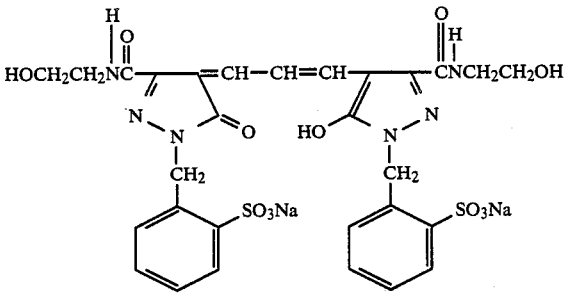
(A-118)
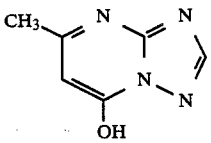
(A-119)
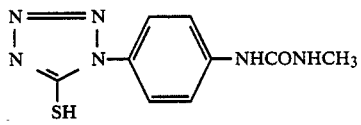
(A-120)
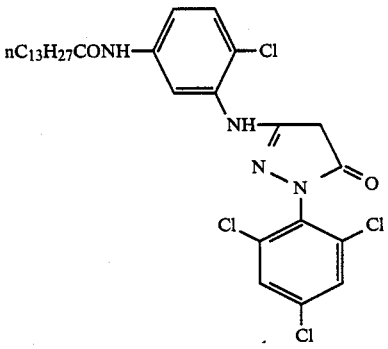
(A-121)
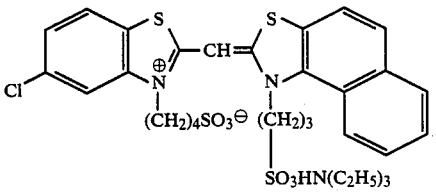
(A-122)
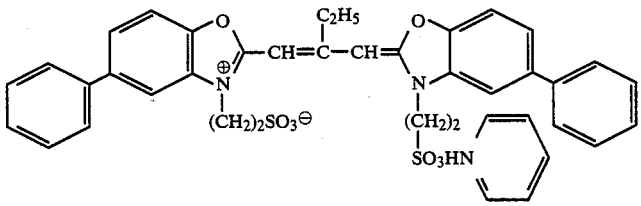
(A-123)
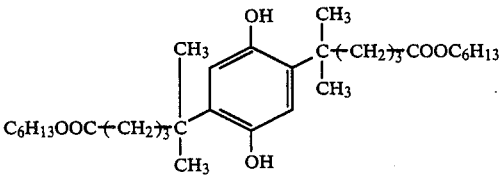

-continued
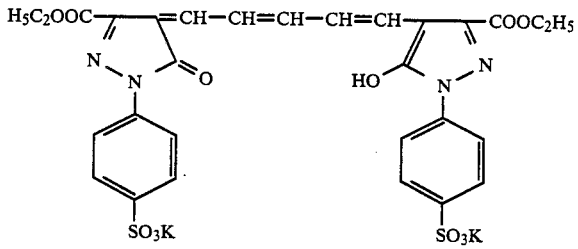
(A-124)
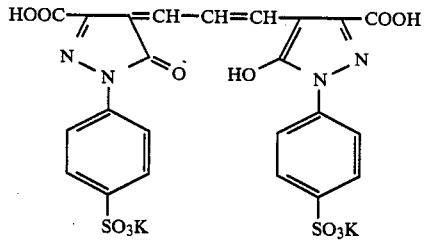
(A-125)
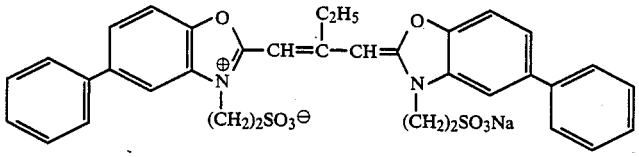
(A-126)
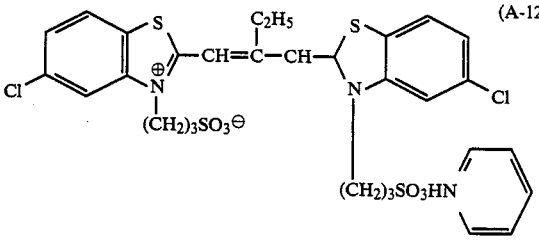
(A-127)
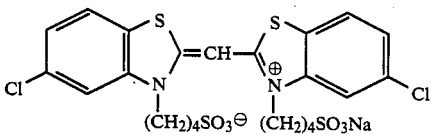
(A-128)
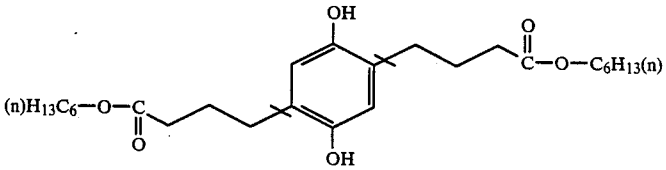
(A-129)
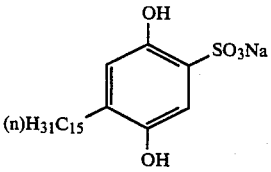
(A-130)
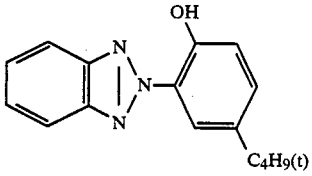
(A-131)
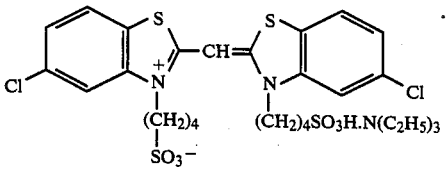
(A-132)
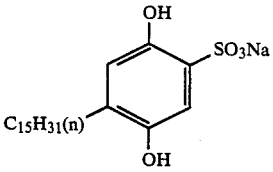
(A-133)
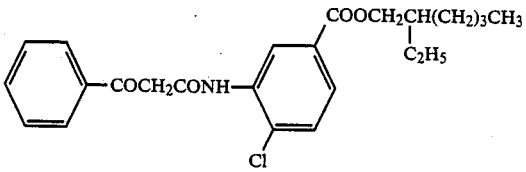
(A-134)

-continued
(A-135)
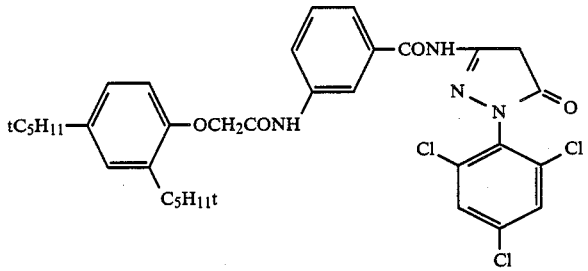
(A-136)
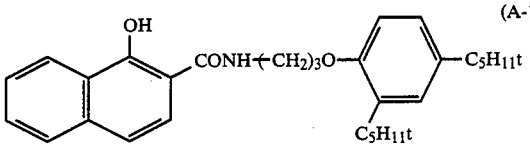
(A-137)
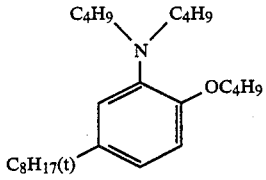
(A-138)
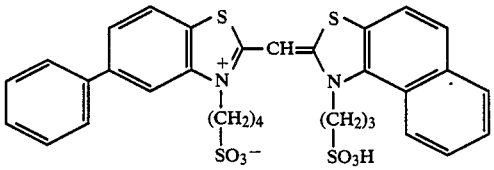
(A-139)
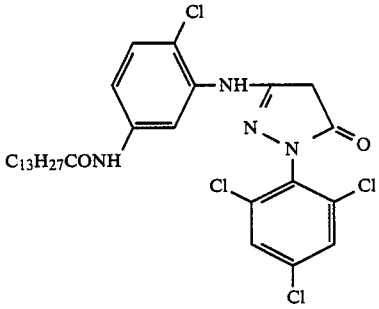
(A-140)
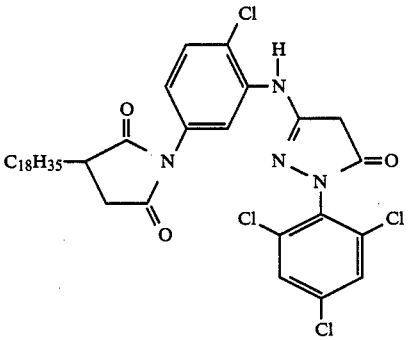
(A-141)
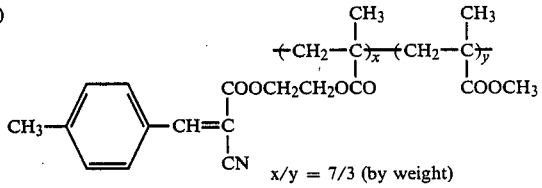
x/y = 7/3 (by weight)
(A-142)
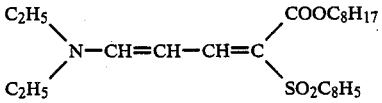
(A-143)
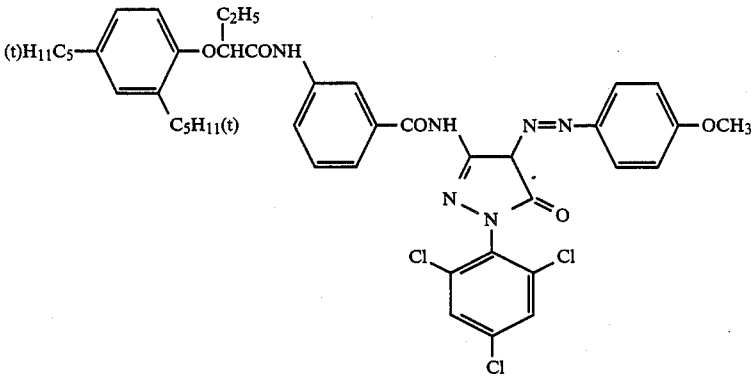

-continued
(A-144)
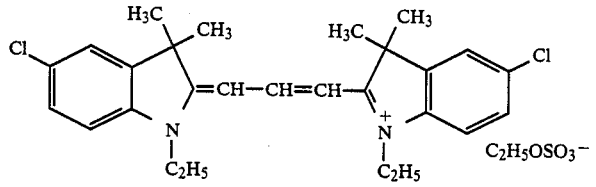
(A-145)
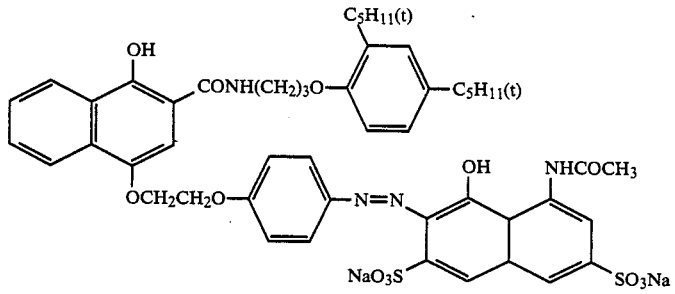
(A-146)
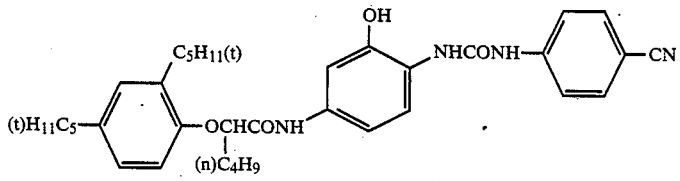
(A-147)
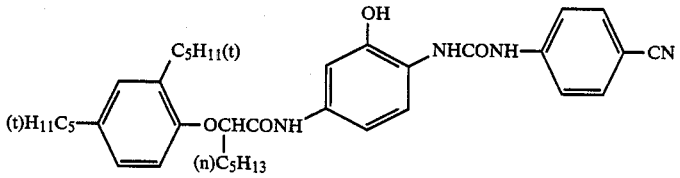
(A-148)
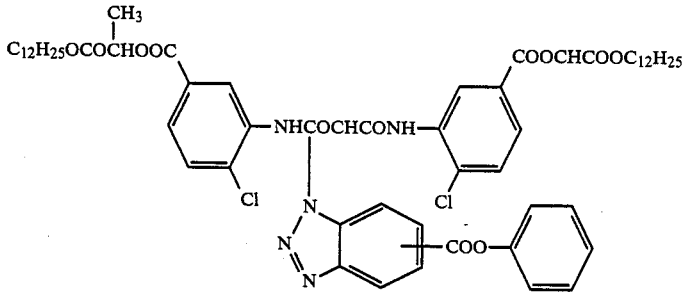
(A-149)
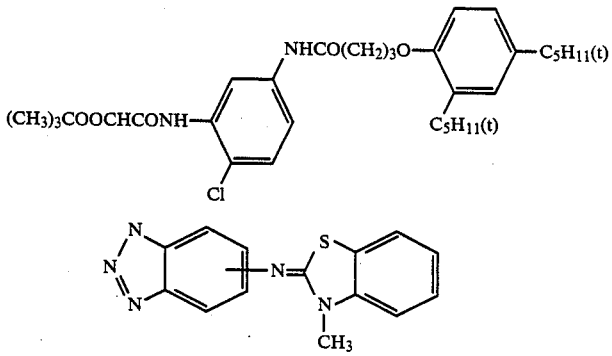

-continued
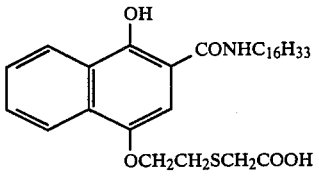
(A-150)
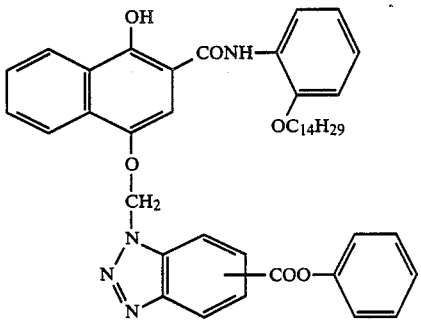
(A-151)
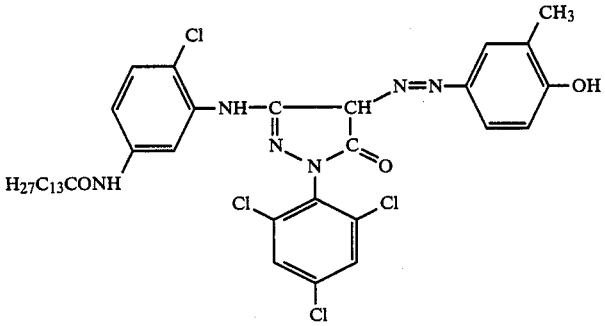
(A-152)
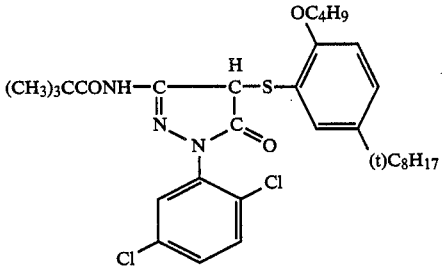
(A-153)
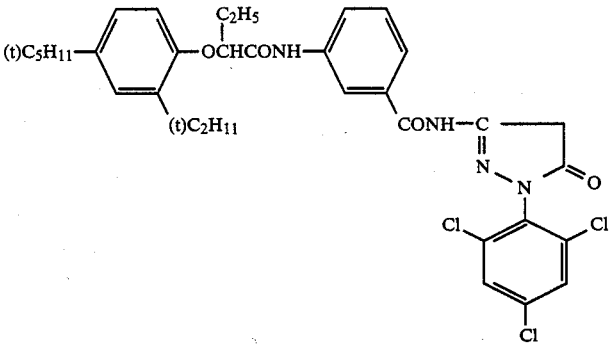
(A-154)
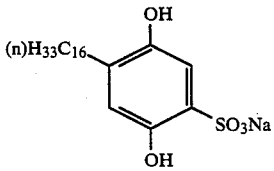
(A-155)
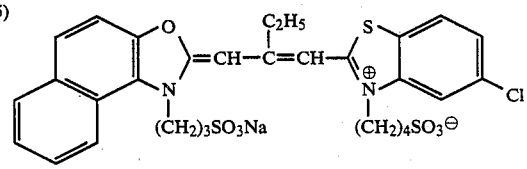
(A-156)

-continued
(A-157)
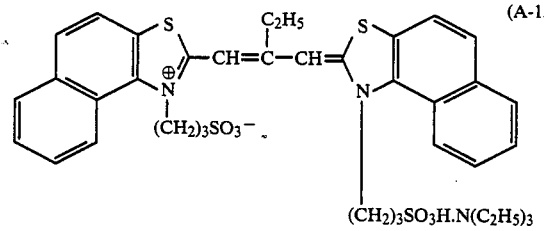
(A-158)
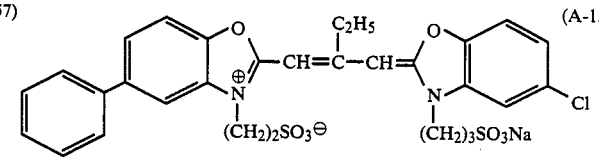
(A-159)
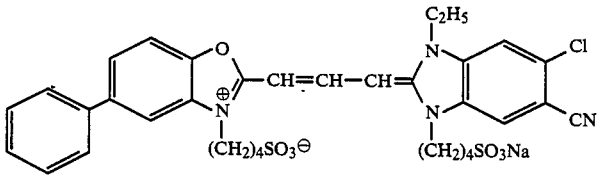
(A-160)
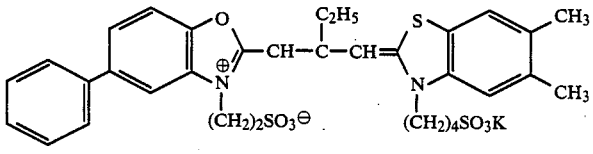
(A-161)
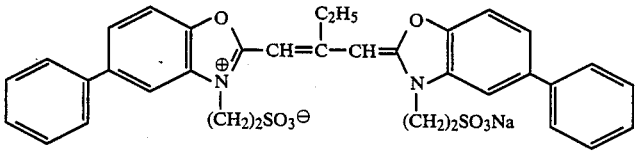
(A-162)
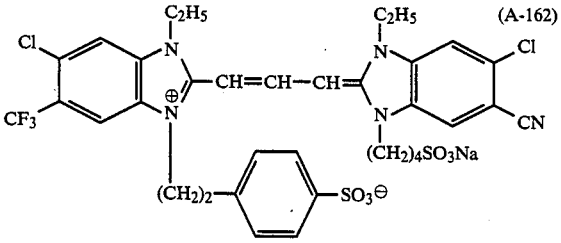
(A-163)
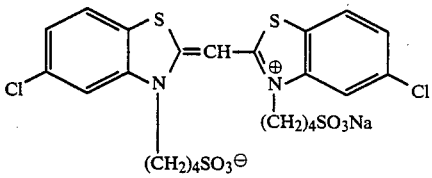
(A-164)
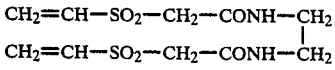
(A-165)
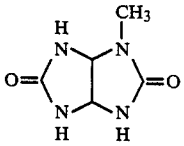
(A-166)
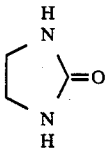
(A-167)
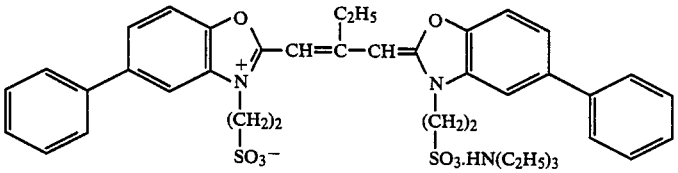
(A-168)
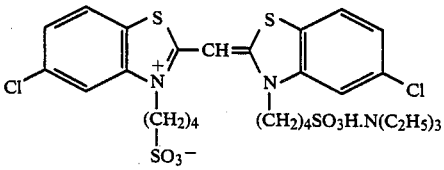

EXAMPLE 1

A multilayer color photographic paper (1-A) was prepared by forming the layers having the compositions shown below on a paper support both surfaces of which were coated with polyethylene. The coating compositions for the layers were prepared as mentioned below. As the gelatin, an alkali-processed gelatin having an isoelectric point of 5.0 was used in every layer.

Coating Composition for First Layer 27.2 cc of ethyl acetate and 7.7 cc (8.0 g) of High Boiling Point Organic Solvent (Solv-1) were added to 10.2 g of yellow coupler, Compound (A-20), 9.1 g of yellow coupler, Compound (A-19), and 4.4 g of color image stabilizer, Compound (A-104), and dissolved and the resulting solution was dispersed by emulsification in 185 cc of an aqueous 10 wt% gelatin solution containing 8 cc of a 10 wt% sodium dodecylbenzenesulfonate solution. The emulsified dispersion and Emulsion (EM1) and Emulsion (EM2) (both of which are described in detail below) were blended and dissolved and the gelatin concentration was adjusted as shown below to provide the coating composition for the first layer. Coating composition for the second layer to the seventh layer were also prepared by the same manner as in the first layer. As a gelatin hardening agent for each layer, 1-hydroxy-3,5-dichloro-s-triazine sodium salt was used. As a thickening agent there was used Compound (A-105).

Layer Constitution

The compositions of the layers were as follows. The number which appears after each component means the amount coated (g/m$^2$) for that component. The amount coated of the silver halide emulsion means the amount coated of silver therein.

| | |
|---|---|
| Support | |
| Polyethylene-coated paper, containing a white pigment ($TiO_2$) and a bluish dye in the polyethylene coat for the first layer. | |
| First Layer: Blue-Sensitive Emulsion Layer | |
| Monodispersed Silver Chlorobromide Emulsion (EM1) (spectrally sensitized with sensitizing dye, Compound (A-99) ($5 \times 10^{-4}$ mol per mol of emulsion)) | 0.13 |
| Monodispersed Silver Chlorobromide Emulsion (EM2) (spectrally sensitized with sensitizing dye, Compound A-99) ($5 \times 10^{-4}$ mol per mol of emulsion)) | 0.13 |
| Gelatin | 1.86 |
| Yellow Coupler, Compound (A-20) | 0.44 |
| Yellow Coupler, Compound (A-19) | 0.39 |
| Color Image Stabilizer, Compound (A-104) | 0.19 |
| Solvent (Solv-1) | 0.35 |
| Second Layer: Color Mixing Preventing Layer | |
| Gelatin | 0.99 |
| Color Mixing Preventing Agent, Compound (A-106) | 0.08 |
| Third Layer: Green-Sensitive Emulsion Layer | |
| Monodispersed Silver Chlorobromide Emulsion (EM3) (spectrally sensitized with sensitizing dyes, Compounds (A-100) and (A-101) ($4 \times 10^{-4}$ and $7 \times 10^{-4}$ mol per mol of emulsion, respectively) | 0.05 |
| Monodispersed Silver Chlorobromide Emulsion (EM4) (spectrally sensitized with sensitizing dyes, Compounds (A-100) and (A-101) ($4 \times 10^{-4}$ and $7 \times 10^{-4}$ mol per mol of emulsion, respectively) | 0.11 |
| Gelatin | 1.80 |
| Magenta Coupler, Compound (A-39) | 0.39 |
| Color Image Stabilizer, Compound (A-107) | 0.20 |
| Color Image Stabilizer, Compound (A-108) | 0.02 |
| Color Image Stabilizer, Compound (A-109) | 0.03 |
| Solvent (Solv-2) | 0.12 |
| Solvent (Solv-3) | 0.25 |
| Fourth Layer: Ultraviolet Absorbing Layer | |
| Gelatin | 1.60 |
| Ultraviolet Absorbents, Compounds (A-110)/(A-111)/(A-112) = 3/2/6 (by weight) | 0.70 |
| Color Mixing Preventing Agent, Compound (A-113) | 0.05 |
| Solvent (Solv-4) | 0.27 |
| Fifth Layer: Red-Sensitive Emulsion Layer | |
| Monodispersed Silver Chlorobromide Emulsion (EM5) (spectrally sensitized with sensitizing dyes, Compounds (A-102) and (A-103) ($9 \times 10^{-5}$ and $2.6 \times 10^{-3}$ mol per mol of emulsion, respectively) | 0.07 |
| Monodispersed Silver Chlorobromide Emulsion (EM6) (spectrally sensitized with sensitizing dyes, Compounds (A-102) and (A-103) ($9 \times 10^{-5}$ and $2.6 \times 10^{-3}$ mol per mol of emulsion, respectively) | 0.16 |
| Gelatin | 0.92 |
| Cyan Coupler, Compound (A-69) | 0.32 |
| Color Image Stabilizers, Compounds (A-111)/(A-112)/(A-115) = 3/4/2 (by weight) | 0.17 |
| Dispersion Polymer, Compound (A-114) | 0.28 |
| Solvent (Solv-1) | 0.20 |
| Sixth Layer: Ultraviolet Absorbing Layer | |
| Gelatin | 0.54 |
| Ultraviolet Absorbents, Compounds (A-110)/(A-112)/(A-115) = 1/5/3 (by weight) | 0.21 |
| Solvent (Solv-4) | 0.08 |
| Seventh Layer: Protective Layer | |
| Gelatin | 1.33 |
| Acryl-Modified Copolymer of Polyvinyl Alcohol (modification degree of 17%) | 0.17 |
| Liquid Paraffin | 0.03 |

As anti-irradiation dyes there were used Compounds (A-116) and (A-117).

In addition, Alkanol XC (by Du Pont), sodium alkylbenzenesulfonate, succinic acid ester and Magefacx F-120 (by Dai-Nippon Ink & Chemicals) were used as an emulsification and dispersing agent and a coating assistant agent in each layer. As stabilizers for silver halides were used Compounds (A-117) and (A-118).

The details of the emulsions used were as follows.

| Emulsion | Grain Size (μ) | Br Content (mol %) | Fluctuation* Coefficient |
|---|---|---|---|
| EM1 | 1.0 | 80 | 0.08 |
| EM2 | 0.75 | 80 | 0.07 |
| EM3 | 0.5 | 83 | 0.09 |
| EM4 | 0.4 | 83 | 0.10 |
| EM5 | 0.5 | 73 | 0.09 |
| EM6 | 0.4 | 73 | 0.10 |

* $\frac{\text{Standard Deviation}}{\text{Mean Grain Size}}$ (This means the grain size distribution)

Samples (1-B) to (1-I) were prepared in the same manner as in the preparation of Sample (1-A), except that the kind of gelatin used was varied as shown in Table 1 below without changing the amount of the gelatin coated.

TABLE 1

| Sample | 1st Layer (%) | 2nd Layer (%) | 3rd Layer (%) | 4th Layer (%) | 5th Layer (%) | 6th Layer (%) | 7th Layer (%) | Proportion of Acid-Processed Gelatin to the Total Gelatin (%) |
|---|---|---|---|---|---|---|---|---|
| 1-A | a: 100 | a: 100 | a: 100 | a: 100 | a: 100 | a: 100 | a: 100 | 0 |
| 1-B | a: 90<br>b: 10 | a: 90<br>b: 10 | a: 90<br>b: 10 | a: 90<br>b: 10 | a: 90<br>b: 10 | a: 90<br>b: 10 | a: 90<br>b: 10 | 10 |
| 1-C | a: 70<br>b: 30 | a: 70<br>b: 30 | a: 70<br>b: 30 | a: 70<br>b: 30 | a: 70<br>b: 30 | a: 70<br>b: 30 | a: 70<br>b: 30 | 30 |
| 1-D | a: 70<br>b: 30 | a: 70<br>b: 30 | a: 70<br>b: 30 | a: 70<br>b: 30 | a: 70<br>b: 30 | a: 70<br>b: 30 | a: 70<br>b: 30 | 30 |
| 1-E | a: 50<br>b: 50 | a: 50<br>b: 50 | a: 50<br>b: 50 | a: 50<br>b: 50 | a: 50<br>b: 50 | a: 50<br>b: 50 | a: 50<br>b: 50 | 50 |
| 1-F | b: 100 | b: 100 | b: 100 | b: 100 | b: 100 | b: 100 | b: 100 | 100 |
| 1-G | a: 100 | a: 40<br>b: 60 | a: 100 | a: 40<br>b: 60 | a: 100 | a: 40<br>b: 60 | a: 40<br>b: 60 | 28 |
| 1-H | a: 40<br>b: 60 | a: 100 | a: 40<br>b: 60 | a: 100 | a: 40<br>b: 60 | a: 100 | a: 100 | 32 |
| 1-I | a: 70<br>b: 30 | a: 100 | a: 70<br>b: 30 | a: 100 | a: 70<br>b: 30 | a: 100 | a: 100 | 16 |

a: Alkali-processed gelatin having PI of 5.0
b: Acid-processed gelatin having PI of 5.0
c: Acid-processed gelatin having PI of 9.0

Sample (1-A) was imagewise exposed and then continuously processed in accordance with the processing procedure as mentioned below until the developer replenisher was added to the developer bath in an amount of 2 times of the developer bath capacity.

| Processing Step | Temperature (°C.) | Time | Amount of Replenisher* | Tank Capacity (l) |
|---|---|---|---|---|
| Color Development | 38 | 1 min 40 sec | 290 ml | 17 |
| Bleach-Fixation | 33 | 60 sec | 150 ml | 9 |
| Rinsing-in-Water (1) | 30–34 | 20 sec | — | 4 |
| Rinsing-in-Water (2) | 30–34 | 20 sec | — | 4 |
| Rinsing-in-Water (3) | 30–34 | 20 sec | 10 l | 4 |
| Drying | 70–80 | 50 sec | | |

*This means the amount per $m^2$ of the photographic material which is being processed.

(The rinsing step was carried out by a three-tank countercurrent system in which water flowed from a last rinsing tank (3) to rinsing tank (2) and then to a first rinsing tank (1), and the photographic material passed through the rinsing tanks in countercurrent by first entering rinsing tank (1) and then entering in succession rinsing tanks (2) and (3).)

The compositions of the respective processing solutions were as follows.

| | Tank Solution | Replenisher |
|---|---|---|
| Color Developer: | | |
| Water | 800 ml | 800 ml |
| Diethylenetriaminepentaacetic Acid | 1.0 g | 1.0 g |
| Nitrilotriacetic Acid | 2.0 g | 2.0 g |
| 1-Hydroxyethyliene-1,1-diphosphonic Acid | 2.0 g | 2.0 g |
| Potassium Bromide | 0.5 g | — |
| Potassium Carbonate | 30 g | 30 g |
| N—Ethyl-N—(β-methanesulfonamidoethyl)-3-methyl-4-aminoaniline Sulfate | 5.5 g | 7.5 g |
| N,N—Diethylhydroxylamine | 3.6 g | 5.5 g |
| Brightening Agent (WHITEX 4, by Sumitomo Chemical Co.) | 1.5 g | 2.0 g |
| Triethylenediamine(1,4-diazabicyclo[2,2,2]octane) | 5.0 g | 5.0 g |
| Water to make | 1,000 ml | 1,000 ml |
| pH (25° C.) | 10.20 | 10.060 |
| Bleach-Fixing Solution: | | |
| Water | 400 ml | 400 ml |
| Ammonium Thiosulfate (70 wt %) | 200 ml | 300 ml |
| Sodium Sulfate | 20 g | 40 g |
| Ammonium (Ethylenediaminetetraacetato) Iron(III) | 60 g | 120 g |
| Disodium Ethylenediaminetetraacetate | 5 g | 10 g |
| Water to make | 1,000 ml | 1,000 ml |
| pH (25° C.) | 6.70 | 6.30 |

Samples (1-A) to (1-I) were processed in the form of a non-exposed state with the above-mentioned processing solutions (working solutions) used by the running procedure, and the value of $D_{min}$ immediately after processing and the value after storage for 1 month under the condition of 60° C. and 70% RH were measured. The results obtained are shown in Table 2 below. The value $D_{min}$ refers to the minimum density.

TABLE 2

| No. | Sample | Note | $D_{min}$ (immediately after processing) B | G | R | $D_{min}$ (after storage) B | G | R |
|---|---|---|---|---|---|---|---|---|
| 1 | 1-A | Comparison | 0.15 | 0.29 | 0.19 | 0.30 | 0.35 | 0.24 |
| 2 | 1-B | " | 0.15 | 0.28 | 0.18 | 0.28 | 0.35 | 0.24 |
| 3 | 1-C | Invention | 0.11 | 0.25 | 0.15 | 0.18 | 0.31 | 0.20 |
| 4 | 1-D | " | 0.11 | 0.25 | 0.15 | 0.18 | 0.31 | 0.20 |
| 5 | 1-E | " | 0.10 | 0.24 | 0.15 | 0.16 | 0.29 | 0.18 |
| 6 | 1-F | " | 0.10 | 0.24 | 0.15 | 0.15 | 0.29 | 0.18 |
| 7 | 1-G | " | 0.11 | 0.25 | 0.15 | 0.18 | 0.29 | 0.19 |
| 8 | 1-H | " | 0.11 | 0.25 | 0.15 | 0.18 | 0.30 | 0.20 |
| 9 | 1-I | Comparison | 0.15 | 0.28 | 0.18 | 0.28 | 0.34 | 0.24 |

According to the present invention (Sample Nos. 3 to 9), not only the value $D_{min}$ immediately after processing was small, but also the increase of the stain after storage was small. In particular, when the content of the acid-processed gelatin was 50% by weight or more (Sample Nos. 5 and 6), the effect was remarkable.

EXAMPLE 2

Sample (1-A) was processed in the same manner as in the running procedure of Example 1, except that an ion-exchanged water (in which the calcium content and magnesium content each were 3 ppm or less) was used as the rinsing water and the amount of the replenishment added to the color developer was 360 ml/m$^2$ of the photographic paper being processed.

Afterwards, Samples (1-A) to (1-I) were processed in the same manner as in Example 1, and the value $D_{min}$ of each of thus processed samples was measured. As a result, the stain of the samples of the present invention was favorably small.

EXAMPLE 3

A multilayer photographic paper was prepared by forming the layers having the compositions shown below on a paper support both surfaces of which were coated with polyethylene. The coated composition for the layers were prepared as follows.

Coating Composition for First Layer 27.2 cc of ethyl acetate and 7.7 cc (8.0 g) of high boiling point organic solvent (Solv-1) were added to 19.1 g of yellow coupler, Compound (A-19), and 4.4 g of color image stabilizer, Compound (A-105), and dissolved, and the resulting solution was dispersed by emulsification in 185 cc of an aqueous 10 wt% gelatin solution containing 8 cc of a 10 wt% sodium dodecylbenzenesulfonate solution. The emulsified dispersion and Emulsions (EM7) and (EM8) (which are described in detail below) were blended and dissolved and the gelatin concentration was adjusted as shown below to provide the coating composition for the first layer. Coating compositions for the second to seventh layers were also prepared by the same manner as in the first layer. As a gelatin hardening agent for each layer, 1-hydroxy-3,5-dichloro-s-triazine sodium salt was used. As a thickening agent there was used Compound (A-105).

The compositions of the layers were as follows. The number which appears after each component means the amount coated (g/m$^2$) for that component. The amount coated of the silver halide emulsion means the amount coated of silver therein.

| | |
|---|---|
| Support: | |
| Polyethylene-coated paper containing a white pigment ($TiO_2$) and a bluish dye in the polyethylene coat for the first layer. | |
| First Layer: Blue-Sensitive Emulsion Layer | |
| Monodispersed Silver Chlorobromide Emulsion (EM7) (spectrally sensitized with sensitizing dye, Compound (A-121) ($6 \times 10^{-4}$ mol per mol of emulsion)) | 0.15 |
| Monodispersed Silver Chlorobromide Emulsion (EM8) (spectrally sensitized with sensitizing dye, Compound (A-121) ($6 \times 10^{-4}$ mol per mol of emulsion)) | 0.15 |
| Gelatin | 1.86 |
| Yellow Coupler, Compound (A-19) | 0.82 |
| Color Image Stabilizer, Compound (A-104) | 0.19 |
| Solvent (Solv-1) | 0.35 |
| Second Layer: Color Mixing Preventing Layer | |
| Gelatin | 0.99 |
| Color Mixing Preventing Agent, Compound (A-106) | 0.08 |
| Third Layer: Green-Sensitive Emulsion Layer | |
| Monodispersed Silver Chlorobromide Emulsion (EM9) (spectrally sensitized with sensitizing dyes, Compounds (A-101) and (A-122) ($8 \times 10^{-5}$ and $4 \times 10^{-4}$ mol per mol of emulsion, respectively)) | 0.12 |
| Monodispersed Silver Chlorobromide Emulsion (EM10) (spectrally sensitized with sensitizing dyes, Compounds (A-101) and (A-122) ($8 \times 10^{-5}$ and $4 \times 10^{-4}$ mol per mol of emulsion, respectively)) | 0.24 |
| Gelatin | 1.24 |
| Magenta Coupler, Compound (A-120) | 0.39 |
| Color Image Stabilizer, Compound (A-107) | 0.25 |
| Color Image Stabilizer, Compound (A-123) | 0.12 |
| Solvent (Solv-3) | 0.25 |
| Fourth Layer: Ultraviolet Absorbing Layer | |
| Gelatin | 1.60 |
| Ultraviolet Absorbents, Compounds (A-110)/(A-111)/(A-112) = 3/2/6 (by weight) | 0.70 |
| Color Mixing Prevening Agent, Compound (A-113) | 0.05 |
| Solvent (Solv-4) | 0.42 |
| Fifth Layer: Red-Sensitive Emulsion Layer | |
| Monodispersed Silver Chlorobromide Emulsion (EM11) (spectrally sensitized with sensitizing dyes, Compounds (A-102) and (A-103) ($1.8 \times 10^{-4}$ and $2.6 \times 10^{-3}$ mol per mol of emulsion, respectively)) | 0.07 |
| Monodispersed Silver Chlorobromide Emulsion (EM12) (spectrally sensitized with sensitizing dyes, Compounds (A-102) and (A-103) ($1.8 \times 10^{-4}$ and $2.6 \times 10^{-3}$ mol per mol of emulsion, respectively)) | 0.16 |
| Gelatin | 0.92 |
| Cyan Coupler, Compound (A-59) | 1.46 |
| Cyan Coupler, Compound (A-72) | 1.84 |
| Color Image Stabilizers, Compounds (A-111)/(A-112)/(A-115) = 3/4/2 (by weight) | 0.17 |
| Dispersion Polymer, Compound (A-112) | 0.14 |
| Solvent (Solv-1) | 0.20 |
| Sixth Layer: Ultraviolet Absorbing Layer | |
| Gelatin | 0.54 |
| Ultraviolet Absorbents, Compounds (A-110)/(A-112)/(A-115) = 1/5/3 (by weight) | 0.21 |
| Solvent (Solv-2) | 0.08 |
| Seventh Layer: Protective Layer | |
| Gelatin | 1.33 |
| Acryl-Modified Copolymer of Polyvinyl Alcohol (modification degree: 17%) | 0.17 |
| Liquid Paraffin | 0.03 |

As anti-irradiation dyes were used Compounds (A-124) and (A-125).

In addition, Alkanol XC (by Du Pont), sodium alkylbenzenesulfonate, succinic acid ester and Magefaxc F-120 (by Dai-Nippon Ink & Chemicals) were used as an emulsification and dispersing agent and a coating assistant agent in each layer. As stabilizers for silver halides were used Compounds (A-118) and (A-119).

The details of the emulsions used were as follows.

| Emulsion | Shape | Grain Size (μ) | Br Content | Fluctuation Coefficient* |
|---|---|---|---|---|
| (EM7) | Cubic | 1.1 | 1.0 | 0.10 |
| (EM8) | Cubic | 0.8 | 1.0 | 0.10 |
| (EM9) | Cubic | 0.45 | 1.5 | 0.09 |
| (EM10) | Cubic | 0.34 | 1.5 | 0.09 |
| (EM11) | Cubic | 0.45 | 1.5 | 0.09 |
| (EM12) | Cubic | 0.34 | 1.6 | 0.10 |

* $\frac{\text{Standard Deviation}}{\text{Mean Grain Size}}$ (This means the grain size distribution)

As the gelatin, an alkali-processed gelatin having an isoelectric point of 5.0 was used in every layer. The sample thus prepared was designated as Sample (3-A).

Next, Sample (3-B) was prepared in the same manner as in the preparation of Sample (3-A), except that a half (50%) of the gelatin in each of the first to seventh layers was substituted by an acid-processed gelatin having an isoelectric point of 7. Also, Sample (3-C) was prepared in the same manner, except that all of the gelatin (100%) used in all the layers was the acid-processed gelatin.

The above-mentioned Sample (3-A) was, after being imagewise exposed, processed by the use of Fuji Color Paper Processing Machine PP600 (modified type), in accordance with the processing procedure as mentioned below. The processing was carried out in a continuous system using a continuous procedure (running test) until the amount of the color developer replenisher added became two times the capacity of the color developer tank. The composition of the color developer was varied as shown in Table 3 below (CD-1, CD-2, CD-3, CD-4) for the running test.

| Processing Step | Temperature (°C.) | Time (sec) | Amount of Replenisher* (ml) | Tank Capacity (l) |
|---|---|---|---|---|
| Color Development | 35 | 45 | 290 | 17 |
| Bleach-Fixation | 33 | 60 | 150 | 9 |
| Rinsing (1) | 30–34 | 20 | — | 4 |
| Rinsing (2) | 30–34 | 20 | — | 4 |
| Rinsing (3) | 30–34 | 20 | 300 | 4 |
| Drying | 70–80 | 50 | | |

*Amount per $m^2$ of the photographic paper being processed.

The rinsing step was carried out by a three-tank countercurrent system in which water flowed from a last rinsing tank (3) to a rinsing tank (2) and then to a first rinsing tank (1) and the photographic material passed through the rinsing tanks in countercurrent by first entering rinsing tank (1) and then entering in succession rinsing tanks (2) and (3).

The compositions of the respective processing solutions were as follows.

| | Tank Solution | Replenisher |
|---|---|---|
| Color Developer: | | |
| Water | 800 ml | 800 ml |
| Ethylenediaminetetraacetic Acid | 1.0 g | 1.0 g |
| Nitrilotriacetic Acid | 2.0 g | 2.0 g |
| 1-Hydroxyethylidene-1,1-diphosphonic Acid | 2.0 g | 2.0 g |
| Benzyl Alcohol | See Table 3 | |
| Diethylene Glycol | See Table 3 | |
| Sodium Sulfite | See Table 3 | |
| Sodium Chloride | 0.5 g | — |
| Potassium Carbonate | 30 g | 30 g |
| N—Ethyl-N—(β-methanesulfonamidoethyl)-3-methyl-4-aminoaniline | 5.5 g | 7.5 g |
| Sulfate | | |
| N,N—Diethylhydroxylamine | 3.6 g | 5.5 g |
| Triethanolamine | 10.0 g | 10.0 g |
| Brightening Agent (UNITEX CK Ciba Geigy) | 1.5 g | 2.0 g |
| Water to make | 1,000 ml | 1,000 ml |
| pH (25° C.) | 10.20 | 10.60 |
| Bleach-Fixing Solution: | | |
| Water | 400 ml | 400 ml |
| Ammonium Thiosulfate (70 wt %) | 200 ml | 300 ml |
| Sodium Sulfite | 20 g | 40 g |
| Ammonium (Ethylenediaminetetraacetato) Iron(III) | 60 g | 120 g |
| Disodium Ethylenediaminetetraacetate | 5 g | 10 g |
| Water to make | 1,000 ml | 1,000 ml |
| pH (25° C.) | 6.70 | 6.30 |
| Rinsing Solution: | | |
| (Tank solution and replenisher were the same.) | | |
| Benzotriazole | 1.0 g | |
| Ethylenediamine-N,N,N',N'—tetramethylenephosphonic Acid | 0.3 g | |
| Water to make | 1,000 ml | |
| pH | 7.0 | |

TABLE 3

| | (Benzyl Alcohol)/(Diethylene Glycol) | | Sodium Sulfite | |
|---|---|---|---|---|
| | Tank Solution (ml) | Replenisher (ml) | Tank Solution (g) | Replenisher (g) |
| CD-1 | 15/10 | 20/10 | 1.7 | 2.5 |
| CD-2 | 15/10 | 20/10 | — | — |
| CD-3 | — | — | 1.7 | 2.5 |
| CD-4 | — | — | — | — |

The above-mentioned photographic paper samples (3-A), (3-B) and (3-C) were wedgewise exposed and then processed with each of the fresh solutions (CD-1) to (CD-4) (at the beginning of the running test) and the aged solutions (the solutions at the equilibrated running) (CD-1) to (CD-4) (at the end of the running test). The value $D_{min}$* and the gradation* of each of the samples thus processed were measured. The variation of the value $D_{min}$ and gradation between the beginning of the running test and the end of the running test was calculated in each sample. The results obtained are shown in Table 4 below.

*The value $D_{min}$ means the minimum density; and the gradation is represented by the density variation from the point having a density of 0.5 to the density point which is on the side of a higher exposure by 0.3 of log E.

TABLE 4

| No. | Sample | Process | $\Delta D_{min}$ B | $\Delta D_{min}$ G | $\Delta D_{min}$ R | ΔGradation B | ΔGradation G | ΔGradation R | Note |
|---|---|---|---|---|---|---|---|---|---|
| 1 | 3-A | CD-1 | +0.05 | +0.05 | +0.05 | +0.04 | +0.02 | +0.02 | Comparison |
| 2 | " | CD-2 | +0.08 | +0.06 | +0.06 | +0.02 | +0.01 | +0.01 | " |
| 3 | " | CD-3 | +0.04 | +0.04 | +0.04 | +0.05 | +0.03 | +0.01 | " |
| 4 | " | CD-4 | +0.05 | +0.05 | +0.05 | +0.01 | 0 | 0 | " |
| 5 | 3-B | CD-1 | +0.02 | +0.01 | 0 | +0.02 | +0.02 | +0.01 | Invention |
| 6 | " | CD-2 | +0.02 | +0.02 | 0 | 0 | 0 | 0 | " |
| 7 | " | CD-3 | 0 | 0 | 0 | +0.02 | +0.01 | 0 | " |
| 8 | " | CD-4 | 0 | +0.01 | 0 | 0 | +0.01 | 0 | " |
| 9 | 3-C | CD-1 | +0.02 | +0.01 | 0 | +0.02 | +0.02 | 0 | " |
| 10 | " | CD-2 | +0.02 | +0.01 | +0.01 | +0.01 | +0.01 | 0 | " |
| 11 | " | CD-3 | 0 | 0 | 0 | +0.02 | +0.02 | 0 | " |
| 12 | " | CD-4 | 0 | 0 | 0 | +0.01 | 0 | 0 | " |

In the comparative samples, the fluctuation of the value $D_{min}$ and the gradation were noticeable irrespective of the presence or absence of benzyl alcohol and sodium sulfite; while in the samples of the present invention, extremely stable photographic characteristics were attained in the system containing neither benzyl alcohol nor sodium sulfite (Nos. 8 and 12).

EXAMPLE 4

Samples (3-A), (3-B) and (3-C) were wedgewise exposed and processed with the aged solution (as used in the running test CD-4 in Example 3), whereupon the time of the bleach-fixing step and that of the rinsing step were varied as shown in Table 5 below. The processing procedure was as follows.

| Processing Step | Solution Used | Time (sec) | Temperature (°C.) |
|---|---|---|---|
| Color Development | Aged CD-4 Solution (after used in running test) | 45 | 35 |
| Bleach-Fixation | Aged Bleach-Fixing Solution of CD-4 (after used in running test) | See Table 5 | 33 |
| Rinsing-in-Water | Flowing Water (10 liters/min) | See Table 5 | 30 |
| Drying | — | 50 | 70 |

After aging the processed samples for 1 month under the condition of 60° C. and 70% RH, the change in the value $D_{min}$ and the decrease of the density from the point having a density of 2.0 were measured in each sample, and the results obtained are shown in Table 5.

TABLE 5

| | Processing Time | | | | | $\Delta D_{min}$ | | | $\Delta D_{2.0}$ | | |
|---|---|---|---|---|---|---|---|---|---|---|---|
| No. | (1) Bleach-Fixation | (2) Rinsing | (1) + (2) | Sample | Note | B | G | R | B | G | R |
| 1 | 2'00" | 2'00" | 4'00" | 3-A | Comparison | 0.11 | 0.23 | 0.14 | −0.10 | −0.15 | −0.20 |
| 2 | 1'00" | 3'00" | 4'00" | " | " | 0.11 | 0.23 | 0.14 | −0.10 | −0.15 | −0.20 |
| 3 | 1'30" | 2'00" | 3'30" | " | " | 0.12 | 0.24 | 0.15 | −0.10 | −0.14 | −0.19 |
| 4 | 1'00" | 1'30" | 2'30" | " | " | 0.15 | 0.26 | 0.17 | −0.09 | −0.13 | −0.18 |
| 5 | 1'00" | 1'00" | 2'00" | " | " | 0.15 | 0.26 | 0.17 | −0.09 | −0.13 | −0.17 |
| 6 | 30" | 1'00" | 1'30" | " | " | 0.17 | 0.27 | 0.18 | −0.09 | −0.13 | −0.17 |
| 7 | 2'00" | 2'00" | 4'00" | 3-B | Comparison | 0.11 | 0.23 | 0.14 | −0.08 | −0.13 | −0.18 |
| 8 | 1'00" | 3'00" | 4'00" | " | " | 0.11 | 0.23 | 0.14 | −0.08 | −0.12 | −0.17 |
| 9 | 1'30" | 2'00" | 3'30" | " | " | 0.11 | 0.23 | 0.14 | −0.08 | −0.10 | −0.16 |
| 10 | 1'00" | 1'30" | 2'30" | " | Invention | 0.11 | 0.23 | 0.14 | −0.08 | −0.05 | −0.11 |
| 11 | 1'00" | 1'00" | 2'00" | " | " | 0.11 | 0.23 | 0.14 | −0.07 | −0.04 | −0.08 |
| 12 | 30" | 1'00" | 1'30" | " | " | 0.12 | 0.24 | 0.15 | −0.07 | −0.04 | −0.07 |
| 13 | 2'00" | 2'00" | 4'00" | 3-C | Comparison | 0.11 | 0.23 | 0.14 | −0.08 | −0.13 | −0.17 |
| 14 | 1'00" | 3'00" | 4'00" | " | " | 0.11 | 0.23 | 0.14 | −0.08 | −0.13 | −0.16 |
| 15 | 1'30" | 2'00" | 3'30" | " | " | 0.11 | 0.23 | 0.14 | −0.08 | −0.12 | −0.15 |
| 16 | 1'00" | 2'00" | 3'00" | " | Invention | 0.11 | 0.23 | 0.14 | −0.07 | −0.06 | −0.10 |
| 17 | 1'00" | 1'00" | 2'00" | " | " | 0.11 | 0.23 | 0.14 | −0.07 | −0.05 | −0.07 |
| 18 | 30" | 1'00" | 1'30" | " | " | 0.11 | 0.23 | 0.14 | −0.07 | −0.04 | −0.06 |

In the comparative samples, the change in the value $D_{min}$ increased when the total processing time of (1) bleach-fixation and (2) rinsing was 3 minutes or less (Sample Nos. 4, 5 and 6); while in the samples of the present invention, an increase of the change in the value $D_{min}$ was not observed at all and additionally the image stability after storage, as measured by the change in density ($\Delta D$), was improved (Sample Nos. 10, 11, 12, 16, 17 and 18).

EXAMPLE 5

Emulsion (A) and Emulsion (B) were prepared as follows.

Emulsion (A)

An aqueous solution of potassium bromide and an aqueous solution of silver nitrate were simultaneously added to an aqueous gelatin solution containing 3,4-dimethyl-1,3-thiazoline-2-thione in an amount of 0.3 g per mol of silver (Ag) with vigorous stirring at 75° C. over about 20 minutes to provide a monodispersed silver bromide emulsion containing grains having a mean grain size of 0.4 μm. To the emulsion were added sodium thiosulfate and chloroauric acid ($4H_2O$) each in an amount of 6 mg per mol of silver, and the whole was heated at 75° C. for 80 minutes for chemical sensitization of the emulsion. The thus-formed silver bromide grain cores were grown for a further time of 40 minutes in the same flocculation environment as the first treatment to finally provide an octahedral monodispersed core/shell silver bromide grain emulsion having a mean grain size of 0.7 μm. After the emulsion was washed in water and demineralized, sodium thiosulfate and chloroauric acid ($4H_2O$) were added to the resulting emulsion each in an amount of 1.5 mg per mol of silver and the whole was heated at 60° C. for 60 minutes for chemical sensitization of the emulsion to obtain an internal latent image type silver halide emulsion (A).

Emulsion (B)

An internal latent image type silver halide emulsion (B) was prepared in the same manner as the preparation of the above-mentioned emulsion (A), except that the amount of the chloroauric acid ($4H_2O$) and that of the sodium thiosulfate used for the chemical sensitization of the silver bromide core each were varied to 20 mg per mol of silver (in place of the amount of 6 mg per mol of silver in Emulsion (A)) and the amount of the chloroauric acid tetrahydrate and sodium thiosulfate used for the next surface sensitization each were varied to 6.5 mg per mol of silver (in place of the amount of 1.5 mg per mol of silver in the Emulsion (A)).

The thus-prepared core/shell latent image-type emulsion was used and a multilayer color photographic paper having the layer constitution as shown below was formed (Sample (5-A)), the layers being coated on a polyethylene-coated paper support. The coating compositions for the layers were prepared as follows.

Coating Composition for First Layer 10 ml of ethyl acetate and 4 ml of solvent ((Solv-2)/(Solv-3)/(Solv-5)=1/2/2 (by weight)) were added to 10 g of magenta coupler, Compound (A-27), and 2.3 g of color image stabilizer, Compounds (A-129)/(A-107)=1/1.5 (by weight), and dissolved, and the resulting solution was dispersed by emulsification in 90 ml of an aqueous 10 wt% gelatin solution containing 5 ml of a 10 wt% sodium dodecylbenzenesulfonate solution. On the other hand, the red-sensitive dye, Compound (A-127), was added to the above-mentioned silver halide emulsion (containing 70 g/kg of silver) in an amount of $2.0\times10^{-4}$ mol per mol of silver halide to provide 90 g of a red-sensitive emulsion. The emulsified dispersion, the emulsion and a development accelerator were blended and dissolved, and the gelatin concentration was adjusted as shown below to provide the coating composition for the first layer. Coating compositions for the second layer to the seventh layer were also prepared in the same manner as in the first layer. As a gelatin hardening agent for each layer, 1-hydroxy-3,5-dichloro-s-triazine sodium salt was used.

The compositions of the layers were as follows. As the support, a polyethylene-coated paper was used, which contained a white pigment ($TiO_2$, etc.) and a bluish dye (ultramarine, etc.) in the polyethylene for the first layer. A curling-preventing layer comprising gelatin (2.70 g/m$^2$) was formed directly on the support on the side opposite to the first layer.

| | |
|---|---|
| Curling Preventing Layer: | |
| Gelatin | 2.70 g/m$^2$ |
| Support: | |
| Polyethylene-coated paper containing a white pigment ($TiO_2$, etc.) and a bluish dye (ultramarine, etc.) in the polyethylene for the first layer. | |
| First Layer: Green-Sensitive Emulsion Layer | |
| Emulsion | 0.39 g/m$^2$ as Ag |
| Gelatin | 1.56 g/m$^2$ |
| Magenta Coupler, Compound (A-27) | $4.60\times10^{-4}$ mol/m$^2$ |
| Color Image Stabilizer, Compounds (A-129)/(A-107) = 1/1.5 (mol ratio) | 0.14 g/m$^2$ |
| Solvent, (Solv-2)/(Solv-3)/(Solv-5) = 1/2/2 (by weight) | 0.22 g/m$^2$ |
| Development Accelerator, Compound (A-130) | 32 mg/m$^2$ |
| Second Layer: Color Mixing Preventing Layer | |
| Gelatin | 0.90 g/m$^2$ |
| Colloidal Silver | 0.02 g/m$^2$ as Ag |
| Color Mixing Preventing Agent, Compound (A-106) | $2.33\times10^{-4}$ mol/m$^2$ |
| Third Layer: Red-Sensitive Emulsion Layer | |
| Emulsion | 0.39 g/m$^2$ as Ag |
| Gelatin | 0.90 g/m$^2$ |
| Cyan Coupler, Compound (A-61) | $7.05\times10^{-4}$ mol/m$^2$ |
| Color Image Stabilizer, Compounds (A-110)/(A-131)/(A-112) = 1/3/3 (mol ratio) | $5.20\times10^{-4}$ mol/m$^2$ |
| Solvent (Solv-2) | 0.22 mg/m$^2$ |
| Development Accelerator, Compound (A-130) | 32 mg/m$^2$ |
| Fourth Layer: Ultraviolet Absorbing Layer | |
| Gelatin | 1.60 g/m$^2$ |
| Colloidal Silver | 0.10 g/m$^2$ as Ag |
| Ultraviolet Absorbent, Compounds (A-110)/(A-112)/(A-115) = 1/5/3 (mol ratio) | $1.70\times10^{-4}$ mol/m$^2$ |
| Color Mixing Preventing Agent, Compound (A-113) | $1.60\times10^{-4}$ mol/m$^2$ |
| Solvent (Solv-4) | 0.24 g/m$^2$ |
| Fifth Layer: Blue-Sensitive Emulsion Layer | |
| Emulsion | 0.40 g/m$^2$ as Ag |
| Gelatin | 1.35 g/m$^2$ |
| Yellow Coupler, Compound (A-20) | $6.91\times10^{-4}$ mol/m$^2$ |
| Color Image Stabilizer, Compound (A-104) | 0.13 g/m$^2$ |
| Solvent (Solv-2) | 0.02 g/m$^2$ |
| Development Accelerator, Compound (A-130) | 32 mg/m$^2$ |
| Sixth Layer: Ultraviolet Absorbing Layer | |
| Gelatin | 0.54 g/m$^2$ |
| Ultraviolet Absorbent, Compounds (A-110)/(A-112)/(A-115) = 1/5/3 (mol ratio) | $5.10\times10^{-4}$ mol/m$^2$ |
| Solvent (Solv-4) | 0.08 g/m$^2$ |
| Seventh Layer: Protective Layer | |
| Gelatin | 1.33 g/m$^2$ |
| Latex Grains of Polymethyl Methacrylate (mean grain size 2.8 μm) | 0.05 g/m$^2$ |
| Acryl-Modified Copolymer of Polyvinyl Alcohol (modification degree 17%) | 0.17 g/m$^2$ |

As the spectral sensitizers for the respective emulsions, the following compounds were used.

For green-sensitive emulsion layer: Compound (A-126) ($3\times10^{-4}$ mol per mol of emulsion)

For red-sensitive emulsion layer: Compound (A-127) ($1.6\times10^{-4}$ mol per mol of emulsion)

For blue-sensitive emulsion layer: Compound (A-128) ($4.2\times10^{-4}$ mol per mol of emulsion)

As the anti-irradiation dyes, the following compounds were used.

For green-sensitive emulsion layer: Compound (A-125)

For red-sensitive emulsion layer: Compound (A-124)

As the gelatin, an alkali-processed gelatin having an isoelectric point of 5.0 was used in every layer.

The direct positive silver halide color photographic material prepared as described above was designated as Sample (5-A).

Other Samples (5-B), (5-C), (5-D) and (5-E) were prepared in the same manner as the preparation of Sample (5-A), except that the gelatin in each of the first to seventh layers were varied as shown in Table 6 below.

TABLE 6

| Sample | 1st Layer (%) | 2nd Layer (%) | 3rd Layer (%) | 4th Layer (%) | 5th Layer (%) | 6th Layer (%) | 7th Layer (%) | Curling Preventing Layer (%) | Total of Acid-Processed Gelatin (%) |
|---|---|---|---|---|---|---|---|---|---|
| 5-A | a: 100 | a: 100 | a: 100 | a: 100 | a: 100 | a: 100 | a: 100 | a: 100 | 10 |
| 5-B | a: 80<br>b: 20 | a: 80<br>b: 20 | a: 80<br>b: 20 | a: 80<br>b: 20 | a: 80<br>b: 20 | a: 80<br>b: 20 | a: 80<br>b: 20 | a: 80<br>b: 20 | 20 |
| 5-C | b: 100 | a: 100 | b: 100 | a: 100 | b: 100 | a: 100 | a: 100 | b: 100 | 35 |
| 5-D | a: 100 | b: 100 | a: 100 | b: 100 | a: 100 | c: 100 | c: 100 | a: 100 | 40 |
| 5-E | b: 100 | a: 50 | b: 100 | a: 50 | b: 100 | a: 50 | a: 50 | a: 50 | 61 |

TABLE 6-continued

| Sample | 1st Layer (%) | 2nd Layer (%) | 3rd Layer (%) | 4th Layer (%) | 5th Layer (%) | 6th Layer (%) | 7th Layer (%) | Curling Preventing Layer (%) | Total of Acid-Processed Gelatin (%) |
|---|---|---|---|---|---|---|---|---|---|
| | | b: 50 | | b: 50 | | b: 50 | b: 50 | b: 50 | |

a: Alkali-processed gelatin having PI 5.0
b: Acid-processed gelatin having PI 7.0
c: Acid-processed gelatin having PI 9.0

Sample (5-A) was imagewise exposed and then processed in accordance with the following running procedure (A). The details of the procedure are mentioned below. The running procedure was continued until the replenisher was added to the color developer tank in an amount of up to two times of the color developer tank capacity (10 liters).

Processing Procedure (A):

| Processing Step | Time | Temperature (°C.) | Amount* of Replenishe (ml/m²) |
|---|---|---|---|
| Color Development | 2 min 15 sec | 36 | 320 |
| Bleach-Fixation | 40 sec | 36 | 320 |
| Stabilization (1) | 40 sec | 20–30 | — |
| Stabilization (2) | 40 sec | 20–30 | 320 |

*Amount per m² of the photographic material being processed.

The stabilizer was replenished by means of a countercurrent system from a stabilization tank (2) to a stabilization tank (1).

The compositions of the respective processing solutions used were s follows.

| | Tank Solution | Replenisher |
|---|---|---|
| Color Developer (A): | | |
| Diethylenetriaminepentaacetic Acid | 2.0 g | 2.0 g |
| Benzyl Alcohol | 12.8 g | 14.0 g |
| Diethylene Glycol | 3.4 g | 4.0 g |
| Sodium Sulfite | 3.0 g | 4.0 g |
| Sodium Bromide | 4.5 g | 3.0 g |
| Diethylhydroxylamine | 6.0 g | 8.0 g |
| Sodium Chloride | 3.20 g | — |
| 3-Methyl-4-amino-N—ethyl-N—(β-methanesulfonamidoethyl)aniline Sulfate | 4.25 g | 6.25 g |
| Potassium Carbonate | 30.0 g | 25.0 g |
| Brightening Agent (stilbene series) | 1.0 g | 1.5 g |
| 3-Methyl-4-amino-N—ethyl-N—hydroxyethyl)aniline Sulfate | 5.0 g | 7.0 g |
| Water to make | 1,000 ml | 1,000 ml |
| pH | 10.20 | 10.40 |
| (The pH value was adjusted with potassium hydroxide or hydrochloric acid.) | | |
| Bleach-Fixing Solution (A): | | |
| Ammonium Thiosulfate | 110 g | (The same composition as that of the tank soln.) |
| Sodium Hydrogensulfide | 10 g | |
| Ammonium (Diethylenetriaminepentaacetato) Iron(III).$H_2O$ | 56 g | |
| Disodium Ethylenediaminetetraacetate.$2H_2O$ | 5 g | |
| 2-Mercapto-5-aminothiadiazole | 5 g | |
| Water to make | 1,000 ml | |
| pH | 6.5 | |
| (The pH value was adjusted with aqueous ammonia or hydrochloric acid.) | | |
| Stabilizer Solution (A): | | |
| 1-Hydroxyethylidene-1,1'-diphosphonic Acid (60 wt %) | 1.6 g | (The same composition as that of the tank soln.) |
| Bismuth Chloride | 0.35 g | |
| Polyvinyl Pyrrolidone | 0.25 g | |
| Aqueous Ammonia | 2.5 ml | |
| Trisodium Nitrilotriacetate | 1.0 g | |
| 5-Chloro-2-methyl-4-isothiazoline-3-one | 50 mg | |
| 2-Octyl-4-isothiazolin-3-one | 50 mg | |
| Brightening Agent (4,4'-diaminostilbene series) | 1.0 g | |
| Water to make | 1,000 ml | |
| pH | 7.5 | |
| (The pH was adjusted with potassium hydroxide or hydrochloric acid.) | | |

Samples (5-A) to (5-E) were processed with the above-mentioned processing solutions used by the running procedure in the same manner as in Example 1, and the density of $D_{min}$ (exposed part) was measured with a Macbeth densitometer in each sample also in the same manner as in Example 1. The results obtained are shown in Table 7 below.

TABLE 8

| No. | Sample | $D_{min}$ B | G | R |
|---|---|---|---|---|
| 1 | 5-A (Comparison) | 0.23 | 0.32 | 0.25 |
| 2 | 5-B (Comparison) | 0.21 | 0.31 | 0.24 |
| 3 | 5-C (Invention) | 0.15 | 0.27 | 0.21 |
| 4 | 5-D (Invention) | 0.15 | 0.27 | 0.21 |
| 5 | 5-E (Invention) | 0.14 | 0.26 | 0.20 |

In the samples of the present invention, the value $D_{min}$ was small and the white background part had excellent sharpness.

EXAMPLE 6

A multilayer color photographic material was prepared by forming the layers as mentioned below on a polyethylene coated paper support.

B2 Layer: Protective Layer
B1 Layer: Curling Preventing Layer
Support
E1 Layer: Red-Sensitive Emulsion Layer
E2 Layer: Ultraviolet Absorbing Layer
E3 Layer: Green-Sensitive Emulsion Layer
E4 Layer: Ultraviolet Absorbing Layer
E5 Layer: Yellow Filter Layer
E6 Layer: Ultraviolet Absorbing Layer
E7 Layer: Blue-Sensitive Emulsion Layer
E8 Layer: Ultraviolet Absorbing Layer
E9 Layer: Protective Layer The coating compositions for the layers were prepared as follows:

Coating Composition for E1 Layer 40 cc of ethyl acetate and 7.7 cc of Solvent (Solv-2) were added to 13.4 g of a cyan coupler, Compound (A-60), 5.7 g of a color image stabilizer, Compounds (A-115)/(A-110)/(A-112)=5/8/9 (by weight), and 10.7 g of a polymer, Compound (A-114), and dissolved, and the resulting solution was dispersed by emulsification in 185 cc of an aqueous 10 wt% gelatin solution containing 8 cc of a 10 wt% sodium dodecylbenzenesulfonate. On the other hand, an emulsion was prepared by adding the red-sensitive sensitizing dye as mentioned below to an internal latent image type emulsion (containing 63 g/kg of silver) in an amount of $2.5\times10^{-4}$ mol per mol of silver. The above-mentioned emulsified dispersion and the red-sensitive emulsion were blended and dissolved to provide the coating composition for the first layer having the composition as mentioned below. Coating compositions for the E2 layer to E9 layer and the B1 layer and B2 layer were also prepared in the same manner as the preparation of the coating composition for the E1 layer. As the gelatin hardening agent for each layer, 1-hydroxy-3,5-dichloro-s-triazine sodium salt was used.

As the spectral sensitizing dyes for the respective layers, the following compounds were used.

For red-sensitive emulsion layer: Compound (A-127) ($2.5\times10^{-4}$ mol per mol of silver halide For green-sensitive emulsion layer: Compound (A-126) ($3.1\times10^{-4}$ mol per mol of silver halide For Blue-Sensitive Emulsion Layer: Compound (A-132) ($4.3\times10^{-4}$ mol per mol of silver halide)

As the anti-irradiation dye, the following compounds were used.

For Green-Sensitive Emulsion Layer: Compound (A-125)

For red-sensitive emulsion layer: Compound (A-124)

The compositions of the respective layers are mentioned below. The number which appears after each component means the amount coated (g/m$^2$) for that component. The amount coated of the silver halide emulsion coated and the amount coated of the colloidal silver each mean the amount coated of silver therein.

| | |
|---|---|
| Support: | |
| Polyethylene-coated paper containing a white pigment ($TiO_2$) and a bluish dye (ultramarine) in the polyethylene coat for the first layer. | |
| E1 Layer: | |
| Silver Halide Emulsion | 0.39 g |
| Gelatin | 1.35 g |
| Cyan Coupler, Compound (A-60) | 0.40 g |
| Color Image Stabilizer, Compounds (A-115)/(A-110)/(A-112) = 5/8/9 (by weight) | 0.17 g |
| Polymer, Compound (A-114) | 0.32 g |
| Solvent (Solv-2) | 0.23 g |
| Development Controlling Agent, Compound (A-133) | 32 mg |
| Stabilizer (ExA-1) | 5.8 mg |
| Nucleation Accelerator (ExZS-1) | 0.37 mg |
| Nucleating Agent (ExZK-1) | 9.9 μg |
| E2 Layer: | |
| Gelatin | 1.6 g |
| Ultraviolet Absorbent, Compounds (A-115)/(A-110)/(A-112) = 2/9/8 (by weight) | 0.62 g |
| Color Mixing Preventing Agent, Compound (A-106) | 0.06 g |
| Solvent (Solv-4) | 0.24 g |
| E3 Layer: | |
| Silver Halide Emulsion | 0.27 g |
| Gelatin | 1.79 g |
| Magenta Coupler, Compound (A-39) | 0.32 g |
| Color Image Stabilizer, Compound (A-107) | 0.20 g |

-continued

| | |
|---|---|
| Solvent, (Solv-3)/(Solv-2) = 2/1 (by volume) | 0.65 g |
| Development Controlling Agent, Compound (A-133) | 22 mg |
| Stabilizer (ExA-1) | 4 mg |
| Nucleation Accelerator (ExZS-1) | 0.26 mg |
| Nucleating Agent (ExZK-1) | 3.4 μg |
| E4 Layer: | |
| Gelatin | 0.53 g |
| Ultraviolet Absorbent, Compounds (A-115)/(A-110)/(A-112) = 2/9/8 (by weight) | 0.21 g |
| Color Mixing Preventing Agent, (A-113) Compound (A-113) | 0.02 g |
| Solvent (Solv-4) | 0.08 g |
| E5 Layer: | |
| Colloidal Silver | 0.10 g |
| Gelatin | 0.53 g |
| Ultraviolet Absorbent, Compounds (A-115)/(A-110)/(A-112) = 2/9/8 (by weight) | 0.21 g |
| Color Mixing Preventing Agent, Compound (A-113) | 0.02 g |
| Solvent (Solv-4) | 0.08 g |
| E6 Layer: | |
| Same as E4 layer | |
| E7 Layer: | |
| Silver Halide Emulsion | 0.26 g |
| Gelatin | 1.83 g |
| Yellow Coupler, Compound (A-19) | 0.83 g |
| Color Image Stabilizer, Compound (A-104) | 0.19 g |
| Solvent (Solv-1) | 0.35 g |
| Development Controlling Agent, Compound (A-133) | 32 mg |
| Stabilizer (ExA-1) | 2.9 mg |
| Nucleation Accelerator (ExZS-1) | 0.2 mg |
| Nucleating Agent (ExZK-1) | 2.5 μg |
| E8 Layer: | |
| Gelatin | 0.53 g |
| Ultraviolet Absorbent, Compounds (A-115)/(A-110)/(A-112) = 2/9/8 (by weight) | 0.21 g |
| Solvent (Solv-4) | 0.08 g |
| E9 Layer: | |
| Gelatin | 1.33 g |
| Acryl-Modified Copolymer of Polyvinyl Alcohol (modification degree: 17%) | 0.17 g |
| Liquid Paraffin | 0.03 g |
| Latex Grains of Polymethyl Methacrylate (mean grain size: 2.8 μm) | 0.05 g |
| B1 Layer: | |
| Gelatin | 8.7 g |
| B2 Layer: | |
| Same as E9 layer. | |

As the stabilizer, nucleation accelerator and nucleating agent there were used the following compounds.

Stabilizer (ExA-1):

4-Hydroxy-6-methyl-1,3,3a,7-tetraazaindene

Nucleation Accelerator:

(ExZS-1):

2-(3-Dimethylaminopropylthio)-5-mercapto-1,3,4-thiadiazole Hydrochloride

Nucleating Agent:

(ExZK-1):

6-Ethoxythiocarbonylamino-2-methyl-1-propargylquinolinium Trifluoromethanesulfonate As all the gelatin, an alkali-processed gelatin having an isoelectric point of 5 was used in every layer. The photographic material thus prepared was designated as Sample (6-A). Other Samples (6-B) and (6-C) were prepared in the same manner as Sample (6-A), except that in Sample (6-B) all the gelatin used was an acid-processed gelatin having an isoelectric point of 7.0, and in Sample (6-C) all the gelatin used was an acid-processed gelatin having an isoelectric point of 9.0.

Sample (6-A) was imagewise exposed and processed in accordance with the running procedure as described below.

| Processing Step | Temperature (°C.) | Time | Amount of Replenisher* (ml) | Tank Capacity (l) |
|---|---|---|---|---|
| Color Development | 38 | 1 min 40 sec | 300 | 10 |
| Bleach-Fixation | 33 | 60 sec | 300 | 5 |
| Rinsing (1) | 30–34 | 20 sec | — | 2 |
| Rinsing (2) | 30–34 | 20 sec | 300** | 2 |
| Drying | 70–80 | 50 sec | | |

*Amount per $m^2$ of the photographic material which is being processed.
**This amount corresponds to 10.4 times the amount taken over from the bleach-fixation. (The rinsing was carried out by a three-tank countercurrent system in which water flowed from a last rinsing tank (2) to a first rinsing tank (1) and the photographic material passed through the rinsing tanks in countercurrent by first entering rinsing tank (1) and then entering rinsing tank (2).)

The compositions of the respective processing solutions were as follows.

| | Tank Solution | Replenisher |
|---|---|---|
| **Color Developer:** | | |
| Water | 800 ml | 800 ml |
| Diethylenetriaminepentaacetic Acid | 1.0 g | 1.0 g |
| Nitrilotriacetic Acid | 2.0 g | 2.0 g |
| 1-Hydroxyethylidene-1,1-diphosphonic Acid | 2.0 g | 2.0 g |
| Triethylenediamine(1,4-diazabicyclo-[2,2,2]octane) | 5.0 g | 5.0 g |
| Potassium Bromide | 1.5 g | — |
| Potassium Carbonate | 30 g | 30 g |
| N—Ethyl-N—(β-methanesulfonamidoethyl)-3-methyl-4-aminoaniline Sulfate | 5.5 g | 7.5 g |
| N,N—Diethylhydroxylamine | 3.6 g | 5.5 g |
| Triethanolamine | 10.0 g | 10.0 g |
| Brightening Agent (WHITEX 4B, by Sumitomo Chemical Co.) | 1.5 g | 2.0 g |
| Water to make | 1,000 ml | 1,000 ml |
| pH (25° C.) | 10.20 | 10.60 |
| **Bleach-Fixing Solution:** | | |
| Water | 400 ml | 400 ml |
| Ammonium Thiosulfate (70 wt %) | 200 ml | 300 ml |
| Ammonium (Ethylenediaminetetraacetato) Iron(III) | 60 g | 120 g |
| Disodium Ethylenediaminetetraacetate | 5 g | 10 g |
| Water to make | 1,000 ml | 1,000 ml |
| pH (25° C.) | 6.70 | 6.30 |

Rinsing Solution

Tank solution and replenisher were the same, being an ion-exchanged water in which the calcium content and magnesium content each were 3 ppm or less.

Samples (6-A), (6-B) and (6-C) were processed with the above-mentioned processing solutions used by the running procedure in the same manner as in Exampl 5, and the value $D_{min}$ was measured also in the same manner as in Example 5. The results obtained are shown in Table 8 below.

TABLE 8

| No. | Sample | $D_{min}$ B | G | R |
|---|---|---|---|---|
| 1 | 6-A (Comparison) | 0.19 | 0.25 | 0.23 |
| 2 | 6-B (Invention) | 0.14 | 0.20 | 0.18 |
| 3 | 6-C (Invention) | 0.14 | 0.20 | 0.18 |

In the process of the present invention, the stain of the processed samples was small and the value $D_{min}$ thereof was low.

EXAMPLE 7

Sample (1-A) prepared in Example 1 was imagewise exposed and then processed in accordance with the running procedure described below. Next, in the same manner as in Example 1, Samples (1-A) through (1-I) were processed with the processing solutions used by the running procedure described below (running test), and the value $D_{min}$ in each sample was measured. As a result, the value $D_{min}$ was favorably extremely small in all the Samples (1-C), (1-D), (1-E), (1-F), (1-G) and (1-H) of the present invention.

| Processing Step | Temperature (°C.) | Time | Amount of Replenisher* (ml) | Tank Capacity (l) |
|---|---|---|---|---|
| Color Development | 38 | 1 min 40 sec | 290 | 17 |
| Bleach-Fixation | 35 | 60 sec | 180 | 9 |
| Rinsing (1) | 33–35 | 20 sec | — | 4 |
| Rinsing (2) | 33–35 | 20 sec | — | 4 |
| Rinsing (3) | 33–35 | 20 sec | 364 | 4 |
| Drying | 70–80 | 50 sec | | |

*Amount per $m^2$ of the photographic material which is being processed.

(The rinsing was carried out by a three-tank countercurrent system in which water flowed from a last rinsing tank (3) to rinsing tank (2) and then to a first rinsing tank (1) and the photographic material passed through the rinsing tanks in countercurrent by first entering tank (1) and then entering in succession tanks (2) and (3).)

The compositions of the respective processing solutions were as follows.

| | Tank Solution | Replenisher |
|---|---|---|
| **Color Developer:** | | |
| Water | 800 ml | 800 ml |
| Diethylenetriaminepentaacetic Acid | 1.0 g | 1.0 g |
| Nitrilotriacetic Acid | 2.0 g | 2.0 g |
| 1-Hydroxyethylidene-1,1-diphosphonic Acid | 2.0 g | 2.0 g |
| Benzyl Alcohol | 16 ml | 22 ml |
| Diethylene Glycol | 10 ml | 10 ml |
| Sodium Sulfite | 2.0 g | 2.5 g |
| Potassium Bromide | 0.5 g | — |
| Potassium Carbonate | 30 g | 30 g |
| N—Ethyl-N—(β-methanesulfonamidoethyl)-3-methyl-4-aminoaniline Sulfate | 5.5 g | 7.5 g |
| Hydroxylamine Sulfate | 2.0 g | 2.5 g |
| Brightening Agent (WHITEX X4, by Sumitomo Chemical Co.) | 1.5 g | 2.0 g |
| Water to make | 1,000 ml | 1,000 ml |
| pH (25° C.) | 10.20 | 10.60 |
| **Bleach-Fixing Solution:** | | |
| Water | 400 ml | 400 ml |
| Ammonium Thiosulfate (70%) | 80 ml | 95 ml |
| Ammonium Sulfite | 24 g | 32 g |
| Ammonium (Ethylenediaminepentaacetato) Iron(III) $H_2O$ | 30 g | 40 g |
| Disodium Ethylenediaminetetraacetate | 5 g | 10 g |
| Water to make | 1,000 ml | 1,000 ml |
| pH (at 25° C.) | 6.50 | 6.00 |

Rinsing Solution

Ion exchanged water (with Ca and Mg each being less than 3 ppm)

EXAMPLE 8

A multilayer color photographic paper (7-A) was prepared by forming the layers having the compositions shown below on a paper support both surfaces of which were coated with polyethylene. The coating compositions for the layers were prepared as mentioned above. As the gelatin, an alkali-processed gelatin having an isoelectric point of 5.0 was used in every layer.

Coating Composition for First Layer 27.2 cc of ethyl acetate and 7.7 cc of Solvent (Solv-1) were added to 19.1 g of Yellow Coupler, Compound (A-19), and 4.4 g of Color Image Stabilizer, Compound (A-104), and dissolved, and the resulting solution was dispersed by emulsification in 185 cc of an aqueous 10 wt% gelatin solution containing 8 cc of a 10 wt% sodium dodecylbenzenesulfonate solution. On the other hand, an emulsion was prepared, comprising the blue-sensitive sensitizing dye as mentioned below which was added to a silver chlorobromide emulsion (containing 80.0 mol% of silver bromide and 70 g/kg of silver) in an amount of $5.0\times10^{-4}$ mol per mol of silver. The emulsified dispersion prepared above was mixed with the blue-sensitive emulsion and dissolved, to provide the coating solution for the first layer having the composition as mentioned below. Coating compositions for the second layer to the seventh layer were also prepared in the same manner as in the first layer. As a gelatin hardening agent for each layer, 1-hydroxy-3,5-dichloro-s-triazine sodium salt was used. As a spectral sensitizing dye for the respective layers, the following compounds were used.

For blue-sensitive emulsion layer: Compound (A-99) ($5.0\times10^{-4}$ mol per mol of silver halide)

For green-sensitive emulsion layer: Compound (A-100) ($4.0\times10^{-4}$ mol per mol of silver halide) and Compound (A-101) ($7.0\times10^{-5}$ mol per mol of silver halide)

For red-sensitive emulsion layer: Compound (A-102) ($0.9\times10^{-4}$ mol per mol of silver halide) and Compound (A-103) ($2.6\times10^{-3}$ mol per mol of silver halide)

In addition, 1-(5-methylureidophenyl)-5-mercaptotetrazole was added, as a stabilizer, to the blue-sensitive emulsion layer, the green-sensitive emulsion layer and the red-sensitive emulsion layer in an amount of $4.0\times10^{-6}$ mol, $3.0\times10^{-5}$ mol and $1.0\times10^{-5}$ mol, respectively, per mol of silver halide.

Further, 4-hydroxy-6-methyl-1,3,3a,7-tetraazaindene was added, as a stabilizer, to the blue-sensitive emulsion layer and the green-sensitive emulsion layer in an amount of $1.2\times10^{-2}$ mol and $1.1\times10^{-2}$ mol, respectively, per mol of silver halide.

For anti-irradiation, Compounds (A-117) and (A-116) were added to the emulsion layers.

Layer Constitution

The compositions of the layers were as follows. The number which appears after each component means the amount coated (g/m$^2$) for the component. The amount of the silver halide emulsion means the amount coated of silver therein.

| | |
|---|---|
| Support: | |
| Polyethylene-coated paper containing a white pigment ($TiO_2$) and a bluish dye (ultramarine) in the polyethylene coat for the first layer. | |
| First Layer: Blue-Sensitive Emulsion Layer | |
| Silver Halide Emulsion (Br: 80%) | 0.26 |
| Gelatin | 1.83 |
| Yellow Coupler, Compound (A-19) | 0.83 |
| Color Image Stabilizer, Compound (A-104) | 0.19 |
| Solvent (Solv-1) | 0.35 |
| Second Layer: Color Mixing Preventing Layer | |
| Gelatin | 0.99 |
| Color Mixing Preventing Agent, Compound (A-106) | 0.08 |
| Third Layer: Green-Sensitive Emulsion Layer | |
| Silver Halide Emulsion (Br: 80%) | 0.16 |
| Gelatin | 1.79 |
| Magenta Coupler, Compound (A-39) | 0.32 |
| Color Image Stabilizer, Compound (A-107) | 0.20 |
| Color Image Stabilizer, Compound (A-108) | 0.02 |
| Color Image Stabilizer, Compound (A-109) | 0.03 |
| Solvent, (Solv-3)/(Solv-2) = 2/1 (by volume) | 0.65 |
| Fourth Layer: Ultraviolet Absorbing Layer | |
| Gelatin | 1.58 |
| Ultraviolet Absorbent, Compounds (A-115)/(A-111)/(A-112) = 2/9/8 (by weight) | 0.62 |
| Color Mixing Preventing Agent, Compound (A-113) | 0.05 |
| Solvent (Solv-4) | 0.24 |
| Fifth Layer: Red-Sensitive Emulsion Layer | |
| Silver Halide Emulsion (Br: 70%) | 0.23 |
| Gelatin | 1.34 |
| Cyan Coupler, Compound (A-69) | 0.34 |
| Color Image Stabilizer, Compounds (A-115)/(A-110)/(A-112) = 5/8/9 (by weight) | 0.17 |
| Polymer, Compound (A-114) | 0.40 |
| Solvent (Solv-2) | 0.23 |
| Sixth Layer: Ultraviolet Absorbing Layer | |
| Gelatin | 0.53 |
| Ultraviolet Absorbent, Compounds (A-115)/(A-111)/(A-112) = 2/9/8 (by weight) | 0.21 |
| Solvent (Solv-4) | 0.08 |
| Seventh Layer: Protective Layer | |
| Gelatin | 1.33 |
| Acryl-Modified Copolymer of Polyvinyl Alcohol (modification degree: 17%) | 0.17 |
| Liquid Paraffin | 0.03 |

Samples (7-B) to (7-I) were prepared in the same manner as in the preparation of Sample (7-A), except that the kind of the gelatin used was varied as shown in Table 9 below without changing the amount of the gelatin.

TABLE 9

| Sample | 1st Layer (%) | 2nd Layer (%) | 3rd Layer (%) | 4th Layer (%) | 5th Layer (%) | 6th Layer (%) | 7th Layer (%) | Proportion of Acid-Processed Gelatin to Total Gelatin (%) |
|---|---|---|---|---|---|---|---|---|
| 7-B | a: 90 b: 10 | a: 90 b: 10 | a: 90 b: 10 | a: 90 b: 10 | a: 90 b: 10 | a: 90 b: 10 | a: 90 b: 10 | 10 |
| 7-C | a: 70 b: 30 | a: 70 b: 30 | a: 70 b: 30 | a: 70 b: 30 | a: 70 b: 30 | a: 70 b: 30 | a: 70 b: 30 | 30 |
| 7-D | a: 70 | a: 70 | a: 70 | a: 70 | a: 70 | a: 70 | a: 70 | 30 |

TABLE 9-continued

| Sample | 1st Layer (%) | 2nd Layer (%) | 3rd Layer (%) | 4th Layer (%) | 5th Layer (%) | 6th Layer (%) | 7th Layer (%) | Proportion of Acid-Processed Gelatin to Total Gelatin (%) |
|---|---|---|---|---|---|---|---|---|
| | c: 30 | c: 30 | c: 30 | c: 30 | c: 30 | c: 30 | c: 30 | |
| 7-E | a: 50 | a: 50 | a: 50 | a: 50 | a: 50 | a: 50 | a: 50 | 50 |
| | b: 50 | b: 50 | b: 50 | b: 50 | b: 50 | b: 50 | b: 50 | |
| 7-F | b: 100 | b: 100 | b: 100 | b: 100 | b: 100 | b: 100 | b: 100 | 100 |
| 7-G | a: 100 | a: 40 | a: 100 | a: 40 | a: 100 | a: 40 | a: 40 | 28 |
| | | b: 60 | | b: 60 | | b: 60 | b: 60 | |
| 7-H | a: 40 | a: 100 | a: 40 | a: 100 | a: 40 | a: 100 | a: 100 | 32 |
| | b: 60 | | b: 60 | | b: 60 | | | |
| 7-I | a: 70 | a: 100 | a: 70 | a: 100 | a: 70 | a: 100 | a: 100 | 16 |
| | b: 30 | | b: 30 | | b: 30 | | | |

a: Alkali-processed gelatin having PI of 5.0
b: Acid-processed gelatin having PI of 7.0
c: Acid-processed gelatin having PI of 9.0

Samples (7-J), (7-K) and (7-L) were prepared in the same manner as the preparation of Samples (7-A), (7-C) and (7-F), respectively, except that the following couplers, Compounds (A-134), (A-135) and (A-136), were used in place of the couplers, Compounds (A-19), (A-39) and (A-69), respectively, in the first, third and fifth layers, each in the same molar amount.

In addition, Samples (7-M), (7-N) and (7-O) were prepared also in the same manner as the preparation of Samples (7-A), (7-C) and (7-F), respectively, except that the same molar amount of coupler, Compound (A-27), was used in place of coupler, Compound (A-39), to prepare Sample (7-M), the same molar amount of coupler, Compound (A-137), was used in place of coupler, Compound (A-39), in the third layer to prepare Sample (7-N) and that the same molar amount of Compounds (A-69)/(A-72) coupler mixture (1/1, by mol) was used in place of the coupler, Compound (A-69), in the fifth layer to prepare Sample (7-O).

Sample (7-A) was imagewise exposed and then continuously processed in accordance with the processing procedure as described below until the developer replenisher was added to the developer bath in an amount of 2 times of the developer bath capacity (running test). The amount of the processing solution which is brought into the respective (rinsing (1)) bath from the previous bath (bleach-fixation) together with the photographic material which is being processed was 35 ml per $m^2$ of the photographic material.

| Processing Step | Temperature (°C.) | Time | Amount of Replenisher per $m^2$ of Photographic Material Processed (ml) | Tank Capacity (l) |
|---|---|---|---|---|
| Color Developer | 38 | 1 min 40 sec | 290 | 17 |
| Bleach-Fixation | 30–34 | 1 min 00 sec | 150 | 9 |
| Rinsing (1) | 30–34 | 20 sec | — | 4 |
| Rinsing (2) | 30–34 | 20 sec | — | 4 |
| Rinsing (3) | 30–34 | 20 sec | See below | 4 |
| Drying | 70–80 | 50 sec | | |

(The rinsing step was carried out by a three-tank counteercurrent system in which water flowed from a last rinsing tank (3) to rinsing tank (2) and then to a first rinsing tank (1) and the photographic material passed through the rinsing tanks in countercurrent first entering tank (1) and then entering in succession tanks (2) and (3).)

The amount of the replenisher added to the rinsing tank (3) was carried out in accordance with the following three conditions.

(1) 10 ml (0.29 time of the processing solution which is brought into rinsing tank (1) from the previous (bleach-fxation) bath)
(2) 260 ml (7.4 times of the processing solution which is brought into rinsing tank (1) from the previous (bleach-fixation) bath)
(3) 2,100 ml (60 times of the processing solution which is brought into rinsing tank (1) from the previous (bleach-fixation) bath)

The compositions of the respective processing solutions were the same as those of the solutions used in the process of Example 1, except that the pH value of the bleach-fixing solution was 7.0 (in place of 6.7 in Example 1) and that an ion-exchaged water (in which the calcium content and the magnesium content were each 3 ppm or less) was used as the rinsing solution.

Next, Samples (7-A) to (7-O) were imagewise exposed and then processed with the processing solutions used in the above-mentioned running procedure. In the case of Samples (7-J) to (7-O), the replenishment to the rinsing tank (3) was carried out only under the above-mentioned condition (2). After being thus processed, the samples were stored for 10 days under the condition of 80° C. and 70% RH, and the yellow, magenta and cyan stain densities in the white background part ($D_{min}$) were measured with a Macbeth densitometer. In addition, the samples were exposed to a xenon light (85,000 lux, distance of 50 cm) for 12 hours and then the discoloration percentage ($D_G$=2.0) of the magenta density was also measured with a Macbeth densitometer in every sample. The results obtained are shown in Table 10 below. For the discoloration test, Samples (7-A) to (7-I) were tested. The stain density shown in Table 10 represents the increment from the stain density of the fresh sample (immediately after processed).

TABLE 10

| No. | Sample | Replenisher to Rinsing Tank (3) | Yellow | Magenta | Cyan | Discoloration of Magenta Color (%) | Note |
|---|---|---|---|---|---|---|---|
| 1 | 7-A | 0.29 time | 0.25 | 0.43 | 0.17 | 25 | Comparison |
| 2 | 7-B | 0.29 times | 0.24 | 0.42 | 0.17 | 23 | Comparison |
| 3 | 7-C | 0.29 times | 0.24 | 0.42 | 0.16 | 20 | Comparison |
| 4 | 7-D | 0.29 times | 0.24 | 0.40 | 0.17 | 20 | Comparison |
| 5 | 7-E | 0.29 times | 0.23 | 0.40 | 0.15 | 20 | Comparison |
| 6 | 7-F | 0.29 times | 0.24 | 0.40 | 0.14 | 21 | Comparison |
| 7 | 7-G | 0.29 times | 0.25 | 0.41 | 0.15 | 21 | Comparison |
| 8 | 7-H | 0.29 times | 0.25 | 0.41 | 0.16 | 22 | Comparison |
| 9 | 7-I | 0.29 times | 0.25 | 0.42 | 0.16 | 22 | Comparison |
| 10 | 7-A | 7.4 times | 0.15 | 0.27 | 0.09 | 24 | Comparison |
| 11 | 7-B | 7.4 times | 0.15 | 0.28 | 0.09 | 23 | Comparison |
| 12 | 7-C | 7.4 times | 0.09 | 0.12 | 0.06 | 21 | Invention |
| 13 | 7-D | 7.4 times | 0.07 | 0.10 | 0.04 | 20 | Invention |
| 14 | 7-E | 7.4 times | 0.07 | 0.09 | 0.03 | 20 | Invention |
| 15 | 7-F | 7.4 times | 0.06 | 0.08 | 0.03 | 18 | Invention |
| 16 | 7-G | 7.4 times | 0.08 | 0.12 | 0.04 | 18 | Invention |
| 17 | 7-H | 7.4 times | 0.09 | 0.11 | 0.05 | 20 | Invention |
| 18 | 7-I | 7.4 times | 0.17 | 0.24 | 0.08 | 20 | Comparison |
| 19 | 7-A | 60 times | 0.09 | 0.13 | 0.04 | 30 | Comparison |
| 20 | 7-B | 60 times | 0.08 | 0.12 | 0.04 | 31 | Comparison |
| 21 | 7-C | 60 times | 0.08 | 0.10 | 0.04 | 30 | Comparison |
| 22 | 7-D | 60 times | 0.07 | 0.08 | 0.03 | 30 | Comparison |
| 23 | 7-E | 60 times | 0.06 | 0.07 | 0.03 | 28 | Comparison |
| 24 | 7-F | 60 times | 0.05 | 0.07 | 0.02 | 27 | Comparison |
| 25 | 7-G | 60 times | 0.06 | 0.08 | 0.02 | 29 | Comparison |
| 26 | 7-H | 60 times | 0.06 | 0.08 | 0.03 | 27 | Comparison |
| 27 | 7-I | 60 times | 0.08 | 0.11 | 0.04 | 30 | Comparison |
| 28 | 7-J | 7.4 times | 0.25 | 0.29 | 0.08 | — | Comparison |
| 29 | 7-K | 7.4 times | 0.20 | 0.21 | 0.06 | — | Invention |
| 30 | 7-L | 7.4 times | 0.18 | 0.16 | 0.05 | — | Invention |
| 31 | 7-M | 7.4 times | 0.16 | 0.25 | 0.09 | — | Comparison |
| 32 | 7-N | 7.4 times | 0.09 | 0.11 | 0.05 | — | Invention |
| 33 | 7-O | 7.4 times | 0.06 | 0.07 | 0.03 | — | Invention |

The results of Table 10 demonstrate as follows: When the amount of the replenisher in the final rinsing step was less than the range as defined in the present invention, the increase of the stain densities of yellow, magenta and cyan was noticeable irrespective of the kind of the gelatin used (Sample Nos. 1 to 9); but when the amount of replenisher is more than the defined range, the magenta color discoloration was somewhat noticeable (Sample Nos. 19 to 27). When the amount of the replenisher fell within the range of the present invention and the content of the acid-processed gelatin also fell within the range as defined in the present invention, the increase of the stain densities was small and the magenta color discoloration was little (Sample Nos. 12 to 17). In particular, the content of the acid-processed gelatin was especially preferably 50% by weight or more (Sample Nos. 14 and 15) and the acid-processed gelatin having an isoelectric point of 8 or more was particularly preferred (Sample No. 13).

When Sample Nos. 10, 12, 15, 31, 32 and 33 (where preferred couplers were used) are compared with Sample Nos. 28, 29 and 30, it is noted that the effect of reducing the stain in the photographic materials by incorporating an acid-processed gelatin thereinto is especially remarkable in the materials containing the preferred couplers.

EXAMPLE 9

Sample (7-A) of Example 8 was imagewise exposed and then continuously processed with Fuji Color Paper Processor (PP 600) in accordance with the processing procedure of Example 6 until the color developer replenisher was added to the color developer tank in an amount of two times of the tank capacity (running test). The color developer tank solution and color developer replenisher were the same as in Example 6. The amount of the processing solution which is brought into the respective (rinsing (1)) bath from the previous (bleach-fixation) bath together with the photographic material which is being processed was 35 ml per $m^2$ of the photographic material. As the bleach-fixing solution, the following solution was used.

| Bleach-Fixing Solution: | Tank Solution | Replenisher |
|---|---|---|
| Water | 400 ml | 400 ml |
| Ammonium Thiosulfate (70 wt %) | 80 ml | 95 ml |
| Ammonium Sulfite | 24 g | 32 g |
| Ammonium (Ethylenediaminetetra-acetato) Iron(III) | 30 g | 40 g |
| Disodium Salt Ethylenediamine-tetraacetate | 5 g | 10 g |
| Water to make | 1,000 ml | 1,000 ml |
| pH (25° C.) | 6.50 | 6.00 |

Next, Samples (7-A) to (7-I) of Example 8 were imagewise exposed and then processed with the processing solutions used by the above-mentioned running procedure. After being thus processed, the increase of the stain of each sample after being stored was investigated in the same manner as the test method of Example 8. The results obtained indicate that the samples of the present invention were superior to the comparative samples.

EXAMPLE 10

A multilayer color photographic paper (8-A) was prepared by forming the layers having the compositions shown below on a paper support both surfaces of which were coated with polyethylene. The coating compositions for the layers were prepared as mentioned below. As the gelatin, an alkali-processed gelatin having an isoelectric point of 5.0 was used in every layer.

Coating Composition for First Layer 27.2 cc of ethyl acetate and 7.7 cc of solvelnt (Solv-1) were added to 19.1 g of yellow coupler, Compound (A-19), and 4.4 g of color image stabilizer, Compound (A-104), and dissolved, and the resulting solution was dispersed by emulsification in 180 cc of an aqueous 10 wt% gelatin solution containing 8 cc of a 10 wt% sodium dodecylbenzenesulfonate solution. On the other hand, an emulsion was prepared, containing a blue-sensitive sensitizing dye shown below which was added to a silver chlorobromide emulsion (containing 1.0 mol% of silver bromide and 70 g/kg of silver) in an amount of $5.0\times10^{-4}$ mol. The emulsified dispersion as prepared above was mixed with the aforesaid blue-sensitive silver halide emulsion to provide the coating solution for the first layer having the composition mentioned below. Coating compositions for the second layer to the seventh layer were also prepared in the same manner as the preparation of the composition for the first layer. As a gelatin hardening agent for each layer, 1-hydroxy-3,5-dichloro-s-triazine sodium salt was used.

As the spectral sensitizing dyes for the respective layers, the following substances were used.

For blue-sensitive emulsion layer: Compound (A-138) ($5.0\times10^{-4}$ mol per mol of silver halide)

For green-sensitive emulsion layer: Compound (A-122) ($4.0\times10^{-4}$ mol per mol of silver halide) and Compound (A-101) ($7.0\times10^{-5}$ mol per mol of silver halide)

For red-sensitive emulsion layer: Compound (A-102) ($0.9\times10^{-4}$ mol per mol of silver halide) and Compound (A-103) ($2.6\times10^{-3}$ mol per mol of silver halide)

In addition, 1-(5-methylureidophenyl)-5-mercaptotetrazole was added as a stabilizer, to the blue-sensitive emulsion layer, the green-sensitive emulsion layer and the red-sensitive emulsion layer, in an amount of $8.5\times10^{-5}$ mol, $7.7\times10^{-4}$ mol and $2.5\times10^{-4}$ mol, respectively, per mol of silver halide.

For anti-irradiation, Compound (A-125) and Compound (A-124) were added to the emulsion layers.

Layer Constitution

The compositions of the layers were as follow. The number which appears after each component means the amount coated (g/m$^2$) for the component. The amount coated of the silver halide emulsion means the amount coated of silver therein.

| | |
|---|---|
| Support: | |
| Polyethylene-coated paper, containing a white pigment ($TiO_2$) and a bluish dye ultramarine) in the polyethylene coat for the first layer. | |
| First Layer: | |
| Silver Halide Emulsion (Br: 1 mol %) | 0.30 |
| Gelatin | 1.86 |
| Yellow Coupler, Compound (A-19) | 0.82 |
| Color Image Stabilizer, Compound (A-104) | 0.19 |
| Solvent (Solv-1) | 0.35 |
| Second Layer: Color Mixing Preventing Layer | |
| Gelatin | 0.99 |
| Color Mixing Preventing Agent, Compound (A-106) | 0.08 |
| Third Layer: Green-Sensitive Emulsion Layer | |
| Silver Halide Emulsion (Br: 1 mol %) | 0.36 |
| Gelatin | 1.24 |
| Magenta Coupler, Compound (A-139) | 0.31 |
| Color Image Stabilizer, Compound A-107 | 0.25 |
| Color Image Stabilizer, Compound A-123) | 0.12 |
| Solvent, (Solv-1)/(Solv-2) = 1/1 (by volume) | 0.42 |
| Fourth Layer: Ultraviolet Absorbing Layer | |
| Gelatin | 1.58 |
| Ultraviolet Absorbent, Compound (A-115) | 0.62 |
| Color Mixing Preventing Agent, Compound (A-113) | 0.05 |
| Solvent (Solv-4) | 0.24 |
| Fifth Layer: Red-Sensitive Emulsion Layer | |
| Silver Halide Emulsion (Br: 1 mol %) | 0.23 |
| Gelatin | 1.34 |
| Cyan Coupler, Compound (A-59) | 0.34 |
| Color Iage Stabilizer, Compound (A-115) | 0.17 |
| Polymer, Compound (A-114) | 0.40 |
| Solvent (Solv-2) | 0.23 |
| Sixth Layer: Ultraviolet Absorbing layer | |
| Gelatin | 0.53 |
| Ultraviolet Absorbent, Compound (A-115) | 0.21 |
| Solvent (Solv-4) | 0.08 |
| Seventh Layer: Protective Layer | |
| Gelatin | 1.33 |
| Acryl-Modified Copolymer of Polyvinyl Alcohol (modification degree: 17%) | 0.17 |
| Liquid Paraffin | 0.03 |

Samples (8-B) to (8-E) were prepaed in the same manner as in the preparation of Sample (8-A), except that the kind of the gelatin used was varied as shown in Table 11 below without changing the amount of the gelatin coated.

TABLE 11

| Sample | 1st Layer | 2nd Layer | 3rd Layer | 4th Layer | 5th Layer | 6th Layer | 7th Layer | Proportion of Acid-Processed Gelatin to Total Gelatin (%) |
|---|---|---|---|---|---|---|---|---|
| 8-B | a: 90 | a: 90 | a: 90 | a: 90 | a: 90 | a: 90 | a: 90 | 10 |
| | b: 10 | b: 10 | b: 10 | b: 10 | b: 10 | b: 10 | b: 10 | |
| 8-C | a: 70 | a: 70 | a: 70 | a: 70 | a: 70 | a: 70 | a: 70 | 30 |
| | b: 30 | b: 30 | b: 30 | b: 30 | b: 30 | b: 30 | b: 30 | |
| 8-D | a: 50 | a: 50 | a: 50 | a: 50 | a: 50 | a: 50 | a: 50 | 50 |
| | b: 50 | b: 50 | b: 50 | b: 50 | b: 50 | b: 50 | b: 50 | |
| 8-E | b: 100 | b: 100 | b: 100 | b: 100 | b: 100 | b: 100 | b: 100 | 100 |

a: Alkali-processed gelatin having PI of 5.0
b: Acid-processed gelatin having PI of 7.0

Sample (8-A) was imagewise exposed and then continuously processed with a paper processor in accordance with the processing procedure described below until the color developer replenisher was used in an amount of 2 times of the color developer tank capacity (running test). The amount of the process solution which is brought into the respective (rinsing (1)) bath from the previous (bleach-fixation) bath together with the photographic material which is being processed was 35 ml per $m^2$ of the photographic material.

| Processing Step | Temperature (°C.) | Time | Amount of Replenisher* (ml) | Tank Capacity (l) |
|---|---|---|---|---|
| Color Development | 35 | 45 | 161 | 17 |
| Bleach-Fixation | 30–36 | 45 | 161 | 17 |
| Rinsing (1) | 30–37 | 20 | — | 10 |
| Rinsing (2) | 30–37 | 20 | — | 10 |
| Rinsing (3) | 30–37 | 20 | — | 10 |
| Rinsing (4) | 30–37 | 30 | See below | 10 |
| Drying | 70–80 | 60 | | |

*Amount per $m^2$ of photographic material which is being processed.

(The rinsing step was carried out by a four-tank countercurrent system in which water flowed from a last rinsing tank (4) and then in succession to rinsing tanks (3) and (2) and finally to a first rinsing tank (1), and the photographic material passed through the rinsing tanks in countercurrent by first entering tank (1) and then entering in succession tanks (2), (3) and (4).)

The amount of the replenisher added to the rinsing tank (4) was carried out in accordance with the following three conditions.

(1) 10 ml (0.29 time of the processing solution which is brought into rinsing tank (1) from the previous (bleach-fixation) bath)
(2) 248 ml (7.1 times of the processing solution which is brought into rinsing tank (1) from the previous (bleach-fixation) bath)
(3) 2,100 ml (60 times of the processing solution which is brought into rinsing tank (1) from the previous (bleach-fixation) bath)

The compositions of the respective processing solutions were as follows.

| Color Developer: | Tank Solution | Replenisher |
|---|---|---|
| Water | 800 ml | 800 ml |
| Ethylenediamine-N,N,N,N—tetramethylenephosphonic Acid | 1.5 g | 1.5 g |
| Triethylenediamine(1,4-diazabicyclo-2,2,2 octane) | 5.0 g | 5.0 g |
| Sodium Chloride | 1.4 g | — |
| Potassium Carbonate | 25 g | 25 g |
| N—Ethyl-N—(βmethanesulfonamidoethyl)-3-methyl-4-aminoaniline Sulfate | 5.0 g | 7.0 g |
| Diethylhydroxylamine | 4.2 g | 6.0 g |
| Brightening Agent (4,4'-diaminostilbene series) | 2.0 g | 2.5 g |
| Water to make | 1,000 ml | 1,000 ml |
| pH (25° C.) | 10.05 | 10.45 |
| Bleach-Fixing Solution: | | |
| (Tank solution and replenisher were the same.) | | |
| Water | 400 ml | |
| Ammonium Thiosulfate (70 wt %) | 100 ml | |
| Sodium Sulfite | 17 g | |
| Ammonium (Ethylenediaminetetraacetato) Iron(III) | 55 g | |
| Disodium Ethylenediaminetetraacetate | 5 g | |
| Ammonium Bromide | 40 g | |
| Glacial Acetic Acid | 9 g | |
| Water to make | 1,000 ml | |
| pH (25° C.) | 5.40 | |
| Rinsing Solution: | | |
| (Tank solution and replenisher were the same.) | | |

This was an ion-exchanged water in which the calcium content and the magnesium content each were 3 ppm or less.

Next, Samples (8-A) to (8-E) were imagewise exposed and then processed with the processing solutions used in the above-mentioned running procedure. After being thus processed, the samples were stored for 10 days under the condition of 80° C. and 70% RH, and the yellow, magenta and cyan stain densities in the white background part ($D_{min}$) were measured with a Macbeth densitometer. In addition, the samples were exposed to a xenon light (85,000 lux, distance of 50 cm) for 12 hours and then the discoloration percentage ($D_G=2.0$) of the magenta density was also measured with a Macbeth densitometer in every sample. The results obtained are shown in Table 12 below. The stain density shown in Table 12 represents the increment from the stain density of the fresh sample (immediately after being processed).

TABLE 12

| No. | Sample | Replenisher to Rinsing Tank (3) | Stain Density Yellow | Magenta | Cyan | Discoloration of Magenta Color (%) | Note |
|---|---|---|---|---|---|---|---|
| 1 | 8-A | 0.29 times | 0.40 | 0.38 | 0.15 | 29 | Comparison |
| 2 | 8-B | " | 0.38 | 0.37 | 0.16 | 28 | " |
| 3 | 8-C | " | 0.37 | 0.36 | 0.16 | 28 | " |
| 4 | 8-D | " | 0.37 | 0.37 | 0.15 | 27 | " |
| 5 | 8-E | " | 0.37 | 0.35 | 0.15 | 26 | " |
| 6 | 8-A | 7.1 times | 0.29 | 0.22 | 0.08 | 27 | " |
| 7 | 8-B | " | 0.27 | 0.20 | 0.08 | 26 | " |
| 8 | 8-C | " | 0.14 | 0.12 | 0.04 | 26 | Invention |
| 9 | 8-D | " | 0.12 | 0.10 | 0.03 | 24 | " |
| 10 | 8-E | " | 0.11 | 0.09 | 0.03 | 25 | " |
| 11 | 8-A | 60 times | 0.13 | 0.11 | 0.04 | 35 | Comparison |
| 12 | 8-B | " | 0.12 | 0.10 | 0.04 | 35 | " |
| 13 | 8-C | " | 0.11 | 0.08 | 0.03 | 33 | " |
| 14 | 8-D | " | 0.12 | 0.08 | 0.02 | 34 | " |
| 15 | 8-E | " | 0.10 | 0.08 | 0.02 | 36 | " |

The results of Table 12 demonstrate as follows. When the amount of the replenisher to the final rinsing bath and the content of the acid-processed gelatin in the photographic material to be processed each fell within the scope as defined in the present invention, the image storability was most excellent (Sample Nos. 8 to 10). In particular, the photographic materials in which the content of the acid-processed gelatin was 50% by weight or more were especially preferable (Sample Nos. 9 and 10).

EXAMPLE 11

A photographic material (Sample 9-A) was prepared by forming the first layer (lowermost layer) to the seventh layer (uppermost layer) on a polyethylene-coated paper which had been processed by corona discharge treatment, as described below. As the gelatin, an alkali-processed gelatin having an isoelectric point of 5.0 was used in every layer.

The coating composition for the first layer was prepared as follows. A mixture comprising 200 g of a yellow coupler, 93.3 g of an antifading agent (*2e), 10 g of a high boiling point organic solvent (*2c), 5 g of a high boiling point organic solvent (*2d) and additionally 600 ml of ethyl acetate as an auxiliary solvent was heated and dissolved at 60° C., and then the resulting solution was blended with 3,300 ml of an aqueous 5 wt% gelatin solution containing 330 ml of an aqueous 5 wt% Alkanol B (alkylnaphthalene sulfonate, by Du Pont) solution and emulsified and a colloid mill to provide a coupler dispersion. The ethyl acetate was evaporated out from the dispersion under reduced pressure, and 1,400 g of an emulsion (containing 96.7 g of silver and 170 g of gelatin) to which a sensitizing dye for blue-sensitive emulsion layer and 1-methyl-2-mercapto-5-acetylamino-1,3,4-triazole had been added to the dispersion, and additionally 2,600 g of an aqueous 10 wt% gelatin solution was added thereto to provide a coating composition for the first layer.

Coating composition for the second layer to the seventh layer were prepared in the same manner as in the preparation of the coating composition for the first layer.

Layer Constitution

The compositions of the layers were as follows.

| | |
|---|---|
| Support: | |
| Polyethylene-Coated Paper Support | |
| First Layer: Blue-Sensitive Emulsion Layer | |
| Silver Chlorobromide Emulsion (silver bromide: 1 mol %) | 290 mg/m$^2$ |
| Yellow Coupler, Compound (A-26) | 600 mg/m$^2$ |
| Antifading Agent (*2e) | 280 mg/m$^2$ |
| Solvent (*2c) | 30 mg/m$^2$ |
| Solvent (*2d) | 15 mg/m$^2$ |
| Gelatin | 1,800 mg/m$^2$ |
| Second Layer: Color Mixing Preventing Layer | |
| Silver Bromide Emulsion (primitive, grain size: 0.05 μm) | 10 mg/m$^2$ as Ag |
| Color Mixing Preventing Agent (*2f) | 55 mg/m$^2$ |
| Solvent (*2c) | 30 mg/m$^2$ |
| Solvent (*2d) | 15 mg/m$^2$ |
| Gelatin | 800 mg/m$^2$ |
| Third Layer: Green-Sensitive Emulsion Layer | |
| Silver Chlorobromide Emulsion (silver bromide: 1 mol %) | 305 mg/m$^2$ |
| Magenta Coupler, Compound (A-140) | 670 mg/m$^2$ |
| Antifading Agent (*2b) | 150 mg/m$^2$ |
| Antifading Agent (*2h) | 10 mg/m$^2$ |
| Solvent (*2c) | 200 mg/m$^2$ |
| Solvent (*2d) | 10 mg/m$^2$ |
| Gelatin | 1,400 mg/m$^2$ |
| Fourth Layer: Color Mixing Preventing Layer | |
| Color Mixing Preventing Agent (*2f) | 65 mg/m$^2$ |
| Ultraviolet Absorbent (*2a) | 450 mg/m$^2$ |
| Ultraviolet Absorbent (*2b) | 230 mg/m$^2$ |
| Solvent (*2c) | 50 mg/m$^2$ |

-continued

| | |
|---|---|
| Solvent (*2d) | 50 mg/m$^2$ |
| Gelatin | 1,700 mg/m$^2$ |
| Fifth Layer: Red-Sensitive Emulsion Layer | |
| Silver Bromochloride Emulsion (silver bromide: 1 mol %) | 210 mg/m$^2$ |
| Cyan Coupler, Compound (A-76) | 260 mg/m$^2$ |
| Cyan Coupler, Compound (A-59) | 120 mg/m$^2$ |
| Antifading Agent (*2e) | 250 mg/m$^2$ |
| Solvent (*2c) | 160 mg/m$^2$ |
| Solvent (*2d) | 100 mg/m$^2$ |
| Gelatin | 1,800 mg/m$^2$ |
| Sixth Layer: Ultraviolet Absorbing Layer | |
| Ultraviolet Absorbent (*2a) | 260 mg/m$^2$ |
| Ultraviolet Absorbent (*2b) | 70 mg/m$^2$ |
| Solvent (*2c) | 300 mg/m$^2$ |
| Solvent (*2d) | 100 mg/m$^2$ |
| Gelatin | 700 mg/m$^2$ |
| Seventh Layer: Protective Layer | |
| Gelatin | 600 mg/m$^2$ |

The compounds used in the above-mentioned layers were as follows.

(*2a): 2-(2-Hydroxy-3,5-di-tert-amylphenyl)benzotriazole
(*2b): 2-(2-Hydroxy-3,5-di-tert-butylphenyl)benzotriazole
(*2c): Di(2-ethylhexyl) Phthalate
(*2d): Dibutyl Phthalate
(*2e): 2,5-Di-tert-amylphenyl-3,5-di-tert-butylhydroxybenzoate
(*2f): 2,5-Di-tert-octylhydroquinone
(*2g): 1,4-Di-tert-amyl-2,5-dioctyloxybenzene
(*2h): 2,2'-Methylenebis(4-methyl-6-tert-butylphenol)

As the sensitizing dyes for the respective emulsion layers, the following substances were used.

Blue-Sensitive Emulsion Layer: Anhydro-5-methoxy-5'-methyl-3,3'-disulfopropylselenacyanine hydroxide Green-Sensitive Emulsion Layer: Anhydro-9-ethyl-5,5'-diphenyl-3,3'-disulfoethyloxacarbocyanine hydroxide Red-Sensitive Emulsion Layer: 3,3'-Diethyl-5-methoxy-9,9'-(2,2-dimethyl-1,3-propano)thiadicarbocyanine iodide As the stabilizer for each emulsion layer, 1-methyl-2-mercapto-5-acetylamino-1,3,4-triazole was used.

As the anti-irradiation dyes, the following compounds were used.

4-[3-Carboxy-5-hydroxy-4-{3-[3-carboxy-5-oxo-1-(4-sulfonatophenyl)-2-pyrazoline-4-ylidene]-1-propenyl}-1-pyrazolyl]benzenesulfonate dipotassium salt; and N,N'-(4,8-Dihydroxy-9,10-dioxo-3,7-disulfonatoanthracene-1,5-diyl)bis(aminomethanesulfonate) tetrasodium salt.

In addition, 1,2-bis(vinylsulfonyl)ethane was used as a hardening agent.

Samples (9-B) to (9-E) were prepared in the same manner as the preparation of Sample (9-A), except that the kind of the gelatin in the first to seventh layers were varied as shown in Table 13 below without changing the amount of the gelatin coated.

TABLE 13

| Sample | 1st Layer (%) | 2nd Layer (%) | 3rd Layer (%) | 4th Layer (%) | 5th Layer (%) | 6th Layer (%) | 7th Layer (%) | Proportion of Acid-Processed Gelatin to Total Gelatin (%) |
|---|---|---|---|---|---|---|---|---|
| 9-B | a: 90<br>b: 10 | a: 90<br>b: 10 | a: 90<br>b: 10 | a: 90<br>b: 10 | a: 90<br>b: 10 | a: 90<br>b: 10 | a: 90<br>b: 10 | 10 |
| 9-C | a: 70<br>b: 30 | a: 70<br>b: 30 | a: 70<br>b: 30 | a: 70<br>b: 30 | a: 70<br>b: 30 | a: 70<br>b: 30 | a: 70<br>b: 30 | 30 |
| 9-D | a: 50<br>b: 50 | a: 50<br>b: 50 | a: 50<br>b: 50 | a: 50<br>b: 50 | a: 50<br>b: 50 | a: 50<br>b: 50 | a: 50<br>b: 50 | 50 |
| 9-E | b: 100 | b: 100 | b: 100 | b: 100 | b: 100 | b: 100 | b: 100 | 100 |

a: Alkali-processed gelatin having PI of 5.0
b: Acid-processed gelatin having PI of 7.0

Samples (9-A) was imagewise exposed and then continuously processed in the same manner as in Example 10 (except the rinsing step was replaced by the corresponding stabilization step) until the color developer replenisher was used in an amount of 2 times the color developer tank capacity. The amount of the processing solution as brought into the respective (stabilization) bath from the previous (bleach-fixation) bath together with the photographic material which is being processed was 35 ml per $m^2$ of the photographic material.

The compositions of the respective processing solutions were as follows.

| | Tank Solution | Replenisher |
|---|---|---|
| Color Developer: | | |
| Water | 800 ml | 800 ml |
| Ethylenediaminetetraacetic Acid | 2.0 g | 2.0 g |
| 5,6-Dihydroxybenzene-1,2,4-trisulfonic Acid | 0.3 g | 0.3 g |
| Triethanolamine | 8.0 g | 8.0 g |
| Sodium Chloride | 1.4 g | — |
| Potassium Carbonate | 25 g | 25 g |
| N—Ethyl-N—(β-methanesulfonamidoethyl)-3-methyl-4-aminoaniline Sulfate | 5.0 g | 7.0 g |
| Diethylhydroxylamine | 4.2 g | 6.0 g |
| Brightening Agent (4,4'-diamino-stilbene series) | 2.0 g | 2.5 g |
| Water to make | 1,000 ml | 1,000 ml |
| pH (25° C.) | 10.05 | 10.45 |
| (Tank solution and replenisher were the same.) | | |
| Bleach-Fixing Solution: | | |
| Water | 400 ml | |
| Ammonium Thiosulfate (70 wt %) | 100 ml | |
| Sodium Sulfite | 17 g | |
| Ammonium (Ethylenediaminetetraacetato) Iron(III) | 55 g | |
| Disodium Ethylenediaminetetraacetate | 5 g | |
| Glacial Acetic Acid | 9 g | |
| Water to make | 1,000 ml | |
| pH (25° C.) | 5.40 | |
| Stabilization Solution: | | |
| 1-Hydroxyethylidene-1,1-diphosphonic Acid (60 wt %) | 1.6 ml | |
| Bismuth Chloride | 0.3 g | |
| Polyvinyl Pyrrolidone | 0.3 g | |
| Aqueous Ammonia (26 wt %) | 2.5 m | |
| Nitrilotriacetic Acid | 1.0 g | |
| 5-Chloro-2-methyl-4-isothiazolin-3-one | 0.05 g | |
| 2-Octyl-4-isothiazolin-3-one | 0.05 g | |
| Brightening Agent (4,4'-diamino-stilbene series) | 1.0 g | |
| Water to make | 1,000 ml | |
| pH (25° C.) | 7.5 | |

Next, Samples (9-A) to (9-E) were imagewise exposed and then processed with the processing solutions used in the above-mentioned running procedure. After being thus processed, the samples were stored for 10 days under the condition of 80° C. and 70% RH, and the yellow, magenta and cyan stain densities in the white background part ($D_{min}$) were measured with a Macbeth densitometer. In addition, the samples were exposed to a xenon light (85,000 lux, distance of 50 cm) for 12 days and then the discoloration percentage ($D_G$=2.0) of the magenta density was also measured with a Macbeth densitometer in every sample. Thus, the image stability of each sample was checked. After the test, the samples in which the content of the acid-processed gelatin fell within the scope of the present invention and which were found most preferred were the samples which were processed under the processing procedure where the amount of the replenisher which is added to the final rinsing step fell within the scope of the present invention.

EXAMPLE 12

A multilayer color photographic material (Sample 10-A) was prepared by forming the layers having the compositions mentioned below on a subbing layer-coated cellulose triacetate film support. As the gelatin, an alkali-processed gelatin having an isoelectric point of 5.0 was used in every layer.

Layer Constitution

The amount coated was represented by the unit of g/$m^2$ (as silver) for silver halide and colloidal silver, by the unit of g/$m^2$ for coupler, additives and gelatin, and by the unit of mol per mol of the silver halide in the same layer for sensitizing dye.

| | |
|---|---|
| First Layer: Antihalation Layer | |
| Black Colloidal Silver | 0.2 |
| Gelatin | 1.3 |
| Compound (A-143) | 0.06 |
| Compound (A-141) | 0.1 |
| Compound (A-142) | 0.2 |
| Solvent (Solv-1) | 0.01 |
| Solvent (Solv-2) | 0.01 |
| Second Layer: Interlayer | |
| Fine Silver Bromide Grains (mean grain size: 0.07 μm) | 0.10 |
| Gelatin | 1.5 |
| Compound (A-141) | 0.06 |
| Compound (A-142) | 0.03 |
| Compound (A-145) | 0.02 |
| Compound (A-144) | 0.004 |
| Solvent (Solv-2) | 0.1 |
| Solvent (Solv-1) | 0.09 |
| Third Layer: First Red-Sensitive Emulsion Layer | |
| Silver Iodobromide Emulsion (AgI 2 mol %, AgI-rich in inside part, diameter of the corresponding sphere 0.3 μm, fluctuation coefficient of the corresponding sphere diameter 29%, normal crystal/twin crystal mixture grains, | 0.4 as Ag |

-continued

| | |
|---|---|
| aspect ratio (diameter/thickness) 2.5) | |
| Gelatin | 0.6 |
| Compound (A-156) | $1.0 \times 10^{-4}$ |
| Compound (A-127) | $3.0 \times 10^{-4}$ |
| Compound (A-157) | $1 \times 10^{-5}$ |
| Compound (A-146) | 0.06 |
| Compound (A-147) | 0.06 |
| Compound (A-151) | 0.04 |
| Solvent (Solv-2) | 0.03 |
| Solvent (Solv-7) | 0.012 |
| Fourth Layer: Second Red-Sensitive Emulsion Layer | |
| Silver Iodobromide Emulsion (AgI 5 mol %, AgI-rich in inside part, diameter of the corresponding sphere 0.7 μm, fluctuation coefficient of the corresponding sphere diameter 25%, normal crystal/twin crystal mixture grains, aspect ratio (diameter/thickness) 4) | 0.7 as Ag |
| Gelatin | 2.5 |
| Compound (A-156) | $1 \times 10^{-4}$ |
| Compound (A-127) | $3 \times 10^{-4}$ |
| Compound (A-157) | $1 \times 10^{-5}$ |
| Compound (A-146) | 0.24 |
| Compound (A-147) | 0.24 |
| Compound (A-151) | 0.04 |
| Compound (A-145) | 0.04 |
| Solvent (Solv-2) | 0.15 |
| Solvent (Solv-7) | 0.02 |
| Fifth Layer: Third Red-Sensitive Emulsion Layer | |
| Silver Iodobromide Emulsion (AgI 10 mol %, AgI-rich in inside part, diameter of the corresponding sphere 0.8 μm, fluctuation coefficient of the corresponding sphere diameter 16%, normal crystal/twin crystal mixture grains, aspect ratio (diameter/thickness) 1.3) | 1.0 as Ag |
| Gelatin | 1.0 |
| Compound (A-156) | $1 \times 10^{-4}$ |
| Compound (A-127) | $3 \times 10^{-4}$ |
| Compound (A-157) | $1 \times 10^{-5}$ |
| Compound (A-91) | 0.05 |
| Compound (A-150) | 0.1 |
| Solvent (Solv-2) | 0.01 |
| Solvent (Solv-1) | 0.05 |
| Sixth Layer: Interlayer | |
| Gelatin | 1.0 |
| Compound (A-155) | 0.03 |
| Solvent (Solv-2) | 0.05 |
| Seventh Layer: First Green-Sensitive Emulsion Layer | |
| Silver Iodobromide Emulsion (AgI 2 mol %, AgI-rich in inside part, diameter of the corresponding sphere 0.3 μm, fluctuation coefficient of the corresponding sphere diameter 28%, normal crystal/twin crystal mixture grains, aspect ratio (diameter/thickness) 2.5) | 0.30 as Ag |
| Compound (A-158) | $5 \times 10^{-4}$ |
| Compound (A-160) | $0.3 \times 10^{-4}$ |
| Compound (A-159) | $2 \times 10^{-4}$ |
| Gelatin | 1.0 |
| Compound (A-55) | 0.2 |
| Compound (A-148) | 0.03 |
| Compound (A-143) | 0.03 |
| Solvent (Solv-2) | 0.5 |
| Eighth Layer: Second Green-Sensitive Emulsion Layer | |
| Silver Iodobromide Emulsion (AgI 4 mol %, AgI-rich in inside part, diameter of the corresponding sphere 0.6 μm, fluctuation coefficient of the corresponding sphere diameter 38%, normal crystal/twin crystal mixture grains, aspect ratio (diameter/thickness) 4) | 0.4 as Ag |
| Gelatin | 0.8 |
| Compound (A-158) | $5 \times 10^{-4}$ |
| Compound (A-159) | $2 \times 10^{-4}$ |
| Compound (A-160) | $0.3 \times 10^{-4}$ |
| Compound (A-154) | 0.25 |
| Compound (A-143) | 0.03 |
| Compound (A-152) | 0.015 |

-continued

| | |
|---|---|
| Compound (A-148) | 0.01 |
| Solvent (Solv-2) | 0.2 |
| Ninth Layer: Third Green-Sensitive Emulsion Layer | |
| Silver Iodobromide Emulsion (AgI 6 mol %, AgI-rich in inside part, diameter of the corresponding sphere 1.0 μm, fluctuation coefficient of the corresponding sphere diameter 80%, normal crystal/twin crystal mixture grains, aspect ratio (diameter/thickness) 1.2) | 0.85 as Ag |
| Gelatin | 1.0 |
| Compound (A-161) | $3.5 \times 10^{-4}$ |
| Compound (A-162) | $1.4 \times 10^{-4}$ |
| Compound (A-153) | 0.01 |
| Compound (A-154) | 0.03 |
| Compound (A-52) | 0.20 |
| Compound (A-143) | 0.02 |
| Compound (A-149) | 0.02 |
| Solvent (Solv-2) | 0.20 |
| Solvent (Solv-1) | 0.05 |
| Tenth Layer: Yellow Filter Layer | |
| Gelatin | 1.2 |
| Yellow Colloidal Silver | 0.08 |
| Compound (A-106) | 0.1 |
| Solvent (Solv-2) | 0.3 |
| Eleventh Layer: First Blue-Sensitive Emulsion Layer | |
| Silver Iodobromide Emulsion (AgI 4 mol %, AgI-rich in inside part, diameter of the corresponding sphere 0.5 μm, fluctuation coefficient of the corresponding sphere diameter 15%, octahedral grains) | 0.4 as Ag |
| Gelatin | 1.0 |
| Compound (A-163) | $2 \times 10^{-4}$ |
| Compound (A-24) | 0.9 |
| Compound (A-148) | 0.07 |
| Solvent (Solv-2) | 0.2 |
| Twelfth Layer: Second Blue-Sensitive Emulsion Layer | |
| Silver Iodobromide Emulsion (AgI 10 mol %, AgI-rich in inside part, diameter of the corresponding sphere 1.3 μm, fluctuation coefficient of the corresponding sphere diameter 25%, normal crystal/twin crystal mixture grains, aspect ratio (diameter/thickness) 4.5) | 0.5 as Ag |
| Gelatin | 0.6 |
| Compound (A-163) | $1 \times 10^{-4}$ |
| Compound (A-24) | 0.25 |
| Solvent (Solv-2) | 0.07 |
| Thirteenth Layer: First Protective Layer | |
| Gelatin | 0.8 |
| Compound (A-141) | 0.1 |
| Compound (A-142) | 0.2 |
| Solvent (Solv-1) | 0.01 |
| Solvent (Solv-2) | 0.01 |
| Fourteenth Layer: Second Protective Layer | |
| Fine Silver Bromide Grains (mean grain size 0.07 μm) | 0.5 |
| Gelatin | 0.45 |
| Polymethyl Methacrylate Grains (diameter 1.5 μm) | 0.2 |
| Compound (A-164) | 0.4 |
| Compound (A-165) | 0.5 |
| Compound (A-166) | 0.5 |

In addition to the above-mentioned components, a surfactant was added to each layer as a coating assistant agent.

The sample thus prepared was designated as Sample (10-A).

Samples (10-B) to (10-I) were prepared in the same manner as the preparation of Sample (10-A), except that the kind of the gelatin for the respective first to fourteenth layers was varied as shown in Table 14 below without changing the amount of the gelatin coated.

TABLE 14

| Sample | 1st Layer (%) | 2nd Layer (%) | 3rd Layer (%) | 4th Layer (%) | 5th Layer (%) | 6th Layer (%) | 7th Layer (%) | 8th Layer (%) |
|---|---|---|---|---|---|---|---|---|
| 10-B | a: 90<br>b: 10 | a: 90<br>b: 10 | a: 90<br>b: 10 | a: 90<br>b: 10 | a: 90<br>b: 10 | a: 90<br>b: 10 | a: 90<br>b: 10 | a: 90<br>b: 10 |
| 10-C | a: 70<br>b: 30 | a: 70<br>b: 30 | a: 70<br>b: 30 | a: 70<br>b: 30 | a: 70<br>b: 30 | a: 70<br>b: 30 | a: 70<br>b: 30 | a: 70<br>b: 30 |
| 10-D | a: 70<br>c: 30 | a: 70<br>c: 30 | a: 70<br>c: 30 | a: 70<br>c: 30 | a: 70<br>c: 30 | a: 70<br>c: 30 | a: 70<br>c: 30 | a: 70<br>c: 30 |
| 10-E | a: 50<br>b: 50 | a: 50<br>b: 50 | a: 50<br>b: 50 | a: 50<br>b: 50 | a: 50<br>b: 50 | a: 50<br>b: 50 | a: 50<br>b: 50 | a: 50<br>b: 50 |
| 10-F | b: 100 | b: 100 | b: 100 | b: 100 | b: 100 | b: 100 | b: 100 | b: 100 |
| 10-G | a: 30<br>b: 70 | a: 30<br>b: 70 | a: 100 | a: 100 | a: 100 | a: 30<br>b: 70 | a: 100 | a: 100 |
| 10-H | b: 100 | b: 100 | a: 100 | a: 100 | a: 100 | b: 100 | a: 100 | a: 100 |
| 10-I | c: 100 | c: 100 | a: 100 | a: 100 | a: 100 | c: 100 | a: 100 | a: 100 |

| Sample | 9th Layer (%) | 10th Layer (%) | 11th Layer (%) | 12th Layer (%) | 13th Layer (%) | 14th Layer (%) | Proportion of Acid-Processed Gelatin to Total Gelatin (%) |
|---|---|---|---|---|---|---|---|
| 10-B | a: 90<br>b: 10 | a: 90<br>b: 10 | a: 90<br>b: 10 | a: 90<br>b: 10 | a: 90<br>b: 10 | a: 90<br>b: 10 | 10 |
| 10-C | a: 70<br>b: 30 | a: 70<br>b: 30 | a: 70<br>b: 30 | a: 70<br>b: 30 | a: 70<br>b: 30 | a: 70<br>b: 30 | 30 |
| 10-D | a: 70<br>c: 30 | a: 70<br>c: 30 | a: 70<br>c: 30 | a: 70<br>c: 30 | a: 70<br>c: 30 | a: 70<br>c: 30 | 30 |
| 10-E | a: 50<br>b: 50 | a: 50<br>b: 50 | a: 50<br>b: 50 | a: 50<br>b: 50 | a: 50<br>b: 50 | a: 50<br>b: 50 | 50 |
| 10-F | b: 100 | b: 100 | b: 100 | b: 100 | b: 100 | b: 100 | 100 |
| 10-G | a: 100 | a: 30<br>b: 70 | a: 100 | a: 100 | a: 30<br>b: 70 | a: 30<br>b: 70 | 30 |
| 10-H | a: 100 | b: 100 | a: 100 | a: 100 | b: 100 | b: 100 | 42 |
| 10-I | a: 100 | c: 100 | a: 100 | a: 100 | c: 100 | c: 100 | 42 |

a: Alkali-processed gelatin having PI of 5.0
b: Acid-processed gelatin having PI of 7.0
c: Acid-processed gelatin having PI of 9.0

Sample (10-A) was exposed and then processed with Fuji Photo Color Negative Processor FP-350, in accordance with the processing procedure as mentioned below, until the total amount of the color developer replenisher became three times of the color developer processing tank capacity.

| Processing Step | Time | Temperature (°C.) | Amount of Replenisher* (ml) | Tank Capacity (l) |
|---|---|---|---|---|
| Color Development | 3 min 15 sec | 38 | 45 | 10 |
| Bleaching | 1 min 00 sec | 38 | 20 | 4 |
| Bleach-Fixation | 3 min 15 sec | 38 | 30 | 10 |
| Rinsing (1) | 40 sec | 35 | (counter-current system from (2) to (1)) | 4 |
| Rinsing (2) | 1 min 00 sec | 35 | 30 | 4 |
| Stabilization | 40 sec | 38 | See below | 4 |
| Drying | 1 min 15 sec | 55 | | |

*The amount of the replenisher was per $m^2$ of the photographic material sample of 35 mm width which is being processed.)

In the above-mentioned procedure, the amount of the bleach-fixing solution which is brought into the rinsing bath together with the photographic material sample of 35 mm width was 2 ml/m of the photographic material.

The replenishment to the stabilization step was carried out in accordance with the three conditions as mentioned below.

(1) 0.6 ml (0.3 time of the processing solution which is brought into the stabilization bath from the previous (bleach-fixation) bath together with the photographic material which is being processed.)
(2) 20 ml (10 times of the processing solution which is brought into the stabilization bath from the previous (bleach-fixation) bath together with the photographic material which is being processed.)
(3) 120 ml (60 times of the processing solution which is brought into the stabilization bath from the previous (bleach-fixation) bath together with the photographic material which is being processed.)

The compositions of the respective processing solutions used in the above-mentioned procedure were as follows.

| | Tank Solution (g) | Replenisher (g) |
|---|---|---|
| Color Developer: | | |
| Diethylenetriaminetetraacetic Acid | 1.0 | 1.1 |
| 1-Hydroxyethylidene-1,1-diphosphonic Acid | 3.0 | 3.2 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-(N—Ethyl-N—β-hydroxyethylamino)-2-methylaniline Sulfate | 4.5 | 5.5 |
| Water to make | 1.0 l | 1.0 l |
| pH | 10.05 | 10.10 |
| Bleaching Solution: | | |

-continued

| | Tank Solution (g) | Replenisher (g) |
|---|---|---|
| (Tank solution and replenisher were the same. The unit of each component was "g", unless otherwise indicated.) | | |
| Ammonium (Ethylenediaminetetraacetato) Iron(III).$2H_2O$ | 120.0 | |
| Disodium Ethylenediaminetetraacetate | 10.0 | |
| Ammonium Bromide | 100.0 | |
| Ammonium Nitrate | 10.0 | |
| Bleach Accelerator | 0.005 mol | |

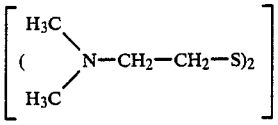

| | | |
|---|---|---|
| Aqueous Ammonia (27 wt %) | 15.0 ml | |
| Water to make | 1.0 l | |
| pH | 6.3 | |

Bleach-Fixing Solution:

| | | |
|---|---|---|
| (Tank solution and replenisher were the same. The unit of each component was "g" unless otherwise indicated.) | | |
| Ammonium (Ethylenediaminetetraacetato) Iron(III) $2H_2O$ | 50.0 | |
| Disodium Ethylenediaminetetraacetate | 5.0 | |
| Sodium Sulfite | 12.0 | |
| Aqueous Ammonium Thiosulfate Solution (70 wt %) | 240.0 ml | |
| Aqueous Ammonia (27 wt %) | 6.0 ml | |
| Water to make | 1.0 l | |
| pH | 7.2 | |

Rinsing Solution

Tank solution and replenisher were the same. A city water was introduced into a mixed bed column filled with an H-type strong acidic cation exchange resin (Rohm & Haas Co., Amberlite IR-120B) and an OH-type anion exchange resin (Rohm & Haas Co., Amberlite IR-400) so that the calcium ion and magnesium ion concentration was reduced to 3 mg/liter, and then 20 mg/liter of sodium dichloroisocyanurate and 150 mg/liter of sodium sulfate were added thereto. The thus processed water was used as the rinsing solution. The solution had a pH value of from 6.5 to 7.5.

Stabilization Solution:

| | |
|---|---|
| (Tank solution and replenisher was the same. The unit of each component was "g" unless otherwise indicated.) | |
| Formalin (37 wt %) | 2.0 ml |
| Polyoxyethylene-p-monononylphenylether (mean polymerization degree 10) | 0.3 |
| Disodium Ethylenediaminetetraacetate | 0.05 |
| Water to make | 1.0 l |
| pH | 5.0–8.0 |

Next, Samples (10-A) to (10-I) were imagewise exposed and then processed with the processing solutions used in the above-mentioned running procedure. After being thus processed, the samples were stored for 30 days under the condition of 80° C. and 70% RH, and the yellow, magenta and cyan stain densities in the minimum density part ($D_{min}$) were measured with a Macbeth densitometer. In addition, the samples were also stored for 15 days at 80° C. and then the discoloration percentage ($D_R=1.2$) of the cyan dye density was also measured with a Macbeth densitometer. The results obtained were shown in Table 15 below. The stain shown in Table 15 represents the increment from the fresh sample (immediately after processed).

TABLE 15

| No. | Sample | Replenisher to Stabilization Bath | Yellow | Magenta | Cyan | Discoloration of Cyan Color (%) | Note |
|---|---|---|---|---|---|---|---|
| 1 | 10-A | 0.3 time | 0.16 | 0.18 | 0.09 | 11.7 | Comparison |
| 2 | 10-B | " | 0.15 | 0.17 | 0.10 | 12.5 | " |
| 3 | 10-C | " | 0.16 | 0.19 | 0.09 | 12.5 | " |
| 4 | 10-D | " | 0.16 | 0.18 | 0.09 | 11.7 | " |
| 5 | 10-E | " | 0.15 | 0.17 | 0.08 | 11.7 | " |
| 6 | 10-F | " | 0.15 | 0.17 | 0.09 | 10.8 | " |
| 7 | 10-G | " | 0.16 | 0.17 | 0.08 | 12.5 | " |
| 8 | 10-H | " | 0.15 | 0.16 | 0.09 | 11.7 | " |
| 9 | 10-I | " | 0.14 | 0.16 | 0.08 | 10.8 | " |
| 10 | 10-A | 10 times | 0.11 | 0.12 | 0.07 | 11.7 | " |
| 11 | 10-B | " | 0.10 | 0.12 | 0.06 | 11.7 | " |
| 12 | 10-C | " | 0.07 | 0.09 | 0.04 | 12.5 | Invention |
| 13 | 10-D | " | 0.05 | 0.07 | 0.03 | 11.7 | " |
| 14 | 10-E | " | 0.05 | 0.07 | 0.03 | 10.8 | " |
| 15 | 10-F | " | 0.04 | 0.06 | 0.02 | 10.8 | " |
| 16 | 10-G | " | 0.06 | 0.09 | 0.03 | 11.7 | " |
| 17 | 10-H | " | 0.06 | 0.08 | 0.03 | 10.8 | " |
| 18 | 10-I | " | 0.04 | 0.06 | 0.02 | 10.8 | " |
| 19 | 10-A | 60 times | 0.05 | 0.07 | 0.04 | 15.8 | Comparison |
| 20 | 10-B | " | 0.05 | 0.07 | 0.03 | 16.7 | " |
| 21 | 10-C | " | 0.04 | 0.06 | 0.03 | 15.8 | " |
| 22 | 10-D | " | 0.04 | 0.06 | 0.02 | 15.8 | " |
| 23 | 10-E | " | 0.04 | 0.05 | 0.02 | 15.0 | " |
| 24 | 10-F | " | 0.04 | 0.05 | 0.02 | 15.8 | " |
| 25 | 10-G | " | 0.05 | 0.06 | 0.02 | 16.7 | " |
| 26 | 10-H | " | 0.04 | 0.05 | 0.02 | 15.8 | " |
| 27 | 10-I | " | 0.03 | 0.05 | 0.02 | 15.0 | " |

The results of Table 15 demonstrate as follows. When the amount of the replenisher to the stabilization bath and the content of the acid-processed gelatin in the photographic material to be processed each fell within the scope as defined in the present invention, the image storability was most excellent (Sample Nos. 12 to 18). In particular, the photographic materials in which the content of the acid-processed gelatin was 50% by weight or more were especially preferably (Sample Nos. 14 and 15), and the photographic materials containing an acid gelatin having an isoelectric point of 8 or more were also especially preferable (Sample Nos. 13 and 18).

EXAMPLE 13

A multilayer color photographic material (Sample 11-A) was prepared by forming the layers having the compositions mentioned below on a paper support both surfaces of which were coated with polyethylene. As the gelatin, an alkali-processed gelatin having an isoelectric point of 5.0 was used in every layer.

B2 Layer: Protective Layer
B1 Layer: Curling Preventing Layer
Support
E1 Layer: Red-Sensitive Emulsion Layer
E2 Layer: Ultraviolet Absorbing Layer
E3 Layer: Green-Sensitive Emulsion Layer
E4 Layer: Ultraviolet Absorbing Layer
E5 Layer: Yellow Filter Layer
E6 Layer: Ultraviolet Absorbing Layer
E7 Layer: Blue-Sensitive Emulsion Layer
E8 Layer: Ultraviolet Absorbing Layer
E9 Layer: Protective Layer The coating compositions for the layers were prepared as follows:

Coating Composition for E1 Layer 40 cc of ethyl acetate and 7.7 cc of solvent (Solv-2) were added to 13.4 g of a cyan coupler, Compound (A-60), 5.7 g of a color image stabilizer, Compounds (A-115)/(A-110)/(A-112)=5/8/9 (by weight), and 10.7 g of a polymer, Compound (A-114), and dissolved, and the resulting solution was dispersed by emulsification in 185 cc of an aqueous 10 wt% gelatin solution containing 8 cc of a 10 wt% sodium dodecylbenzenesulfonate. On the other hand, an emulsion was prepared by adding the red-sensitive sensitizing dye as mentioned below to an internal latent image type emulsion (containing 63 kg/g of silver) in an amount of $2.5\times10^{-4}$ mol per mol of silver. The above-mentioned emulsified dispersion and the resulting red-sensitive emulsion were blended and dissolved to provide the coating composition for the first layer having the composition as mentioned below. Coating compositions for the E2 layer to E9 layer and the B1 layer and B2 layer were also prepared in the same manner as the preparation of the coating composition for the E1 layer. As the gelatin hardening agent for each layer, 1-hydroxy-3,5-dichloro-s-triazine sodium salt was used.

As the spectral sensitizing dyes for the respective layers, the following compounds were used.

For red-sensitive emulsion layer: Compound (A-127) ($2.5\times10^{-4}$ mol per mol of silver halide)

For green-sensitive emulsion layer: Compound (A-167) ($3.1\times10^{-4}$ mol per mol of silver halide)

For blue-sensitive emulsion layer: Compound (A-168) ($4.3\times10^{-4}$ mol per mol of silver halide)

As the anti-irradiation dye, the following compounds were used.

For green-sensitive emulsion layer: Compound (A-125)

For red-sensitive emulsion layer: Compound (A-124)

The compositions of the respective layers are mentioned below. The number which appears after each component means the amount coated (g/m$^2$) for that component. The amount coated of the silver halide emulsion and the amount coated of the colloidal silver each mean the amount coated of silver therein.

| | |
|---|---|
| Support: | |
| Polyethylene-coated Paper, containing a white pigment ($TiO_2$) and a blueish dye (ultramarine) in the polyethylene coat for the first layer. | |
| E1 Layer | |
| Support: | |
| Silver Halide Emulsion | 0.39 g |
| Gelatin | 1.35 g |
| Cyan Coupler, Compound (A-60) | 0.40 g |
| Color Image Stabilizer, Compounds (A-115)/(A-110)/(A-112) = 5/8/9 (by weight) | 0.17 g |
| Polymer, Compound (A-114) | 0.32 g |
| Solvent (Solv-2) | 0.23 g |
| Development Controlling Agent, Compound (A-132) | 32 mg |
| Stabilizer (ExA-1) | 5.8 mg |
| Nucleation Accelerator (ExZS-1) | 0.37 mg |
| Nucleation Agent (ExZK-1) | 9.9 g |
| E2 Layer: | |
| Gelatin | 1.6 g |
| Ultraviolet Absorbent, Compounds (A-115)/(A-110)/(A-112) = 2/9/8 (by weight) | 0.62 g |
| Color Mixing Preventing Agent, Compound (A-106) | 0.06 g |
| Solvent (Solv-4) | 0.24 g |
| E3 Layer | |
| Silver Halide Emulsion | 0.27 g |
| Gelatin | 1.79 g |
| Magenta Coupler, Compound (A-39) | 0.32 g |
| Color Image Stabilizer, Compounds (A-115)/(A-110)/(A-112) = 5/8/9 (by weight) | 0.20 g |
| Solvent (Solv-2)/(Solv-6) = ½ (by volume) | 0.65 g |
| Development Controlling Agent, Compound (A-133) | 22 mg |
| Stabilizer (ExA-1) | 4 mg |
| Nucleation Accelerator (ExZS-1) | 0.26 m |
| Nucleating Agent (ExZK-1) | 3.4 g |
| E4 Layer: | |
| Gelatin | 0.53 g |
| Ultraviolet Absorbent, Compound (A-115)/(A-110)/(A-112) = 2/9/8 (by weight) | 0.21 g |
| Color Mixing Preventing Agent, Compound (A-113) | 0.02 g |
| Solvent (Solv-4) | 0.08 g |
| E5 Layer: | |
| Colloidal Silver | 0.10 g |
| Gelatin | 0.53 g |
| Ultraviolet Absorbent, Compounds (A-115)/(A-110)/(A-112) = 2/9/8 (by weight) | 0.21 g |
| Color Mixing Preventing Agent, Compound (A-113) | 0.02 g |
| Solvent (Solv-4) | 0.08 g |
| E6 Layer: | |
| Same as E4 Layer | |
| E7 Layer: | |
| Silver halide Emulsion | 0.26 g |
| Gelatin | 1.83 g |
| Yellow Coupler, Compound (A-19) | 0.83 g |
| Color Image Stabilizer, Compound (A-104) | 0.19 g |
| Solvent (Solv-1) | 0.35 g |
| Development Controlling Agent, Compound (A-133) | 32 mg |
| Stabilizer (ExA-1) | 2.9 mg |
| Nucleation Accelerator (ExZS-1) | 0.2 mg |
| Nucleating Agent (ExZK-1) | 2.5 μg |
| E8 Layer: | |
| Gelatin | 0.53 g |
| Ultraviolet Absorbent, Compound (A-141) | 0.21 g |
| Solvent (Solv-4) | 0.08 g |
| E9 Layer: | |
| Gelatin | 1.33 g |
| Acryl-Modified Copolymer of Polyvinyl Alcohol (modification degree: 17%) | 0.17 g |
| Liquid Paraffin | 0.03 g |
| Latex Grains of Polymethyl Methacrylate (mean grain size: 2.8 μm) | |

-continued

| | |
|---|---|
| B1 Layer: | |
| Gelatin | 8.7 g |
| B2 Layer: | |
| Same as E9 Layer. | |
| Stabilizer (ExA-1): | |
| 4-Hydroxy-6-methyl-1,3,3a,7-tetraazaindene | |
| (ExZS-1): | |
| 2-(3-Dimethylaminopropylthio)-5-mercapto-1,3,4-thiadiazole Hydrochloride | |
| (ExZK-1): | |
| 6-Ethoxythiocarbonylamino-2-methyl-1-propargylquinolinium Trifluoromethanesulfonate | |

The internal latent image type emulsion was prepared as follows.

A mixed aqueous solution of potassium bromide and sodium chloride and an aqueous solution of silver nitrate were simultaneously added to an aqueous gelatin solution to which 1,3-dimethyl-1,3-imidazoline-2-thione had been added in an amount of 0.7 g per mol of silver with vigorously stirring at 65° C. over about 7 minutes to provide a monodispersed silver chlorobromide emulsion (silver bromide content: 70 mol%) having a mean grain size of about 0.21 mm. To the resulting emulsion were added 110 mg/mol(Ag) of sodium thiosulfate and 77 mg/mol(Ag) of chloroauric acid ($4H_2O$), and the whole was heated at 65° C. for 60 minutes for chemical sensitization of the emulsion. The thus formed silver chlorobromide grain cores were grown further in the same flocculation environment as the first treatment to finally provide a monodispersed core/shell silver chlorobromide emulsion having a mean grain size of 0.6 mm (silver bromide content: 70 mol%). The fluctuation coefficient of the grain size was about 12%.

After the emulsion was washed in water and demineralized, 1.2 mg/mol(Ag) of sodium thiosulfate and 1.2 mg/mol(Ag) of chloroauric acid ($4H_2O$) were added to the resulting emulsion and the whole was heated at 60° C. for 60 minutes for chemical sensitization of the emulsion to obtain an internal latent image type silver halide emulsion.

Next, Samples (11-B) to (11-E) were prepared in the same manner as in the preparation of Sample (11-A), except that the kind of the gelatin in the E1 to E9 layers and in the B1 and B2 layers was varied as shown in Table 16 below without changing the amount of the gelatin coated.

TABLE 16

| Sample | E1 Layer (%) | E2 Layer (%) | E3 Layer (%) | E4 Layer (%) | E5 Layer (%) | E6 Layer (%) | E7 Layer (%) | E8 Layer (%) | E9 Layer (%) | B1 Layer (%) | B2 Layer (%) | Proportion of Acid-Processed Gelatin to Total Gelatin (%) |
|---|---|---|---|---|---|---|---|---|---|---|---|---|
| 11-B | a: 90 | a: 90 | a: 90 | a: 90 | a: 90 | a: 90 | a: 90 | a: 90 | a: 90 | a: 90 | a: 90 | 10 |
| | b: 10 | b: 10 | b: 10 | b: 10 | b: 10 | b: 10 | b: 10 | b: 10 | b: 10 | b: 10 | b: 10 | |
| 11-C | a: 70 | a: 70 | a: 70 | a: 70 | a: 70 | a: 70 | a: 70 | a: 70 | a: 70 | a: 70 | a: 70 | 30 |
| | b: 30 | b: 30 | b: 30 | b: 30 | b: 30 | b: 30 | b: 30 | b: 30 | b: 30 | b: 30 | b: 30 | |
| 11-D | a: 50 | a: 50 | a: 50 | a: 50 | a: 50 | a: 50 | a: 50 | a: 50 | a: 50 | a: 50 | a: 50 | 50 |
| | b: 50 | b: 50 | b: 50 | b: 50 | b: 50 | b: 50 | b: 50 | b: 50 | b: 50 | b: 50 | b: 50 | |
| 11-E | b: 100 | b: 100 | b: 100 | b: 100 | b: 100 | b: 100 | b: 100 | b: 100 | b: 100 | b: 100 | b: 100 | 100 |

a: Alkali-processed gelatin having PI of 5.0
b: Acid-processed gelatin having PI of 7.0

Sample (11-A) was imagewise exposed and then processed in accordance with the running procedure as mentioned below. The amount of the processing solution which is brought into the respective bath from the previous bath together with the photographic material which is being processed was 50 ml per $m^2$ of the photographic material.

| Processing Step | Temperature (°C.) | Time | Amount of Replenisher* (ml) | Tank Capacity (l) |
|---|---|---|---|---|
| Color Development | 38 | 1 min 40 sec | 300 | 10 |
| Bleach-Fixation | 33 | 60 sec | 300 | 5 |
| Rinsing (1) | 30–34 | 20 sec | — | 2 |
| Rinsing (2) | 30–34 | 20 sec | See below | 2 |
| Drying | 70–80 | 50 sec | | |

*Amount per $m^2$ of photographic materal which is being processed.

(The rinsing step was carried out by a two-tank countercurrent system in which water flowed from the last rinsing tank (2) to the first rinsing tank (1) and the photographic material passed through the rinsing tanks in countercurrent by first entering rinsing tank (1) and then entering rinsing tank (2).)

The amount of the replenisher to the rinsing tank (2) was carried out in accordance with the following three conditions.

(1) 15 ml (0.3 time of the processing solution which is brought into rinsing tank (1) from the previous (bleach-fixation) bath)
(2) 300 ml (6.0 times of the processing solution which is brought into rinsing tank (1) from the previous (bleach-fixation) bath)
(3) 300 ml (60 times of the processing solution which is brought into rinsing tank (1) from the previous (bleach-fixation) bath)

The compositions of the respective processing solutions were as follows.

| | Tank Solution | Replenisher |
|---|---|---|
| Color Developer: | | |
| Water | 800 ml | 800 ml |
| Diethylenetriaminepentaacetic Acid | 1.0 g | 1.0 g |
| Nitrilotriacetic Acid | 2.0 g | 2.0 g |
| 1-Hydroxyethylidene-1,1-diphosphonic Acid | 2.0 g | 2.0 g |
| Triethylenediamine(1,4-diazabicyclo-2,2,2 octane) | 5.0 g | 5.0 g |
| Potassium Bromide | 1.5 g | — |
| Potassium Carbonate | 30 g | 30 g |
| N—Ethyl-N—(β-methanesulfonamidoethyl)-3-methyl-4-aminoaniline Sulfate | 5.5 g | 7.5 g |
| N,N—Diethylhydroxylamine | 3.6 g | 5.5 g |
| Triethanolamine | 10.0 g | 10.0 g |
| Brightening Agent (WHITEX 4B, by Sumitomo Chemical Co.) | 1.5 g | 2.0 g |

-continued

| | Tank Solution | Replenisher |
|---|---|---|
| Water to make | 1,000 ml | 1,000 ml |
| pH (25° C.) | 10.20 | 10.60 |
| Bleach-Fixing Solution: | | |
| Water | 400 ml | 400 ml |
| Ammonium Thiosulfate (70 wt %) | 200 ml | 300 ml |
| Sodium Sulfite | 20 g | 40 g |
| Ammonium (Ethylenediaminetetraacetato) Iron(III) | 60 g | 120 g |
| Disodium Ethylenediaminetetraacetate | 5 g | 10 g |
| Water to make | 1,000 ml | 1,000 ml |
| pH (25° C.) | 6.70 | 6.30 |
| (Tank solution and replenisher were the same.) | | |
| Rinsing Solution: | | |
| Benzotriazole | 1.0 g | |
| Ethylenediamine-N,N,N',N'—tetra-methylenephosphonic Acid | 0.3 g | |
| KOH to make pH | 7.0 | |
| Water to make | 1,000 ml | |

Next, Samples (11-A) to (11-E) were imagewise exposed and then processed with the processing solutions used in the above-mentioned running procedure. After being thus processed, the samples were stored for 10 days under the condition of 80° C. and 70% RH, and the yellow, magenta and cyan stain densities in the white background part ($D_{min}$) were measured with a Macbeth densitometer. In addition, the samples were exposed to a xenon light (85,000 lux, distance 50 cm) for 12 days and then the discoloration percentage ($D_G$=2.0) of the magenta density was also measured with a Macbeth densitometer in every sample. The results obtained are shown in Table 17 below. The stain density shown in Table 17 represents the increment from the fresh sample (immediately after processed).

TABLE 17

| No. | Sample | Replenisher To Rinsing Tank (2) | Yellow | Magenta | Cyan | Discoloration of Magenta Color (%) | Note |
|---|---|---|---|---|---|---|---|
| 1 | 11-A | 0.3 time | 0.32 | 0.51 | 0.20 | 28 | Comparison |
| 2 | 11-B | " | 0.31 | 0.50 | 0.21 | 29 | " |
| 3 | 11-C | " | 0.29 | 0.50 | 0.20 | 29 | " |
| 4 | 11-D | " | 0.29 | 0.49 | 0.19 | 28 | " |
| 5 | 11-E | " | 0.27 | 0.48 | 0.19 | 28 | " |
| 6 | 11-A | 6.0 times | 0.18 | 0.29 | 0.12 | 29 | " |
| 7 | 11-B | " | 0.67 | 0.28 | 0.11 | 28 | " |
| 8 | 11-C | " | 0.12 | 0.15 | 0.06 | 28 | Invention |
| 9 | 11-D | " | 0.10 | 0.12 | 0.05 | 27 | " |
| 10 | 11-E | " | 0.09 | 0.11 | 0.04 | 27 | " |
| 11 | 11-A | 60 times | 0.12 | 0.13 | 0.04 | 35 | Comparison |
| 12 | 11-B | " | 0.12 | 0.12 | 0.04 | 36 | " |
| 13 | 11-C | " | 0.10 | 0.11 | 0.04 | 34 | " |
| 14 | 11-D | " | 0.10 | 0.10 | 0.04 | 33 | " |
| 15 | 11-E | " | 0.09 | 0.10 | 0.03 | 33 | " |

The results of Table 17 demonstrate as follows: When the amount of the replenisher to the final rinsing bath and the content of the acid-processed gelatin in the photographic material to be processed each fell within the scope as defined in the present invention, the image storability was most excellent (Sample Nos. 8 to 10). In particular, the photographic materials in which the content of the acid-processed gelatin was 50% by weight or more were especially preferable (Sample Nos. 9 and 10).

While the invention has been described in detail and with reference to specific embodiments thereof, it will be apparent to one skilled in the art that various changes and modifications can be made therein without departing from the spirit and scope thereof.

What is claimed is:

1. A method of forming color images where a silver halide color photographic material containing a coupler which forms a dye by reaction with the oxidation product of an aromatic primary amine developing agent and containing an acid-processed gelatin in an amount of 25% by weight or more of the amount of the total gelatin coated is color developed, desilvered and then rinsed in water and/or stabilized, comprising: controlling the total of the processing time of the desilvering, rinsing-in-water and stabilization step to be 3 minutes or less, and/or controlling the amount of replenisher added to the rinsing-in-water bath and stabilization bath to be from 0.5 to 50 times of the amount of the processing solution which is brought into the rinsing-in-water bath and stabilization bath from the desilvering bath together with the material which is being processed.

2. A method of forming color images as in claim 1, wherein the color developer for color development does not substantially contain any sulfite ion.

3. A method of forming color images as in claim 1, wherein the total amount of the gelatin coated is from 1 to 30 g per $m^2$ of the photographic material.

4. A method of forming color images as in claim 3, wherein the total amount of the gelatin coated is from 2 to 20 g per $m^2$ of the photographic material.

5. A method of forming color images as in claim 1, wherein the amount of the acid-processed gelatin in the photographic material is 40 wt% or more of the amount of the total gelatin coated.

6. A method of forming color images as in claim 5, wherein the amount of the acid-processed gelatin in the photographic material is 50 wt% or more of the amount of the total gelatin coated.

7. A method of forming color images as in claim 1, wherein the acid-processed gelatin in the photographic material has an isoelectric point of from 6 to 9.5.

8. A method of forming color images as in claim 7, wherein the acid-processed gelatin in the photographic material has an isoelectric point of from 7 to 9.5.

9. A method of forming color images as in claim 7, wherein the acid-processed gelatin in the photographic material has an isoelectric point of from 8 to 9.5.

10. A method of forming color images as in claim 1, wherein the photographic material contains a yellow coupler of general formula (I), a magenta coupler of general formula (II) or (III) and/or a cyan coupler of general formula (IV) or (V):

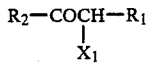

(I)

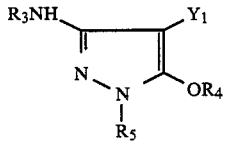

(II)

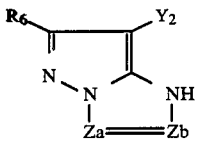

(III)

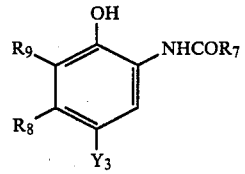

(IV)

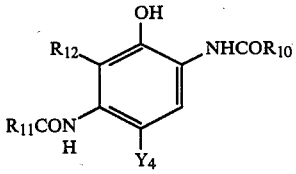

(V)

in which $R_1$ represents a substituted or unsubstituted N-phenylcarbamoyl group; $R_2$ represents a tertiary alkyl group having from 4 to 20 carbon atoms or a substituted or unsubstituted phenyl group; $R_3$ and $R_5$ each represents a substituted or unsubstituted phenyl group; $R_4$ represents a hydrogen atom, an aliphatic or aromatic acyl group, or an aliphatic or aromatic sulfonyl group; $R_6$ represents a hydrogen atom or a substituent; $R_7$, $R_{10}$ and $R_{11}$ each represents an aliphatic group, an aromatic group, a heterocyclic group, an aromatic amino group or a heterocyclic amino group; $R_8$ represents an aliphatic group; $R_9$ and $R_{12}$ each represents a hydrogen atom, a halogen atom, an aliphatic group, an aliphatic oxy group or an arylamino group; Za and Zb each represents a methine group, a substituted methine group or =N—; $X_1$, $Y_1$, $Y_2$, $Y_3$ and $Y_4$ each represents a group capable of being released by a coupling reaction with the oxidation product of a developing agent; and $R_1$, $R_2$ or $X_1$; $R_3$, $R_4$, $R_5$ or $Y_1$; $R_6$, Za, Zb or $Y_2$; $R_7$, $R_8$, $R_9$ or $Y_3$; $R_{10}$, $R_{11}$, $R_{12}$ or Y may form a dimer or a higher polymer.

11. A method of forming color images as in claim 10, wherein the photographic material contains a yellow coupler, a magenta coupler and a cyan coupler.

12. A method of forming color images as in claim 10, wherein $X_1$ in the formula (I) represents a group of general formula (VI), (VII) or (VIII):

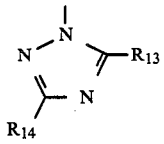

(VI)

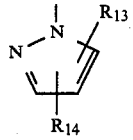

(VII)

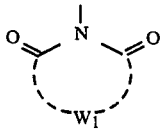

(VIII)

in which $R_{13}$ and $R_{14}$ each represents a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, a substituted or unsubstituted phenyl group or a heterocyclic group; $W_1$ represents a nonmetallic atomic group necessary for forming a 4-membered, 5-membered or 6-membered ring together with the moiety

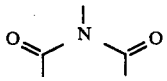

in the formula.

13. A method of forming color images as in claim 1, wherein the color developer for color development does not substantially contain benzyl alcohol.

14. A method of forming color images as in claim 1, wherein the processing time of the desilvering step is 2 minutes or less.

15. A method of forming color images as in claim 14, wherein the processing time of the desilvering step is from 15 seconds to 60 seconds.

16. A method of forming color images as in claim 1, wherein the total of the processing time of the desilvering, rinsing-in-water and stabilization steps is from 30 seconds to 2 minutes and 30 seconds.

17. A method of forming color images as in claim 1, wherein the amount of the replenisher to the rinsing-in-water bath and stabilization bath is from 3 to 40 times of the amount of the processing solution which is brought into said bath from the previous bath together with the material which is being processed.

* * * * *